US008172643B2

(12) United States Patent
Yilmaz et al.

(10) Patent No.: US 8,172,643 B2
(45) Date of Patent: May 8, 2012

(54) POLISHING SYSTEM HAVING A TRACK

(75) Inventors: Alpay Yilmaz, San Jose, CA (US); Allen L. D'Ambra, Burlingame, CA (US); Jagan Rangarajan, Fremont, CA (US); Lakshmanan Karuppiah, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 527 days.

(21) Appl. No.: 12/420,996

(22) Filed: Apr. 9, 2009

(65) Prior Publication Data

US 2009/0258574 A1 Oct. 15, 2009

Related U.S. Application Data

(60) Provisional application No. 61/043,582, filed on Apr. 9, 2008, provisional application No. 61/043,600, filed on Apr. 9, 2008, provisional application No. 61/056,384, filed on May 27, 2008, provisional application No. 61/056,256, filed on May 27, 2008, provisional application No. 61/087,124, filed on Aug. 7, 2008, provisional application No. 61/087,127, filed on Aug. 7, 2008.

(51) Int. Cl.
*B24B 49/00* (2012.01)
*B24B 5/00* (2006.01)

(52) U.S. Cl. ..... 451/11; 451/285; 451/6

(58) Field of Classification Search ..... 451/9–11, 451/285–289, 5, 6
See application file for complete search history.

(56) References Cited

U.S. PATENT DOCUMENTS

| | | | | |
|---|---|---|---|---|
| 6,155,717 | A | 12/2000 | Michioka et al. | |
| 6,500,051 | B1 * | 12/2002 | Nishi et al. | 451/41 |
| 6,602,121 | B1 | 8/2003 | Halley | |
| 6,705,430 | B2 | 3/2004 | Michioka et al. | |
| 6,780,091 | B2 * | 8/2004 | Mizomoto et al. | 451/67 |
| 6,877,900 | B2 | 4/2005 | Mochizuki et al. | |
| 6,919,653 | B2 | 7/2005 | Thirunarayan et al. | |
| 6,919,654 | B2 | 7/2005 | Harned et al. | |
| 7,011,567 | B2 * | 3/2006 | Gerber | 451/11 |
| 7,183,689 | B2 | 2/2007 | Schmidt et al. | |
| 7,306,509 | B2 * | 12/2007 | Hoshino | 451/41 |
| 2003/0059134 | A1 | 3/2003 | Mochizuki et al. | |
| 2006/0148384 | A1 | 7/2006 | Izumi | |
| 2007/0247008 | A1 | 10/2007 | Miyamoto | |
| 2007/0278863 | A1 | 12/2007 | Yamamoto et al. | |

FOREIGN PATENT DOCUMENTS

| | | |
|---|---|---|
| JP | 2000-024914 | 1/2000 |
| WO | WO-94/04404 | 3/1994 |

OTHER PUBLICATIONS

International Search Report and Written Opinion dated Dec. 3, 2009 for International Application No. PCT/US2009/040099.

* cited by examiner

*Primary Examiner* — Dung Van Nguyen
(74) *Attorney, Agent, or Firm* — Patterson & Sheridan, LLP

(57) ABSTRACT

Embodiments described herein relate to a track system in a polishing system. One embodiment described herein provides a track system configured to transfer polishing heads in a polishing system. The track system comprises a supporting frame, a track coupled to the supporting frame and defining a path along which the polishing heads are configured to move, and one or more carriages configured to carry at least one polishing head along the path defined by the track, wherein the one or more carriages are coupled to the track and independently movable along the track.

21 Claims, 42 Drawing Sheets

POLISHING SYSTEM HAVING A TRACK

CROSS-REFERENCE TO RELATED APPLICATIONS

This application claims benefit of U.S. Provisional Patent Application Ser. No. 61/043,582, filed Apr. 9, 2008, U.S. Provisional Patent Application Ser. No. 61/043,600, filed Apr. 9, 2008, U.S. Provisional Patent Application Ser. No. 61/056,384, filed May 27, 2008, U.S. Provisional Patent Application Ser. No. 61/056,256, filed May 27, 2008, U.S. Provisional Patent Application Ser. No. 61/087,124, filed Aug. 7, 2008, and U.S. Provisional Patent Application Ser. No. 61/087,127, filed Aug. 7, 2008, all of which are herein incorporated by reference in their entirety.

BACKGROUND

1. Field

Embodiments described herein relate to an apparatus and a method for processing semiconductor substrates. More particularly, embodiments described herein provide apparatus and methods for transferring and actuating polishing heads during polishing.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

In the fabrication of integrated circuits and other electronic devices, multiple layers of conductive, semi-conductive, and dielectric materials are deposited on or removed from a surface of a substrate. Thin layers of conductive, semiconductive, and dielectric materials may be deposited by a number of deposition techniques. As layers of materials are sequentially deposited and removed, the uppermost surface of the substrate may become non-planar across its surface and require planarization.

Planarization may be performed using Chemical Mechanical Polishing (CMP) and/or Electro-Chemical Mechanical Deposition (ECMP). A planarization method typically requires that the substrate be mounted in a wafer head, with the surface of the substrate to be polished exposed. The substrate supported by the head is then placed against a rotating polishing pad. The head holding the substrate may also rotate, to provide additional motion between the substrate and the polishing pad surface. Further, a polishing slurry (typically including an abrasive and at least one chemically reactive agent therein, which are selected to enhance the polishing of the topmost film layer of the substrate) is supplied to the pad to provide an abrasive chemical solution at the interface between the pad and the substrate. The combination of polishing pad characteristics, the specific slurry mixture, and other polishing parameters can provide specific polishing characteristics.

Polishing may be performed in multiple steps, each having specific polishing characteristics, to achieve desired results. A polishing system typically has two or more polishing pads configured to perform different polishing steps, and a substrate transfer assembly configured to transfer the substrates among the two or more polishing pads.

However, it remains challenging to achieve high throughput and flexibility to meet process requirements in a polishing system.

Therefore, there is a need for a polishing apparatus which provides improved polishing throughput, quality, and flexibility.

SUMMARY

Embodiments described herein relate to a polishing system. More particularly, embodiments described herein relate to a track system configured to transfer and actuate polishing heads in a polishing system.

In one embodiment described herein a track system configured to transfer polishing heads in a polishing system comprising a supporting frame, a track coupled to the supporting frame and defining a path along which the polishing heads are configured to move, and one or more carriages configured to carry at least one polishing head along the path defined by the track, wherein the one or more carriages are coupled to the track and independently movable along the track is provided.

In another embodiment described herein a track system for transferring polishing heads in a polishing system comprising a supporting frame, a guiding rail coupled to the supporting frame, wherein the guiding rail defines a path along which the polishing ahead is configured to travel, a magnetic track disposed along the guiding rail, an encoder scale disposed along the guiding rail, and one or more sliding carriages movably coupled to the guiding rail and each configured to move a polishing head along the path, wherein each of the one or more sliding carriages comprises a segment motor configured to independently actuate the respective sliding carriage by interacting with the magnetic track, and an encoder sensor directed at the encoder scale and configured to measure a position of the respective sliding carriage along the path is provided.

In yet another embodiment described herein a method for polishing semiconductor substrates is provided. The method comprises loading a substrate onto a polishing head configured to transfer the substrate among loading, unloading and polishing stations, moving the polishing head along a track system to a first polishing station, wherein the system comprises a supporting frame, a track coupled to the supporting frame and defining a path along which the polishing heads have access to the loading, unloading and polishing stations, and one or more carriages configured to carry at least one polishing head along the path defined by the track, wherein the one or more carriages are coupled to the track and independently movable along the track, and polishing the substrate at the first polishing station.

In yet another embodiment described herein a polishing head for a polishing system having a track is provided. The polishing head comprises a carriage body, one or more guide blocks mounted on the carriage body, wherein the one or more guide blocks are configured to couple with a track and restrict movements of the carriage body to along the track, a sliding actuator connected to the carriage body and configured to move the carriage body along the track, a first polishing motor connected with the carriage body, wherein the first polishing motor is moved with the movement of the carriage body, and a first substrate carrier configured to secure a substrate during transferring and polishing, wherein the first substrate carrier is coupled to the first polishing motor and rotated by the first polishing motor during polishing.

In yet another embodiment described herein a polishing head for a track polishing system is provided. The polishing head comprises a carriage body, one or more guide blocks mounted on the carriage body, wherein the one or more guide blocks are configured to couple with a guiding rail of the track polishing system and restrict movements of the carriage body to along the guiding rail, a sliding motor mounted on the carriage body and configured to move the carriage body along the guiding rail by reacting to a magnetic track of the track polishing system, a sensor assembly disposed on the carriage body, wherein the sensor assembly is configured to measure a position of the polishing head, and a first polishing assembly attached to the carriage body, wherein the first polishing assembly comprises a first polishing motor, and a first substrate carrier configured to secure a substrate during transferring and polishing, wherein the first substrate carrier is coupled to the first polishing motor and rotated by the first polishing motor during polishing.

In yet another embodiment described herein a method for polishing semiconductor substrates is provided. The method comprises loading a first substrate onto a polishing head movably coupled to a track of a track polishing system, wherein the polishing head comprises a carriage body, one or more guide blocks mounted on the carriage body, wherein the one or more guide blocks are configured to couple with the track and restrict movements of the carriage body to along the track, a sliding actuator connected to the carriage body and configured to move the carriage body along the track, a first polishing assembly comprising a first polishing motor connected with the carriage body and a first substrate carrier configured to secure the first substrate during transferring and polishing, wherein the first substrate carrier is coupled to the first polishing motor and rotated by the first polishing motor during polishing, sliding the polishing head along the track to position the first substrate over the first polishing station, and polishing the first substrate at the first polishing station by pushing the first substrate against a platen of the first polishing station and rotating the first substrate using the first polishing motor.

Embodiments described herein further relate to an apparatus for isolating a substrate processing environment from substrate transferring mechanisms. More particularly, certain embodiments described herein further relate to a shield assembly for isolating a substrate processing environment from substrate transferring mechanisms in an overhead track system.

In yet another embodiment, a track system configured to transfer polishing heads in a polishing system is provided. The track system comprises a supporting frame, a track coupled with the supporting frame and defining a path along which the polishing heads are configured to move, one or more carriages configured to carry at least one of the polishing heads along the path defined by the track, wherein the one or more carriages are coupled with the track and independently movable along the track, and a shield assembly coupled with the supporting frame and isolating the circular track from a processing environment. In one embodiment, the track is a circular track. In one embodiment, the shield assembly comprises an outer stationary shield encircling the outer periphery of the circular track, an inner stationary shield dimensioned to fit within the inner diameter of the circular track, and a plurality of movable shields positioned to overlap with the outer stationary shield and the inner stationary shield.

In yet another embodiment a track system configured to transfer polishing heads in a polishing system is provided. The track system comprises a supporting frame, a track coupled with the supporting frame and defining a path along which the polishing heads are configured to move, one or more carriages configured to carry at least one polishing head along the path defined by the track, wherein the one or more carriages are coupled with the track and independently movable along the track, and a unshaped shield assembly coupled with the carriage, wherein the u-shaped shield assembly is dimensioned to isolate the circular track from a processing environment. In one embodiment, the track is a circular track.

Embodiments described herein further provide a replaceable seal device that is easily removed or installed from a circular track system with minimal system downtime.

In yet another embodiment, the replaceable seal comprises a backing plate and a seal member removably coupled with the backing plate. The backing plate may comprise an inner circumferential face forming a recessed portion for accommodating a rail of a circular track. The seal member may comprise an inner circumferential face forming a recessed portion for accommodating the rail of the circular track.

In yet another embodiment, the replaceable seal comprises a seal member coupled to two or more backing plates. In one embodiment, the seal member may be coupled with the backing plate by molding the seal member on the backing plate. The seal member comprises an inner circumferential face forming a recessed portion for accommodating the rail of a track assembly. The backing plate is made such that it provides rigidity to the seal member while allowing the replaceable seal assembly to be removed or installed without compromising the seal assembly.

In yet another embodiment, the replaceable seal is fixed to an end portion of a guide block which is fixed to an end portion of a slider of the guide block to prevent foreign objects such as dirt and dust from entering the guide block and slider, the slider straddling a rail of a circular track.

In yet another embodiment a polishing head for a polishing system having a circular track is provided. The polishing head comprises a carriage body, one or more guide blocks mounted on the carriage body, wherein the one or more guide blocks are configured to couple with a track and restrict movements of the carriage body along the track, and a replaceable seal coupled with the guide block, wherein the replaceable seal straddles the track. In one embodiment, the polishing head further comprises a sliding actuator coupled with the carriage body and configured to move the carriage along the track and a first substrate carrier configured to secure a substrate during transferring and polishing, wherein the first substrate carrier is couple with the carriage body.

In yet another embodiment, a circular track system configured to transfer polishing heads in a polishing system is provided. The circular track system comprises a supporting frame, a track coupled to the supporting frame and defining a path along which the polishing heads are configured to move, and one or more carriages configured to carry at least one polishing head along the path defined by the track, wherein the track comprises a guide rail and each of the one or more carriages comprises one or more guide blocks with a replaceable seal which movably couple each respective carriage to the guide rail and restrict movements of the respective carriage within the path.

Embodiments described herein further relate to a circular track polishing system and methods for installing a circular track polishing system. In one embodiment a method for installing a circular track assembly is provided. The method comprises coupling a top plate with a supporting frame, coupling a guide assembly comprising inner and outer guide rails with the top plate, coupling an adapter assembly with the guide assembly, aligning an encoder scale with a sensor assembly, aligning a stator strip with an actuator, and coupling the stator strip with the guide assembly.

In another embodiment a track system configured to transfer polishing heads in a polishing system is provided. The track system comprises a supporting frame, a guide assembly coupled with the supporting frame, and one or more carriages configured to carry at least one polishing head along the path defined by the track, wherein the one or more carriages are coupled with the track and independently movable along the track. The guide assembly comprises a plate and a track coupled with the plate and defining a path along which the polishing heads are configured to move.

In yet another embodiment a track system for polishing heads is provided. The track system comprising a supporting frame, a guide assembly coupled with the supporting frame, a guiding rail coupled with the guide assembly, a magnetic track disposed along the guiding rail, an encoder scale disposed along the guiding rail, and one or more sliding carriages movably coupled to the guiding rail and each configured to move a polishing head along the path. Each of the one or more sliding carriages comprises a segment motor configured to independently actuate the respective sliding carriage by interacting with the magnetic track and an encoder sensor directed at the encoder scale and configured to measure a position of the respective sliding carriage along the path.

In yet another embodiment a guide assembly configured for coupling with a system support frame is provided. The guide assembly comprises a plate and a track coupled with the plate and defining a path along which polishing heads are configured to move.

BRIEF DESCRIPTION OF THE DRAWINGS

So that the manner in which the above recited features described herein can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments described herein relate to an apparatus and a method for transferring and supporting a substrate in a chemical mechanical polishing (CMP) system or electrochemical mechanical polishing (ECMP) system. In one embodiment described herein, a track system is used to transfer one or more polishing heads independently among polishing stations, loading/unloading station, and/or cleaning stations. In one embodiment, the track system comprises a stator strip defining a path along which one or more polishing heads may be moved by interactions between a rotor in each of the one or more polishing heads and the stator strip. In one embodiment, the stator strip comprises a plurality of permanent magnets, the rotor is a segment motor, and the polishing head is moved or stopped by interaction between magnetic fields of the permanent magnets and magnetic fields generated by the segment motor from electronic power provided to the segment motor. In one embodiment, one or more guide rails are disposed along the path defined by the stator strip and each of the one or more polishing heads are coupled to the one or more guide rails by one or more guide blocks. In one embodiment, the track is circular.

Figure 1:
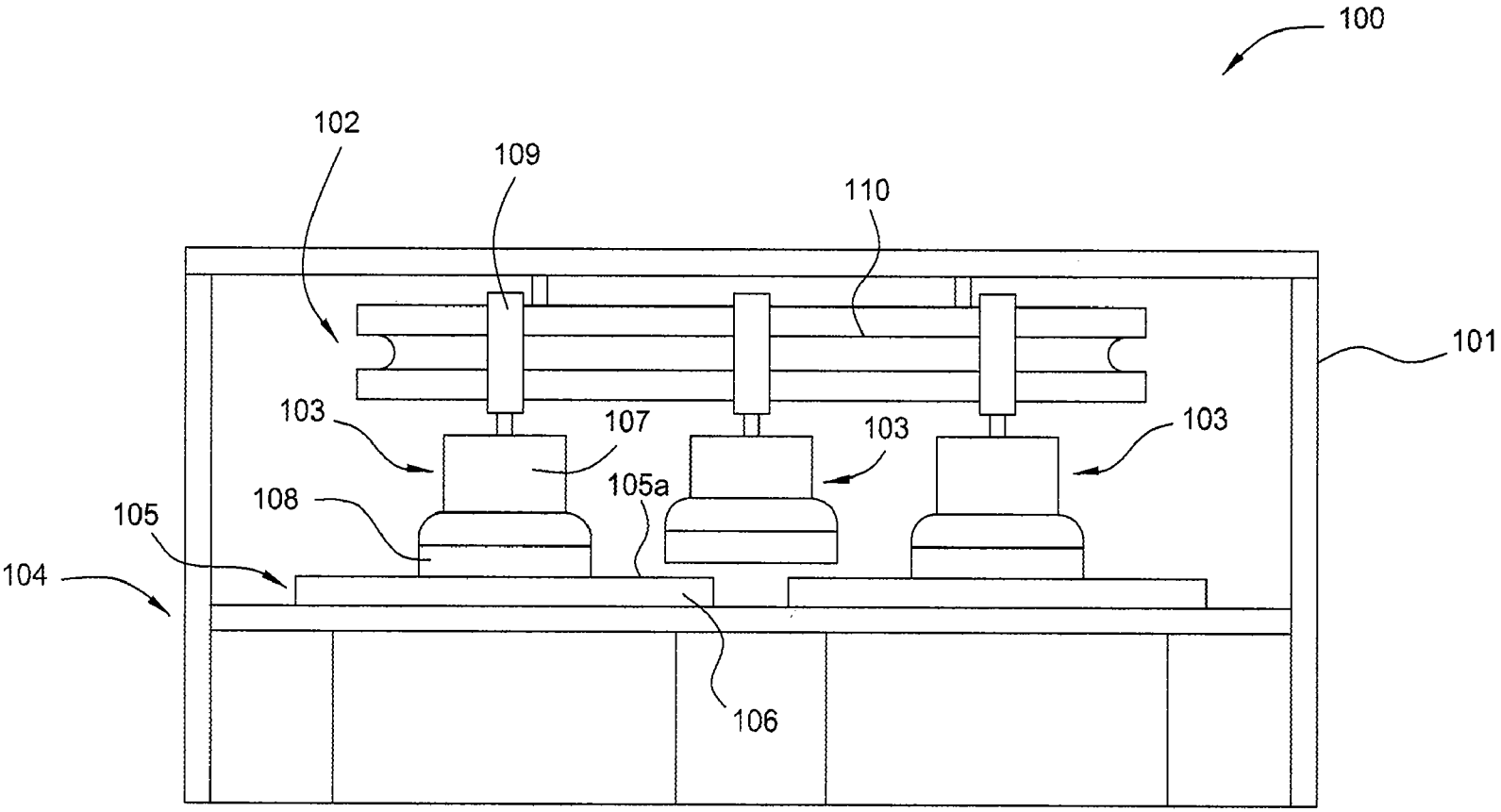
FIG. 1 is a schematic side view of a track polishing system in accordance with one embodiment described herein.

Track System:

FIG. 1 is a schematic side view of a track polishing system 100 in accordance with one embodiment described herein. The track polishing system 100 comprises a system frame 101 configured to provide support for apparatus using in a polishing process.

A track assembly 102 is mounted on an upper portion of the system frame 101 and a processing platform 104 is installed on a lower portion of the system frame 101. In one embodiment, the processing platform 104 may comprise a combination of modulated tools, such as polishing stations, load cups, and cleaning stations according to process requirements. As shown in FIG. 1, the processing platform 104 comprises one or more polishing stations 105.

A plurality of polishing heads 103 are movably coupled to the track assembly 102. Each of the plurality of polishing heads 103 is independently movable along the track assembly 102 and is capable of travelling among the one or more polishing stations 105 positioned below.

In one embodiment, the track assembly 102 comprises a track body 110 defining a path along which the polishing heads 103 may move. The track assembly 102 further comprises one or more carriages 109 movably connected to the track body 110. Each of the one or more carriages 109 is configured to carry at least one polishing heads 103.

In one embodiment, the polishing head 103 comprises a polishing motor 107 mounted on one of the carriages 109, and a substrate carrier 108 connected to the polishing motor 107. The substrate carrier 108 is configured to secure a substrate during polishing. The polishing motor 107 is configured to rotate the substrate carrier 108, thus the substrate secured thereon, against a polishing surface 105*a* of the polishing station 105. A detailed description of a polishing head may be found in U.S. Pat. No. 6,183,354, entitled "Carrier Head with a Flexible Membrane for a Chemical Mechanical Polishing", and co-pending U.S. Pat. No. 7,001,257, entitled "Multi-chamber Carrier Head with a Flexible Membrane".

Each of the polishing stations 105 may comprise a platen 106 configured to support and rotate a polishing pad thereon. Each polishing station 105 may further comprise a polishing solution dispenser, and a conditioner head. A detailed description of a platen and a polishing pad may be found in co-pending U.S. patent application Ser. No. 10/880,752, filed on Jun. 30, 2004, published as United States Patent Publication 2005/0000801, entitled "Method and Apparatus for Electrochemical Mechanical Processing". A detailed description for the polishing pad may be found in co-pending U.S. patent application Ser. No. 10/455,895, filed on Jun. 6, 2003, published as United States Patent Publication 2004/0020789, entitled "Conductive Polishing Article for Electrochemical Mechanical Polishing".

To perform a typical polishing process, one or more polishing stations 105 may be arranged in the track polishing system 100 to perform different polishing steps. At least one load cup for loading and unloading substrates is also arranged in the track polishing system 100 so that each of the polishing heads 103 may be loaded and unloaded. A detailed description of a load cup may be found in co-pending U.S. Pat. No. 7,044,832, entitled "Load Cup for Chemical Mechanical Polishing".

For a typical polishing process, one of the polishing heads 103 may be moved to a load cup that is positioned within the system frame 101 and accessible to each of the polishing heads 103 to perform a first polishing step, for example a bulk polish. A substrate may be loaded onto the substrate carrier 108 of the polishing head 103. The polishing head 103 may then move along the track assembly 102 by the carriage 109. A substrate may be loaded on a substrate carrier 108 at a loading station accessible to a first of the one or more polishing stations 105. The substrate is then lowered to be in contact with the platen 106 of the polishing station 105. The polishing head 103 may then press the substrate against the platen 106 and rotate the substrate using the polishing motor 107 to generate relative motion for polishing. The platen 106 is usually rotated during polishing. In one embodiment, the polishing head 103 may be oscillated about a position in the track assembly 102 providing a sweeping motion between the platen 106 and the substrate to improve polishing uniformity.

After polishing is complete in the first polishing station 105, the polishing head 103 may raise the substrate from the polishing station 105 and transfer the substrate along the track assembly 102 to the next polishing station 105 configured for a second polishing step, such as buffing.

The track polishing system 100 may be arranged according to a process recipe to have different arrangement of polishing stations, load cups, and cleaning stations. The track assembly 102 may define a path to allow each of the polishing heads to access the polishing stations, load cups and cleaning stations. The track assembly 102 may be linear, non-linear, curved, close looped, circular, non-circular, non-uniform curved path or with a shape of combinations thereof.

Figure 2A:
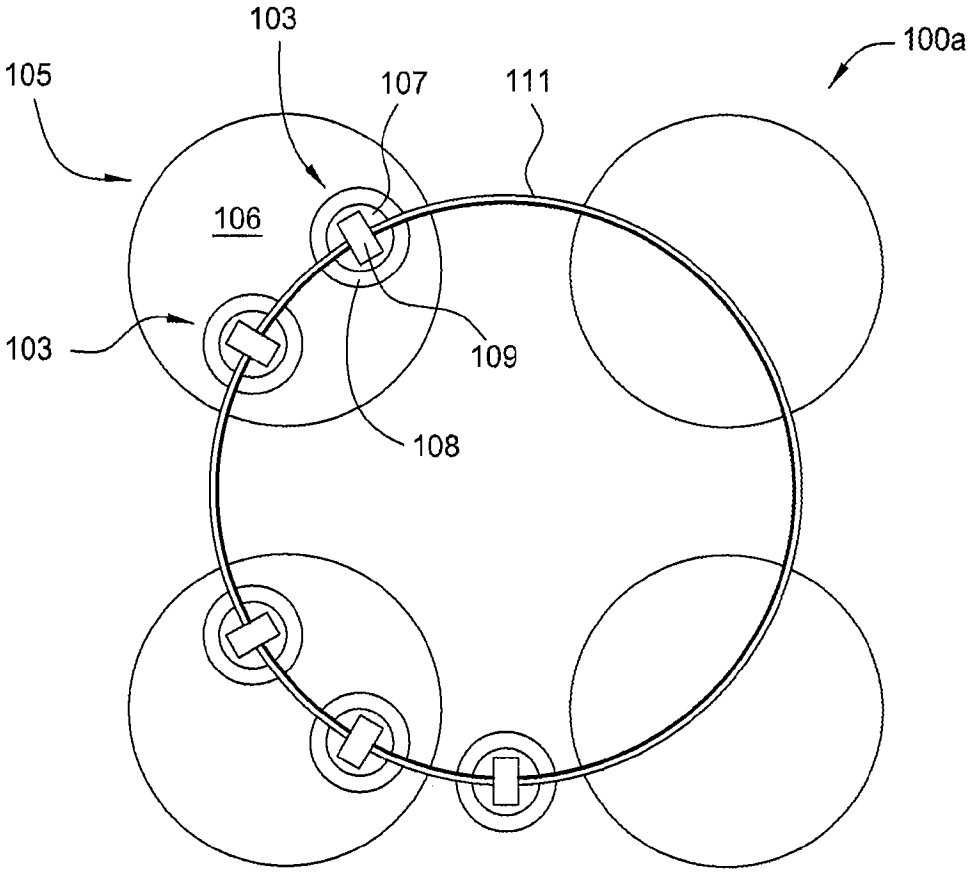
FIG. 2A is a schematic top view of a track polishing system in accordance with one embodiment described herein.

FIG. 2A is a schematic partial top view of a track polishing system 100*a* having a circular track. The track polishing system 100*a* comprises a circular track 111 disposed above four polishing stations 105. A plurality of polishing heads 103 are independently movable along the circular track 111. In one embodiment, two polishing heads 103 have access to one polishing station 105 simultaneously.

Figure 2B:
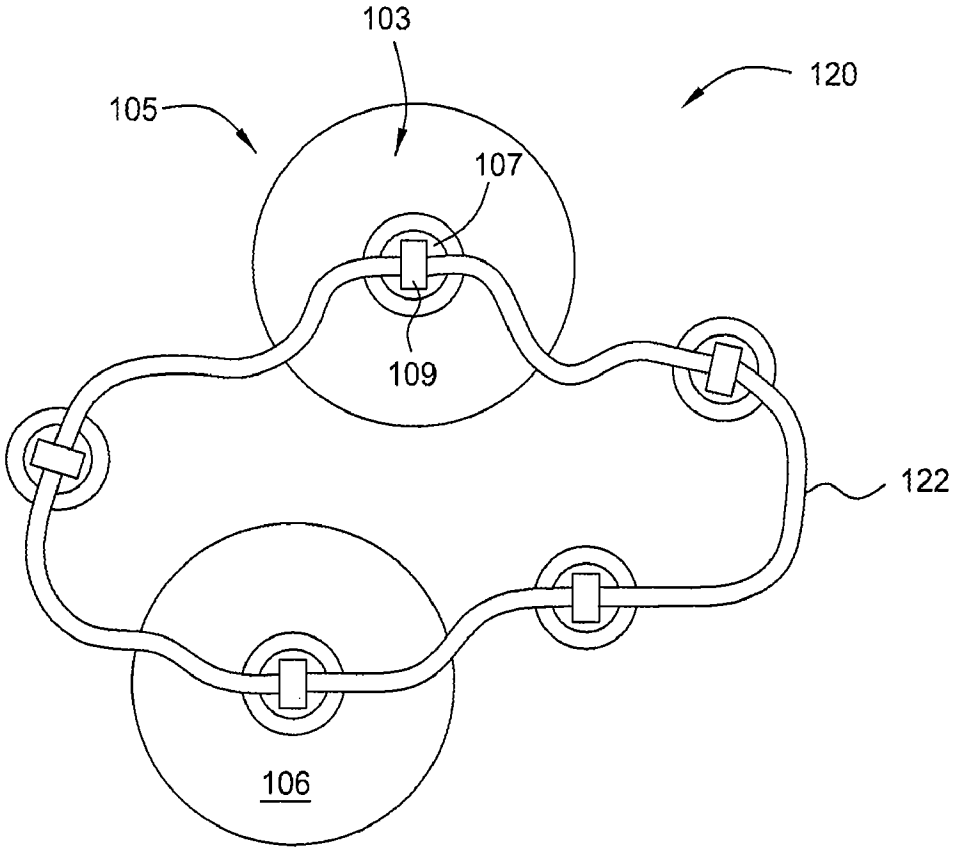
FIG. 2B is a schematic top view of a track polishing system in accordance with another embodiment described herein.

FIG. 2B is a schematic partial top view of a track polishing system 120 having a non-uniform curved track. The track polishing system 120 comprises a non-uniform curved track non-uniform curved track 122 disposed above two polishing stations 105.

Figure 3A:
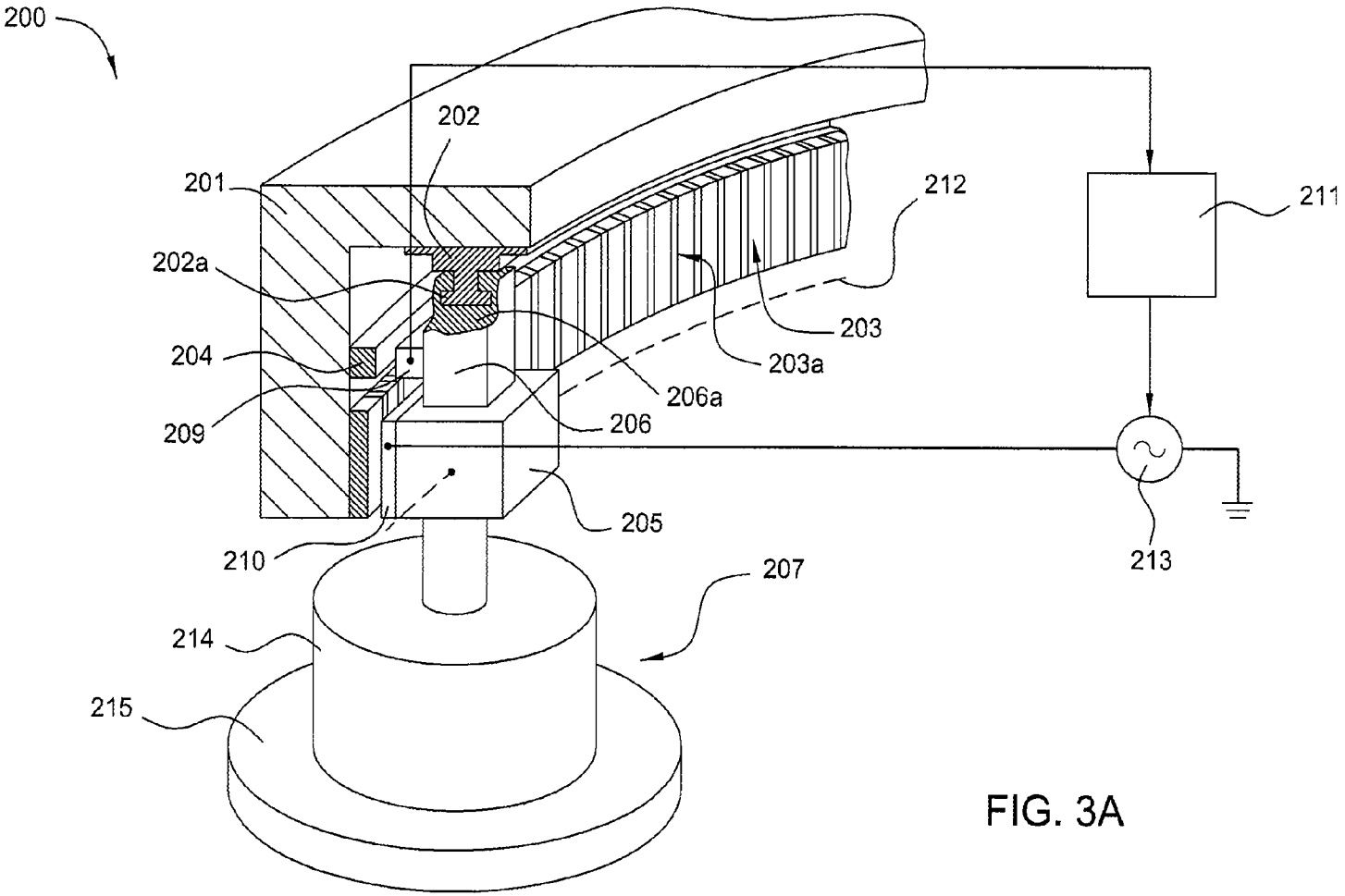
FIG. 3A is a schematic perspective sectional view of a track assembly in accordance with one embodiment described herein.

FIG. 3A is a schematic perspective sectional view of a track assembly 200 in accordance with one embodiment described herein. The track assembly 200 may be used in track polishing systems, similar to the track polishing system 100 described above. The track assembly 200 comprises a supporting frame 201, which may be secured to a system frame of a polishing system.

A guiding rail 202 is attached to the supporting frame 201. At least one carriage 205 is movably connected with the guiding rail 202. In one embodiment, the carriage 205 may be connected with the guiding rail 202 via a guide block 206. The guiding rail 202 is configured to restrain movement of the at least one carriage 205 to within a path 212. In one embodiment, the guide block 206 has a channel 206*a* configured to receive and secure a shoulder portion 202*a* of the guiding rail 202.

The track assembly 200 further comprises a stator strip 203 attached to the supporting frame 201. Each of the carriages 205 comprises a rotor 210 facing the stator strip 203. The stator strip 203 and the rotor 210 of each carriage 205 form a linear motor that propels the carriage 205 along the path 212. Each of the carriages 205 is configured to attach and carry one or more polishing heads 207. As shown in FIG. 3A, the polishing heads 207 may comprise a polishing motor 214 mounted on the carriage 205, and a substrate carrier 215 connected to the polishing motor 214.

Figure 3B:
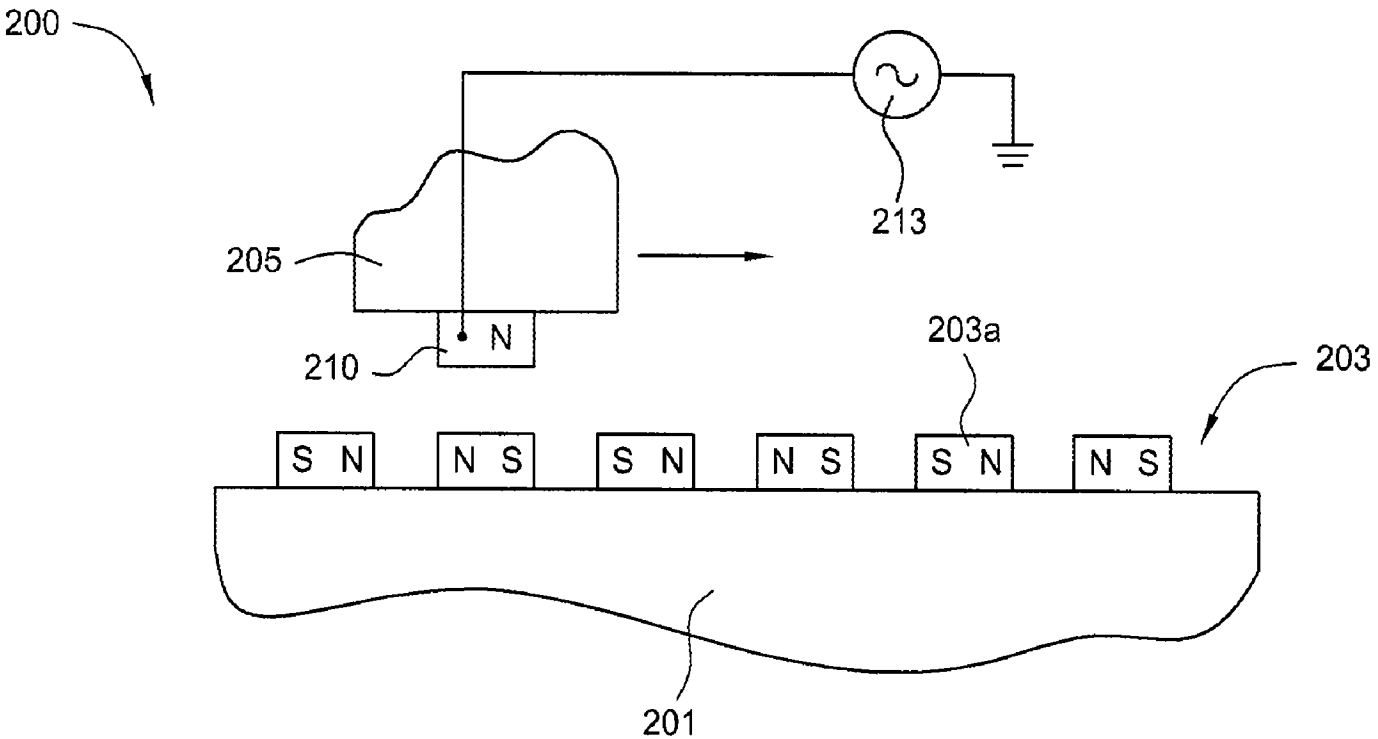
FIG. 3B is a schematic partial view of a stator strip used the track assembly of FIG. 3A.

In one embodiment, the stator strip 203 comprises a plurality of permanent magnets 203*a* and the rotor 210 comprises a segment motor connected to a power supply 213. The plurality of permanent magnets 203*a* may be arranged next to one another in a single line. In one embodiment, each of the permanent magnets 203*a* may be positioned such that neighboring permanent magnets 203*a* having opposite magnetic fields, as shown in FIG. 3B. Variation of the electromagnetic field of the segment motor is used to actuate the carriage 205 to move along opposite directions or station at one point.

In one embodiment, an encoder scale 204 is attached to the supporting frame 201 along the path 212. In another embodiment, the encoder scale 204 may be coupled with the stator strip 203. A sensor assembly 209 may be facilitated on each carriage 205. The sensor assembly 209 is configured to measure the encoder scale 204 to determine a location of the carriage 205 along the path 212 and/or velocity of the carriage 205. The encoder scale 204 and the sensor assembly 209 may be selected from any suitable length measure system. In one embodiment, the encoder scale 204 comprises a magnetic tape and the sensor assembly 209 comprises a read head configured to read the magnetic tape.

The sensor assembly 209 is connected to a system controller 211, which is configured to independently control each carriage 205. During processing, the system controller 211 acquires location and/or velocity of each carriage 205 according to measurements sent to the system controller 211 from the sensor assembly 209 of the corresponding carriage 205. The system controller 211 then sends control signal to the power supply 213 to position the carriage 205 to a desired position.

Compared with traditional method for supporting and transporting polishing heads, the track system described herein has several advantages.

First, the track system has increased flexibility. Unlike the traditional carousel structure wherein a fixed number of polishing heads are transferred simultaneously by a carousel, the track system is not limited by number of polishing heads and each polishing head attached to the track system is actuated independently. Therefore, the track system provides increased flexibility in both arrangement of the whole polishing system and execution of polishing recipes.

Second, the track system has improved throughput. In the traditional carousel structure, movement of the polishing heads is slow because all of the polishing heads attached to the carousel need to move and stop at the same time. In the track system described herein, the track system and supporting structures remain stationary during operation, and actuators only need to slide one carriage and the polishing head attached to the carriage at each move. Thus, the track system can move polishing heads at much faster pace and increase system throughput.

Third, the track system has low maintenance requirement. Because parts of a system level, such as the track, the guiding rail and the supporting frame, are not movable, the large structures are less susceptible to failure. The moving parts, such as carriages, polishing heads, are structurally independent, thus may be repaired on, replaced independently without affecting the rest of the system. Thus, the maintenance of the track system described herein is relatively simple and easy to carry out.

Figure 4:
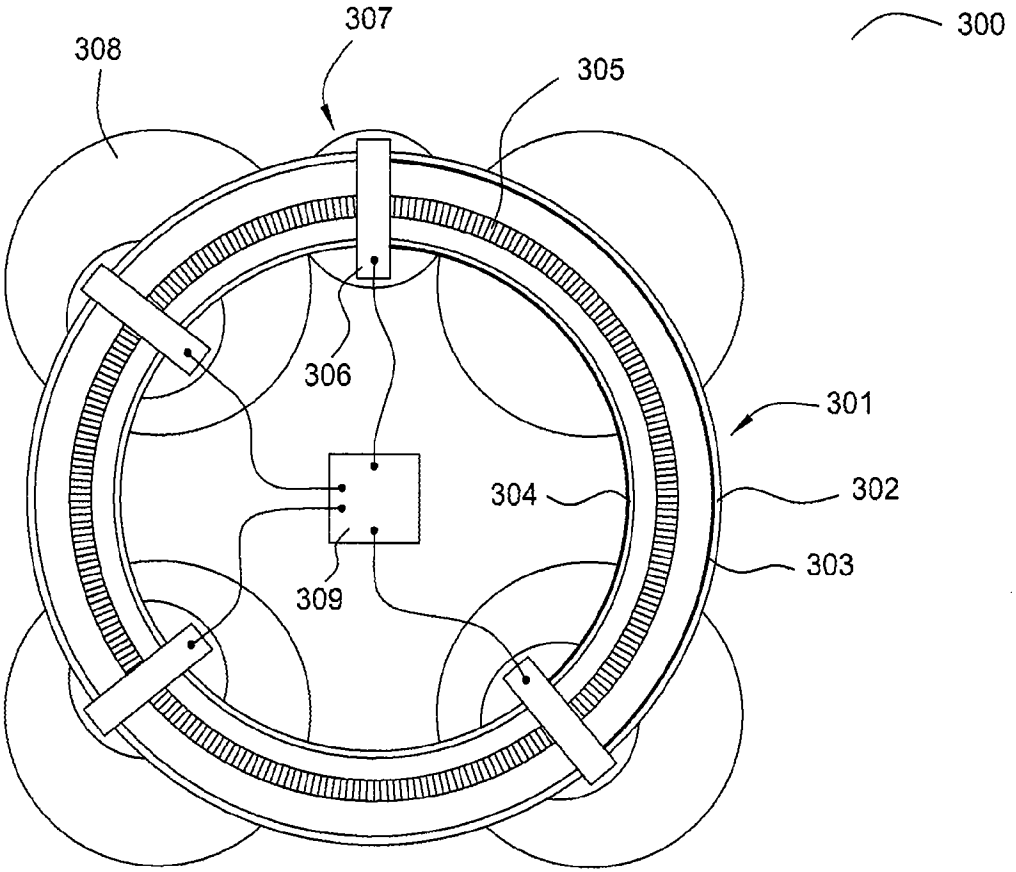
FIG. 4 is a schematic top view of a track polishing system in accordance with one embodiment described herein.

FIG. 4 is a schematic partial top view of a track polishing system 300 in accordance with one embodiment described herein. The track polishing system 300 is a circular track system having two guiding rails concentric to a track to provide structural sturdiness.

The track polishing system 300 comprises a circular track assembly 301 secured to a system frame (not shown). The circular track assembly 301 is configured to support and provide a circular path to a plurality of polishing heads 307. A plurality of working stations 308 is disposed underneath the circular track assembly 301. Each of the polishing head 307 has access to all the plurality of working stations 308 by moving along the circular track assembly 301. Each of the working stations 308 may be a polishing station, a load cup, and cleaning station, or any suitable apparatus required for a process.

The circular track assembly 301 comprises a first guiding rail 303 and a second guiding rail 304 concentrically disposed on a supporting frame 302. The supporting frame 302 is configured to be attached to the system frame. The circular track assembly 301 further comprises a circular stator 305 disposed on the supporting frame 302. The circular stator 305 is concentric to both the first guiding rail 303 and the second guiding rail 304.

One or more carriages 306 are configured to slide along the both the first guiding rail 303 and the second guiding rail 304.

Each of the carriages 306 is configured to carry at least one polishing head 307. Each of the carriages 306 comprises two or more guide blocks configured to mount the carriage 306 on both the first guiding rail 303 and the second guiding rail 304, and a rotor configured to react with the circular stator 305 to actuate movements of the carriage 306 along the first and second guiding rails 303, 304. In one embodiment, each of the carriages 306 may be connected to a system controller 309 configured to independently control each carriage 306 and/or polishing heads attached thereto.

The first and second guiding rails 303, 304 may be arranged as inner and outer guiding rails on the same plane, or arranged vertically. In one embodiment, the first guiding rail 303 may be disposed radially outwards the second guiding rail 304, and the circular stator 305 disposed between the first guiding rail 303 and the second guiding rail 304. The guiding rails 303, 304 are configured to retrain the path of the carriages 306 as well as provide structural support to the carriage 306 and the polishing head 307. Different designs of a double rail track assembly are described with FIGS. 5-8 below.

Figure 5:
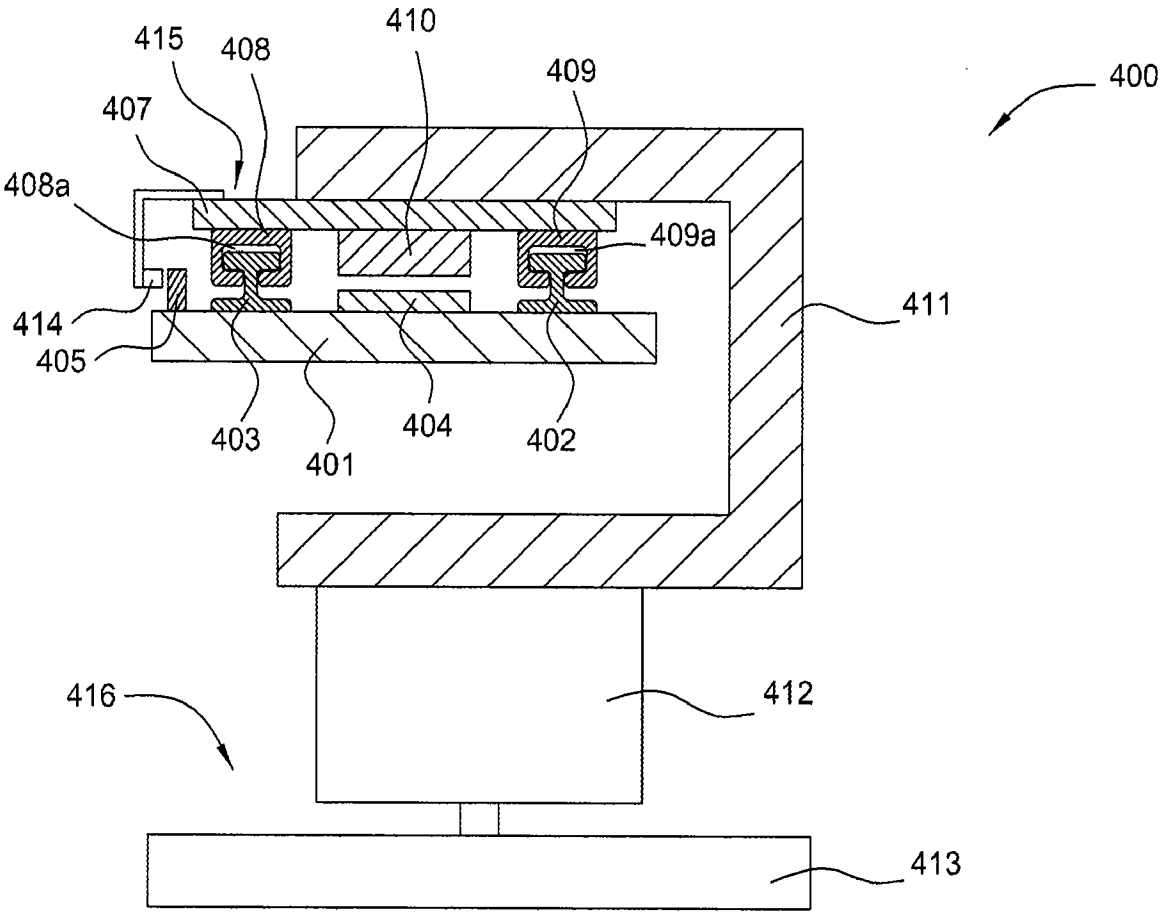
FIG. 5 is a schematic sectional side view of a track assembly in accordance with one embodiment described herein.

FIG. 5 is a schematic sectional side view of a track assembly 400 in accordance with one embodiment described herein. The track assembly 400 may be used in any track polishing systems, for example, a circular track system similar to the circular track system 300 of FIG. 4.

The track assembly 400 comprises a stationary portion having a supporting frame 401, which may be mounted on a system frame of a polishing system. The stationary portion further comprises a first guiding rail 402, a second guiding rail 403, a stator strip 404, and an encoder scale 405 mounted on the supporting frame 401. The guiding rails 402, 403, stator strip 404, and encoder scale 405 define a path along which polishing heads are configured to travel. The guiding rails 402, 403, the stator strip 404, and the encoder scale 405 may be parallel, concentric, or locally parallel depending on the shape of the path. For example, the guiding rails 402, 403, the stator strip 404, and the encoder scale 405 are substantially concentric for a circular track, parallel overall for a linear track, or parallel portion by portion for a curved track.

The track assembly 400 further comprises a mobile portion comprising one or more carriage assemblies 415. The carriage assemblies 415 comprise a carriage body 407 on which a guide block 408 and a guide block 409 are mounted. The guide block 408 has an inner channel 408*a* configured to receive the guiding rail 403, and the guide block 409 has an inner channel 409*a* configured to receive the guiding rail 402. The inner channels 408*a*, 409*a* allow the carriage assembly 415 to slide along the stationary portion of the track assembly 400. In one embodiment, the guide blocks 408, 409 may comprise two or more sections configured to provide secured attachment between the guiding rails 402, 403.

The carriage assembly 415 further comprises a rotor 410 positioned facing the stator strip 404. The rotor 410 is configured to push the carriage assembly 415 along the guiding rails 402, 403 or to station the carriage assembly 415 on the guiding rails 402, 403 by reacting with the stator strip 404. In one embodiment, the stator strip 404 and the rotor 410 do not contact one another. In one embodiment, the stator strip 404 comprises a plurality of permanent magnets and the rotor 410 comprises a segment motor.

The carriage assembly 415 further comprises a sensor assembly 414 positioned opposite the encoder scale 405 on the supporting frame 401. The sensor assembly 414 is configured to read the encoder scale 405 and provide position, and/or velocity of the carriage assembly 415 in relative to the encoder scale 405, and the guiding rails 402, 403.

The carriage assembly 415 further comprises a mounting component 411 attached to the carriage body 407. The mounting component 411 has a "C" shape and is configured to provide an interface with any devices to be carried by the carriage assembly 415. In one embodiment, a polishing head 416 having a polishing motor 412 and a substrate carrier 413 is mounted on the mounting component 411.

In this embodiment, the two guiding rails 402, 403 are used to define a path of the track and to bear the weight of the carriage assemblies 415 and anything mounted on the carriage assemblies 415.

Figure 6:
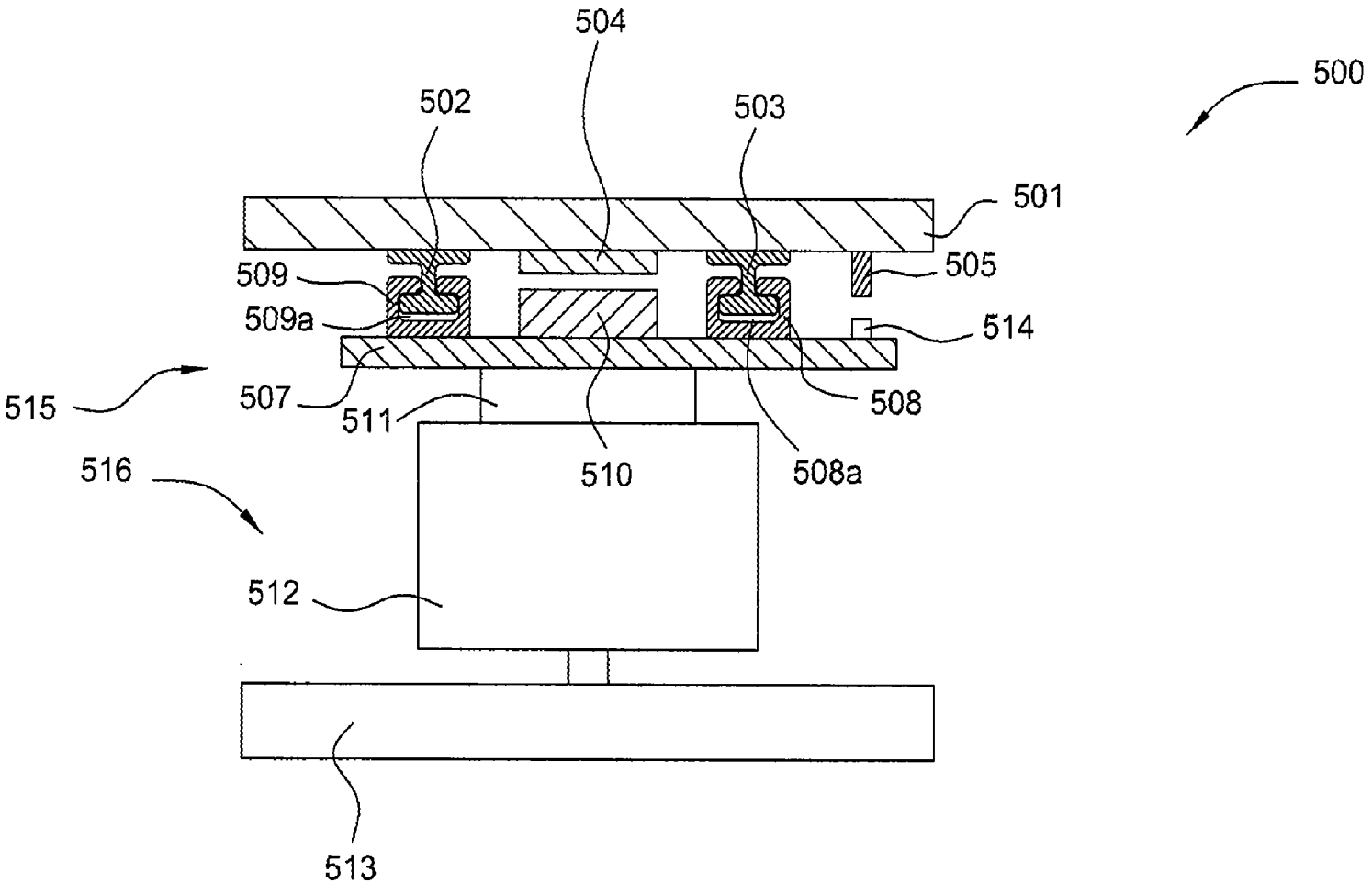
FIG. 6 is a schematic sectional side view of a track assembly in accordance with one embodiment described herein.

FIG. 6 is a schematic sectional side view of a track assembly 500 in accordance with another embodiment described herein. The track assembly 500 may be used in any track polishing systems, for example, a circular track system similar to the circular track system 300 of FIG. 4.

The track assembly 500 comprises a stationary portion having a supporting frame 501, which is mounted on a system frame of a polishing system. The stationary portion further comprises a first guiding rail 502, a second guiding rail 503, a stator strip 504, and an encoder scale 505 mounted on the supporting frame 501. The guiding rails 502, 503, stator strip 504, and encoder scale 505 define a path along which polishing heads are configured to travel. The guiding rails 502, 503, stator strip 504, and encoder scale 505 may be parallel, concentric, or locally parallel depending on the shape of the path. For example, the guiding rails 502, 503, stator strip 504, and encoder scale 505 are substantially concentric for a circular track, parallel overall for a linear track, or parallel portion by portion for a curved track.

The track assembly 500 further comprises a mobile portion comprising one or more carriage assemblies 515 hanging on the guiding rails 502, 503. The carriage assemblies 515 comprise a carriage body 507 on which a guide block 508 and a guide block 509 are mounted. The guide block 508 has an inner channel 508*a* configured to receive the guiding rail 503, and the guide block 509 has an inner channel 509*a* configured to receive the guiding rail 502. The inner channels 508*a*, 509*a* allow the carriage assembly 515 to slide along the stationary portion of the track assembly 500. In one embodiment, the guide blocks 508, 509 may comprise two or more sections configured to provide secured attachment between the guiding rails 502, 503.

The carriage assembly 515 further comprises a rotor 510 positioned facing the stator strip 504. The rotor 510 is configured to push the carriage assembly 515 along the guiding rails 502, 503 or to station the carriage assembly 515 on the guiding rails 502, 503 by reacting with the stator strip 504. In one embodiment, the stator strip 504 and the rotor 510 do not contact one another. In one embodiment, the stator strip 504 comprises a plurality of permanent magnets and the rotor 510 comprises a segment motor.

The carriage assembly 515 further comprises a sensor assembly 514 positioned opposite the encoder scale 505 on the supporting frame 501. The sensor assembly 514 is configured to read the encoder 505 and provide position, and/or velocity of the carriage assembly 515 in relative to the encoder scale 505, and the guiding rails 502, 503.

The carriage assembly 515 further comprises a mounting component 511 attached to the carriage body 507. The mounting component 511 is configured to provide interface to any devices to be carried by the carriage assembly 515. In one embodiment, a polishing head 516 having a polishing motor 512 and a substrate carrier 513 is mounted on the mounting component 511.

Figure 7:
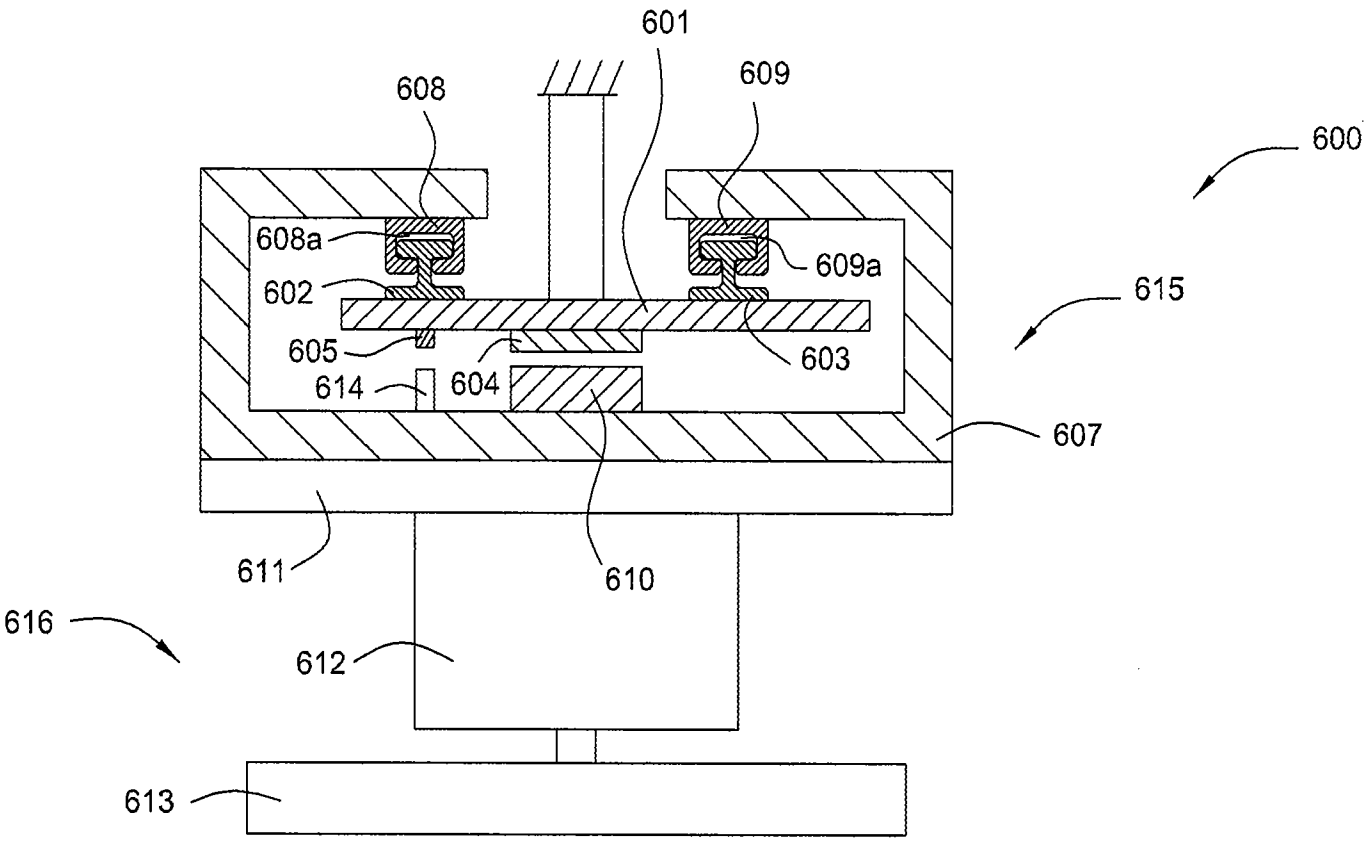
FIG. 7 is a schematic sectional side view of a track assembly in accordance with one embodiment described herein.

FIG. 7 is a schematic sectional side view of a track assembly 600 in accordance with another embodiment described herein. The track assembly 600 may be used in any track polishing systems, for example, a circular track system similar to the circular track system 300 of FIG. 4.

The track assembly 600 comprises a stationary portion having a supporting frame 601, and a first guiding rail 602, a second guiding rail 603, a stator strip 604, and an encoder scale 605 mounted on the supporting frame 601. The guiding rails 602, 603, the stator strip 604, and the encoder scale 605 define a path along which polishing heads are configured to travel. The guiding rails 602, 603, the stator strip 604, and the encoder scale 605 may be parallel, concentric, or locally parallel depending on the shape of the path. For example, the guiding rails 602, 603, the stator strip 604, and the encoder scale 605 are substantially concentric for a circular track, parallel overall for a linear track, or parallel portion by portion for a curved track.

The track assembly 600 further comprises a mobile portion comprising one or more carriage assemblies 615 hanging on the guiding rails 602, 603. The carriage assemblies 615 comprise a carriage body 607 on which a guide block 608 and a guide block 609 are mounted. The guide block 608 has an inner channel 608*a* configured to receive the guiding rail 603, and the guide block 609 has an inner channel 609*a* configured to receive the guiding rail 602. The inner channels 608*a*, 609*a* allow the carriage assembly 615 to slide along the stationary portion of the track assembly 600. In one embodiment, the guide blocks 608, 609 may comprise two or more sections configured to provide secured attachment between the guiding rails 602, 603. In one embodiment, the carriage body 607 may be designed to assert the weight of the carriage assemblies 615 is evenly distributed between the guiding rails 602, 603.

The carriage assembly 615 further comprises a rotor 610 positioned facing the stator strip 604. The rotor 610 is configured to push the carriage assembly 615 along the guiding rails 602, 603 or to station the carriage assembly 615 on the guiding rails 602, 603 by reacting with the stator strip 604. In one embodiment, the stator strip 604 and the rotor 610 do not contact one another. In one embodiment, the stator strip 604 comprises a plurality of permanent magnets and the rotor 610 comprises a segment motor.

The carriage assembly 615 further comprises a sensor assembly 614 positioned opposite the encoder scale 605 on the supporting frame 601. The sensor assembly 614 is configured to read the encoder 605 and provide position, and/or velocity of the carriage assembly 615 relative to the encoder scale 605, and the guiding rails 602, 603.

The carriage assembly 615 further comprises a mounting component 611 attached to the carriage body 607. The mounting component 611 is configured to provide an interface with any devices to be carried by the carriage assembly 615. In one embodiment, a polishing head 616 having a polishing motor 612 and a substrate carrier 613 is mounted on the mounting component 611.

Figure 8:
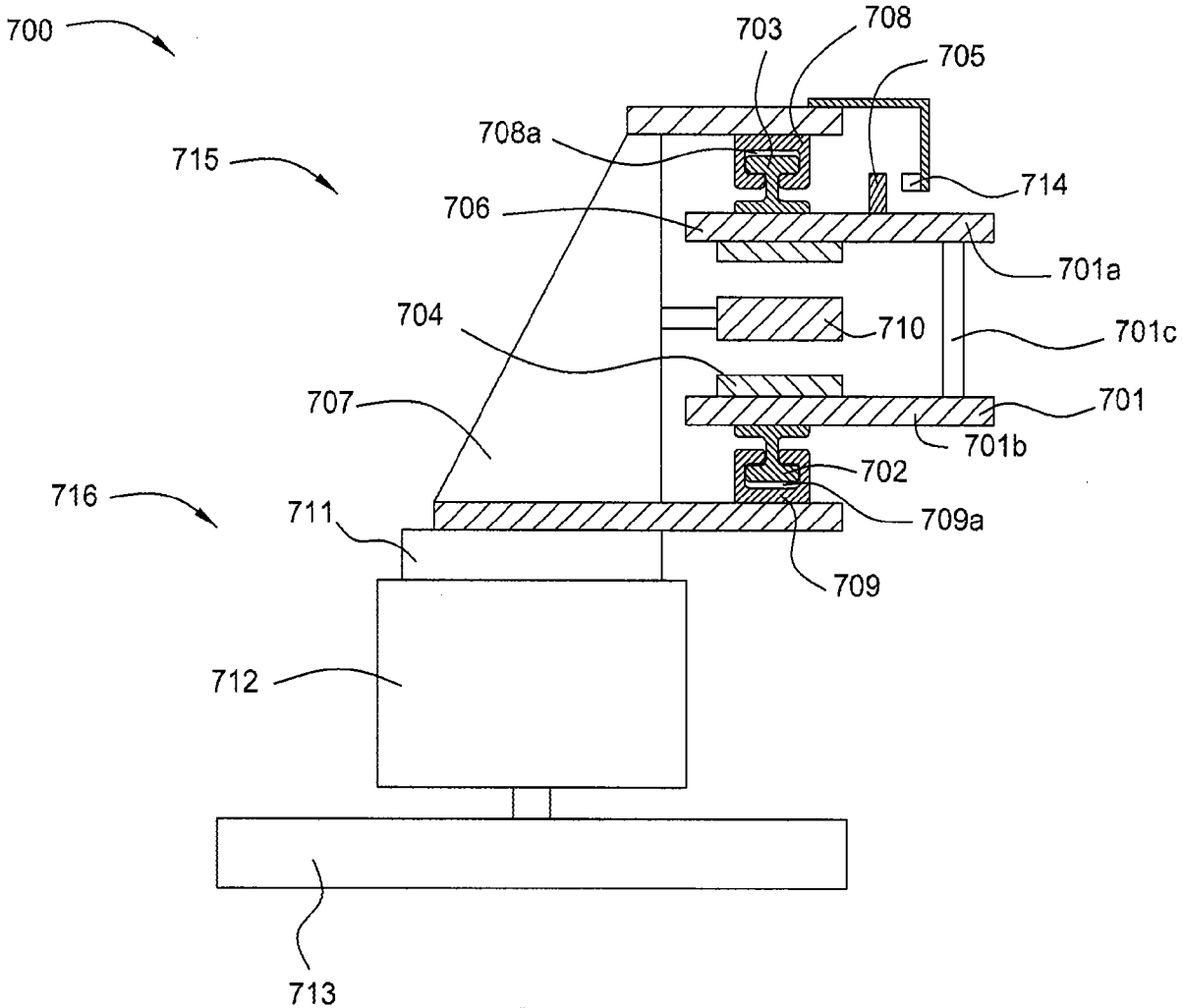
FIG. 8 is a schematic sectional side view of a track assembly in accordance with one embodiment described herein.

FIG. 8 is a schematic sectional side view of a track assembly 700 in accordance with another embodiment described herein. The track assembly 700 may be used in any track polishing systems, for example, a circular track system similar to the circular track system 300 of FIG. 4.

The track assembly 700 comprises a stationary portion having a supporting frame 701. In one embodiment, the supporting frame 701 comprises an upper frame 701*a* and a lower frame 701*b* connected by a plurality of supporting columns 701*c*. The stationary portion further comprises a first guiding rail 702 mounted on a bottom side of the lower frame 701*b*, a second guiding rail 703 mounted on a top side of the upper frame 701*a*. The stationary portion further comprises a stator strip 704 disposed on a top side of the lower frame 701*b* and a stator strip 706 disposed on a bottom side of the upper frame 701*a*. The stator strips 704, 706 provide more interaction with the moving portion of the track assembly 700.

The stationary portion further comprises an encoder scale 705 mounted on the supporting frame 701. The guiding rails 702, 703, stator strips 704, 706, and encoder scale 705 define a path along which polishing heads are configured to travel. The guiding rails 702, 703, stator strips 704, 706, and encoder scale 705 may be parallel, concentric, or locally parallel depending on the shape of the path. For example, the guiding rails 702, 703, the stator strips 704, 706, and the encoder scale 705 are substantially concentric for a circular track, parallel overall for a linear track, or parallel portion by portion for a curved track.

The track assembly 700 further comprises a mobile portion comprising one or more carriage assemblies 715 hanging on the guiding rails 702, 703. The carriage assemblies 715 comprise a carriage body 707 on which a guide block 708 and a guide block 709 are mounted. The guide block 708 has an inner channel 708*a* configured to receive the guiding rail 703, and the guide block 709 has an inner channel 709*a* configured to receive the guiding rail 702. The inner channels 708*a*, 709*a* allow the carriage assembly 715 to slide along the stationary portion of the track assembly 700. In one embodiment, the guide blocks 708, 709 may comprise two or more sections configured to provide secured attachment between the guiding rails 702, 703. In one embodiment, the carriage body 707 may be designed to assure that the weight of the carriage assemblies 715 is evenly distributed between the guiding rails 702, 703.

The carriage assembly 715 further comprises a rotor 710 positioned facing the stator strip 704. The rotor 710 is configured to push the carriage assembly 715 along the guiding rails 702, 703 or to station the carriage assembly 715 on the guiding rails 702, 703 by reacting with the stator strips 704, 706. The rotor 710 is disposed between the stator strips 704, 706. In one embodiment, each of the stator strips 704, 706 comprises a plurality of permanent magnets and the rotor 710 comprises one or more segment motors.

The carriage assembly 715 further comprises a sensor assembly 714 positioned opposite the encoder scale 705 on the supporting frame 701. The sensor assembly 714 is configured to read the encoder scale 705 and provide position, and/or velocity of the carriage assembly 715 relative to the encoder scale 705, and the guiding rails 702, 703.

The carriage assembly 715 further comprises a mounting component 711 attached to the carriage body 707. The mounting component 711 is configured to provide an interface with any devices to be carried by the carriage assembly 715. In one embodiment, a polishing head 716 having a polishing motor 712 and a substrate carrier 713 is mounted on the mounting component 711. The carriage body 707 is substantially a cantilever structure with one end secured to the guiding rails 702, 703, and an opposite end bearing the weight of the polishing head 716.

Figure 9:
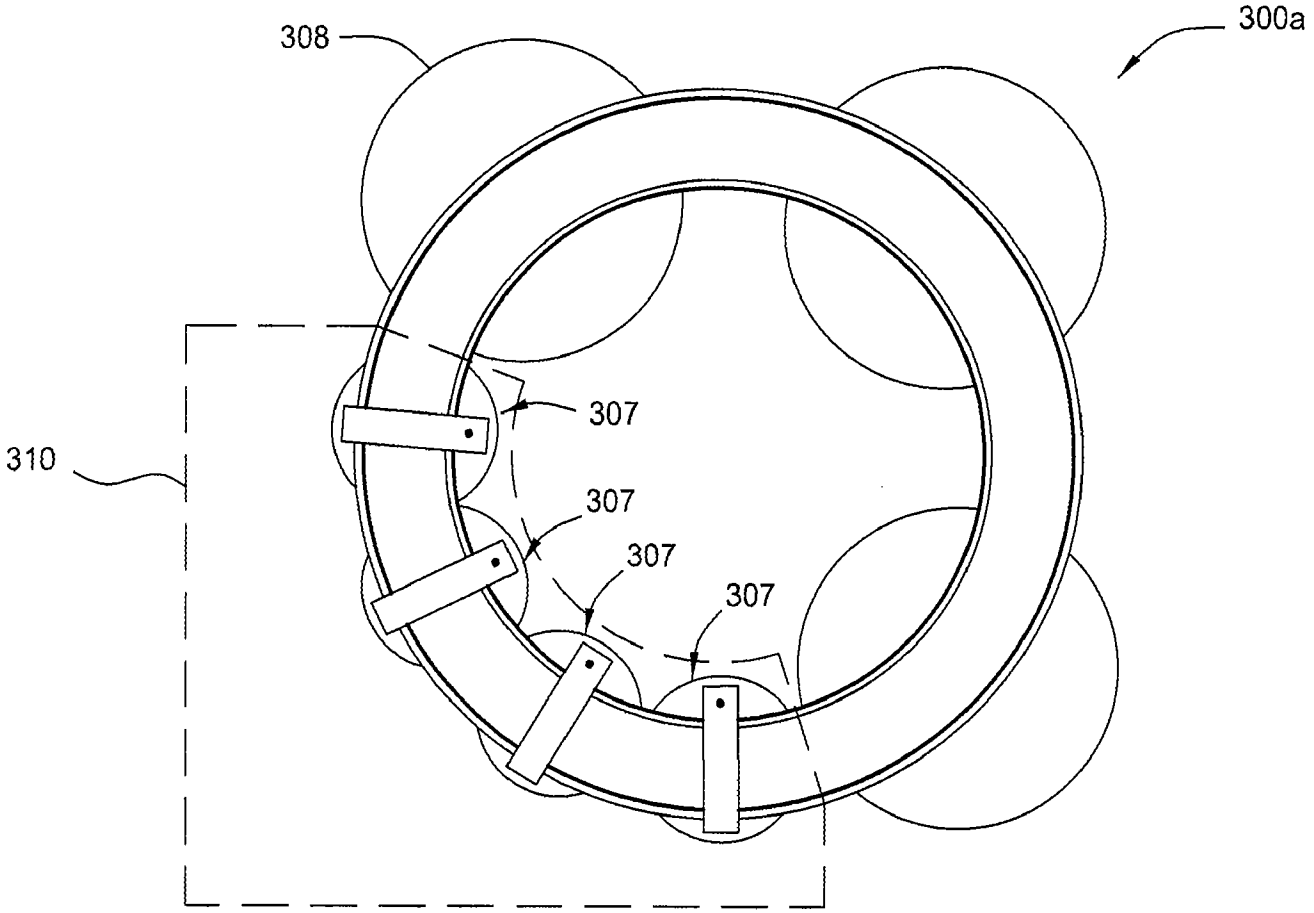
FIG. 9 is a schematic top view of a track polishing system described herein in a maintenance state.

FIG. 9 is a schematic top view of a track polishing system 300*a* described herein in a maintenance state. The track polishing system 300*a* is similar to the track polishing system 300 of FIG. 4. As shown in FIG. 9, the polishing heads 307 may be gathered at a dedicated maintenance corner 310 during maintaining, thus, saving space and time.

Even though a polishing process is described with the track system described herein, a person skilled in the art can apply the track in any suitable processes that require movement of substrates between different workstations.

Figure 10A:
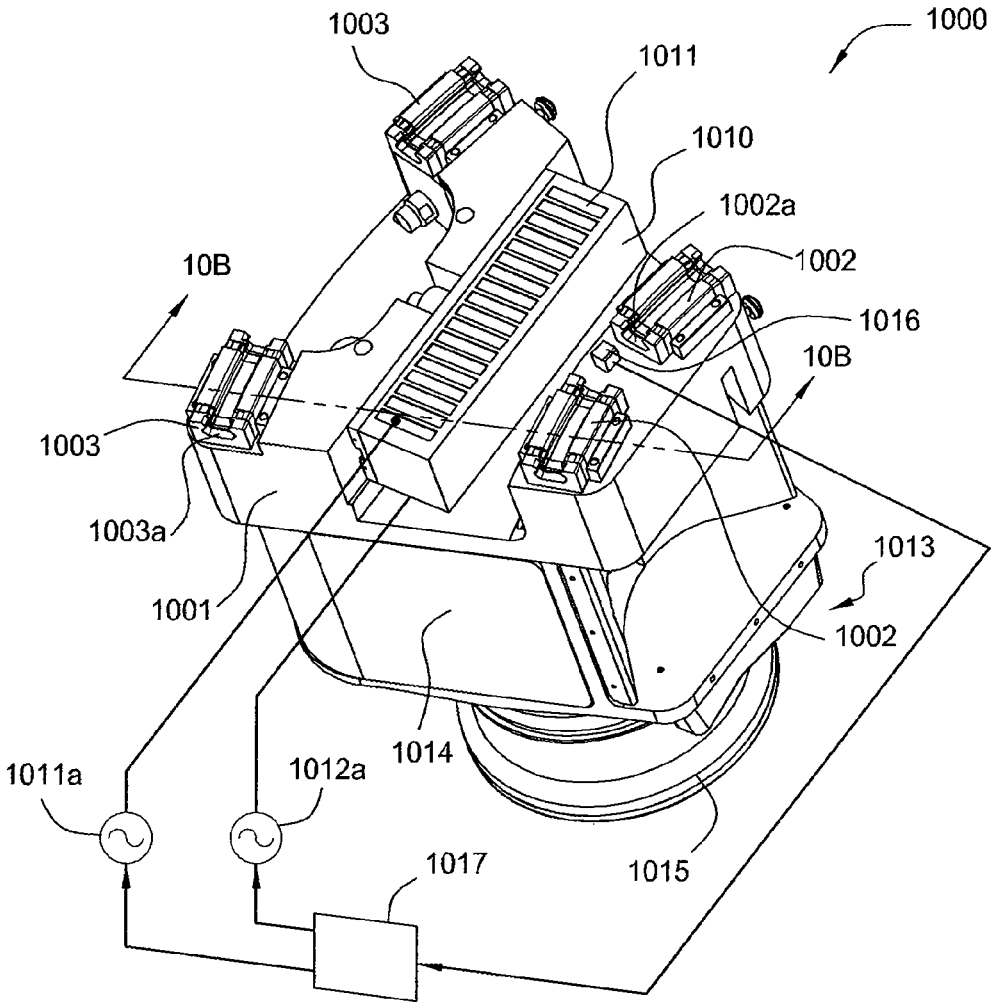
FIG. 10A is a schematic perspective view of a polishing head in accordance with one embodiment described herein.
Figure 10B:
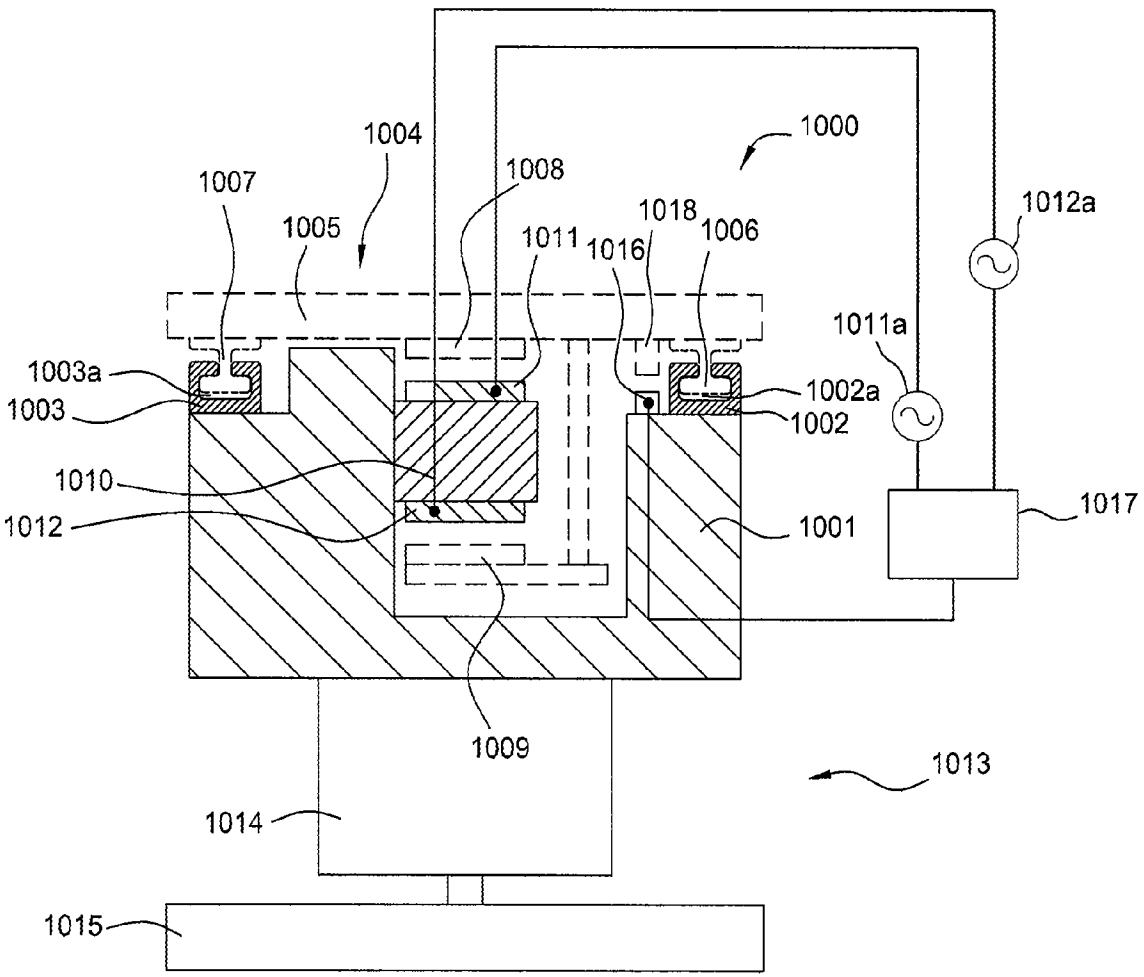
FIG. 10B is a schematic sectional side view of the polishing head of FIG. 10A.

Polishing Head:

FIG. 10A is a schematic perspective view of a polishing head 1000 in accordance with one embodiment described herein. FIG. 10B is a schematic sectional side view of the polishing head 1000 of FIG. 10A. The polishing head 1000 is configured to transfer and process substrates along a track assembly 1004 (shown FIG. 10B) having two guiding rails 1006, 1007.

The polishing head 1000 comprises a carriage body 1001, and guide blocks 1002, 1003 configured to receive the guiding rails 1006, 1007 of the track assembly 1004. The guide blocks 1002, 1003 have sliding channels 1002*a*, 1003*a* formed therein to receive guiding rails. In one embodiment, each of the guide blocks 1002, 1003 may comprise two or more segments configured to provide enhanced support to the carriage body 1001 and devices attached thereto.

In one embodiment, the polishing head 1000 is configured to move along a circular track system having two concentric guiding rails. As shown in FIG. 10A, the guide blocks 1002, 1003 are configured to receive an inner circular guiding rail and an outer circular guiding rail respectively. In one embodiment, the sliding channels 1002*a*, 1003*a* are curved to match the guiding rails. In one embodiment, each of the guide blocks 1002, 1003 comprises two curved segments positioned on opposite ends of the carriage body 1001.

An actuator assembly 1010 is attached to the carriage body 1001. The actuator assembly 1010 comprises a rotor 1011 configured to transport the polishing head 1000 along a track assembly by reacting with a stator strip of the track assembly. For example, as shown in FIG. 10B, the rotor 1011 is configured to react with a stator strip 1008 attached to a supporting frame 1005 of the track assembly 1004. In one embodiment, the actuator assembly 1010 comprises a second rotor 1012 disposed on opposite side of the rotor 1011. The actuator assembly 1010 is configured to transport the polishing head 1000 by reacting with a second stator strip of the track assembly. As shown in FIG. 10B, the rotor 1012 is configured to react with a stator strip 1009 of the track assembly 1004.

The rotors 1011 and 1012 may be used alone or in combination to achieve different functions during processing, for example, transportation and sweeping.

In one embodiment, the rotors 1011, 1012 are segment motors configured to react with stator strips comprises a plurality of permanent magnets. The rotors 1011, 1012 are connected to power supplies 1011*a*, 1012*a* which may be controlled by a system controller 1017.

The polishing head 1000 further comprises a sensor assembly 1016 disposed in a location to read an encoder scale in a track assembly, for example an encoder scale 1018 of the track assembly 1004. The sensor assembly 1016 is configured to detect position and/or velocity of the polishing head 1000 relative to the track assembly. In one embodiment, the sensor assembly 1016 is connected to the system controller 1017 which may use measurements from the sensor assembly 1016 to control the rotors 1011, 1012.

The polishing head 1000 further comprises a polishing assembly 1013 connected to the carriage body 1001. In one embodiment, the polishing assembly 1013 comprises at least one polishing motor 1014 connected to a substrate carrier 1015. The polishing motor 1014 is configured to rotate the substrate carrier 1015 during polishing. In one embodiment, the polishing assembly 1013 may comprise a second polishing motor connected to a second substrate carrier configured to process a second substrate at the same polishing station simultaneously.

Figure 11A:
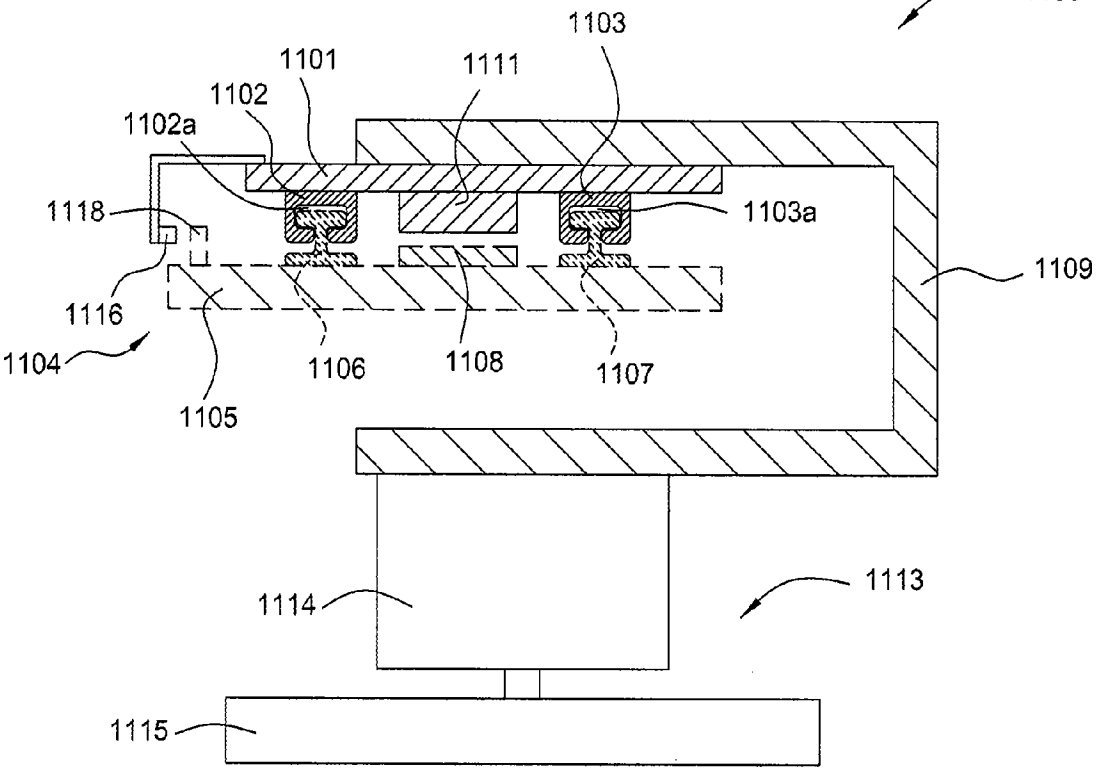
FIG. 11A is a schematic sectional side view of a polishing head and a track assembly in accordance with one embodiment described herein.
Figure 11B:
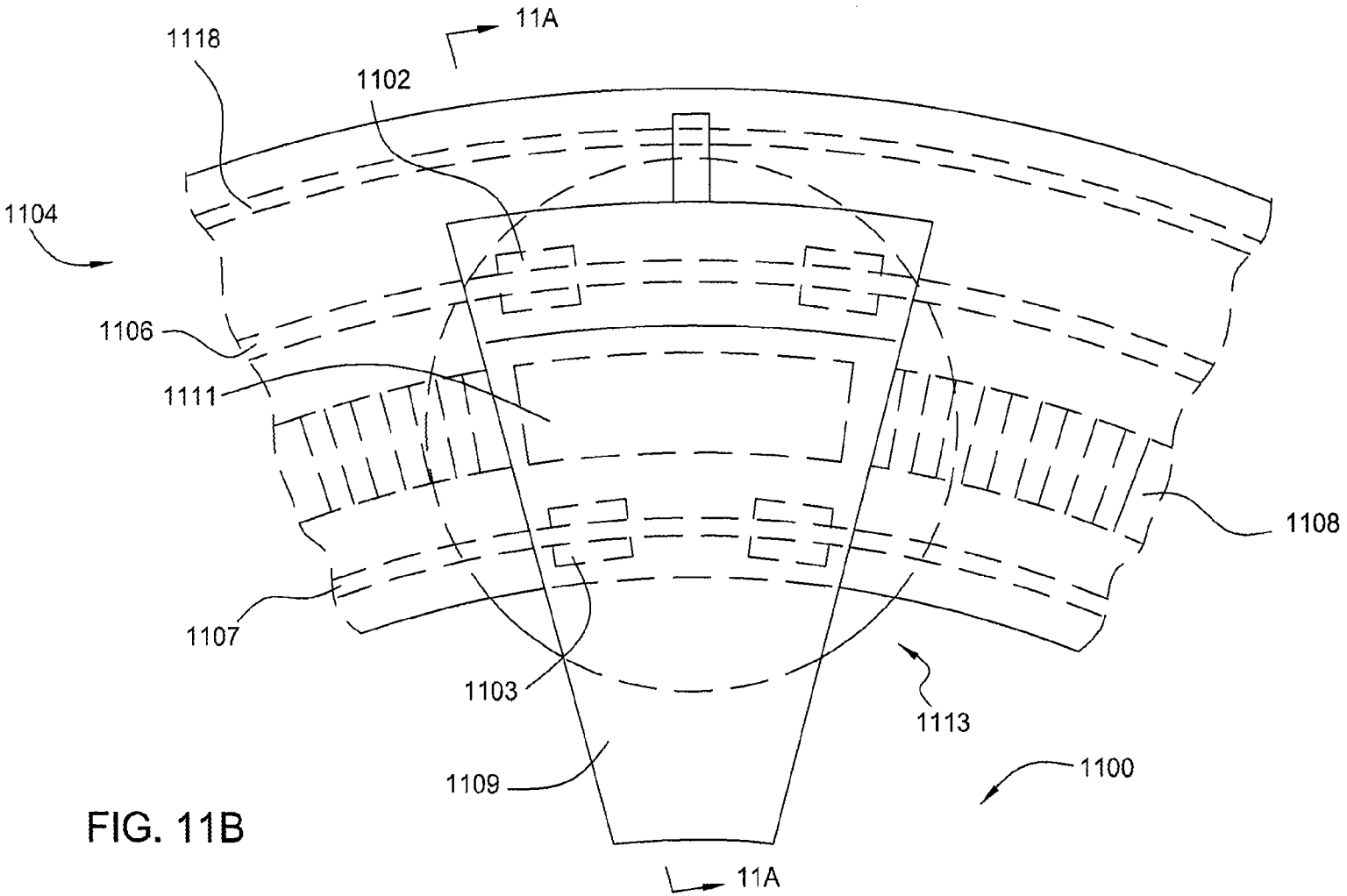
FIG. 11B is a schematic top view of the polishing head and the track assembly of FIG. 11A.

FIG. 11A is a schematic sectional side view of a polishing head 1100 in accordance with one embodiment described herein. FIG. 11B is a schematic top view of the polishing head 1100 of FIG. 11A. The polishing head 1100 is configured to transfer and process substrates along a track assembly 1104 (shown in dashed lines in FIGS. 11A-11B) having two guiding rails 1106, 1107.

The polishing head 1100 comprises a carriage body 1101, and guide blocks 1102, 1103 configured to receive the guiding rails 1106, 1107 of the track assembly 1104. The guide blocks 1102, 1103 have sliding channels 1102*a*, 1103*a* formed therein to receive guiding rails. In one embodiment, each of the guide blocks 1102, 1103 may comprises two or more segments configured to provide enhanced support to the carriage body 1101 and devices attached thereto.

In one embodiment, the polishing head 1100 is configured to move along a circular track system having two concentric guiding rails. As shown in FIG. 11A, each of the guide blocks 1102, 1103 comprises two curved segments positioned on opposite ends of the carriage body 1101.

A rotor 1111 is attached to the carriage body 1101. The rotor 1111 is configured to transport the polishing head 1100 along the track assembly 1104 by reacting with a stator strip 1108 disposed on a supporting frame 1105 of the track assembly 1104.

In one embodiment, the rotor 1111 is a segment motor configured to react with a plurality of permanent magnets of the stator strip 1108. The rotor 1111 is connected to a power supply which may be controlled by a system controller.

The polishing head 1100 further comprises a sensor assembly 1116 disposed in a location to read an encoder scale in a track assembly, for example an encoder scale 1118 of the track assembly 1104. The sensor assembly 1116 is configured to detect position and/or velocity of the polishing head 1100 relative to the track assembly. In one embodiment, the sensor assembly 1116 is connected to the system controller which may use measurements from the sensor assembly 1116 to control the rotor 1111.

The polishing head 1100 further comprises a mounting frame 1109 coupled to the carriage body 1101. A polishing assembly 1113 is mounted on the mounting frame 1109 and connected to the carriage body 1101. The mounting frame 1109 has a "C" shape and is configured to position the polishing assembly 1113 directly under the track assembly 1104

In one embodiment, the polishing assembly 1113 comprises at least one polishing motor 1114 connected to a substrate carrier 1115. The polishing motor 1114 is configured to rotate the substrate carrier 1115 during polishing. In one embodiment, the polishing assembly 1113 may comprise a second polishing motor connected to a second substrate carrier configured to process a second substrate at the same polishing station simultaneously.

Figure 12:
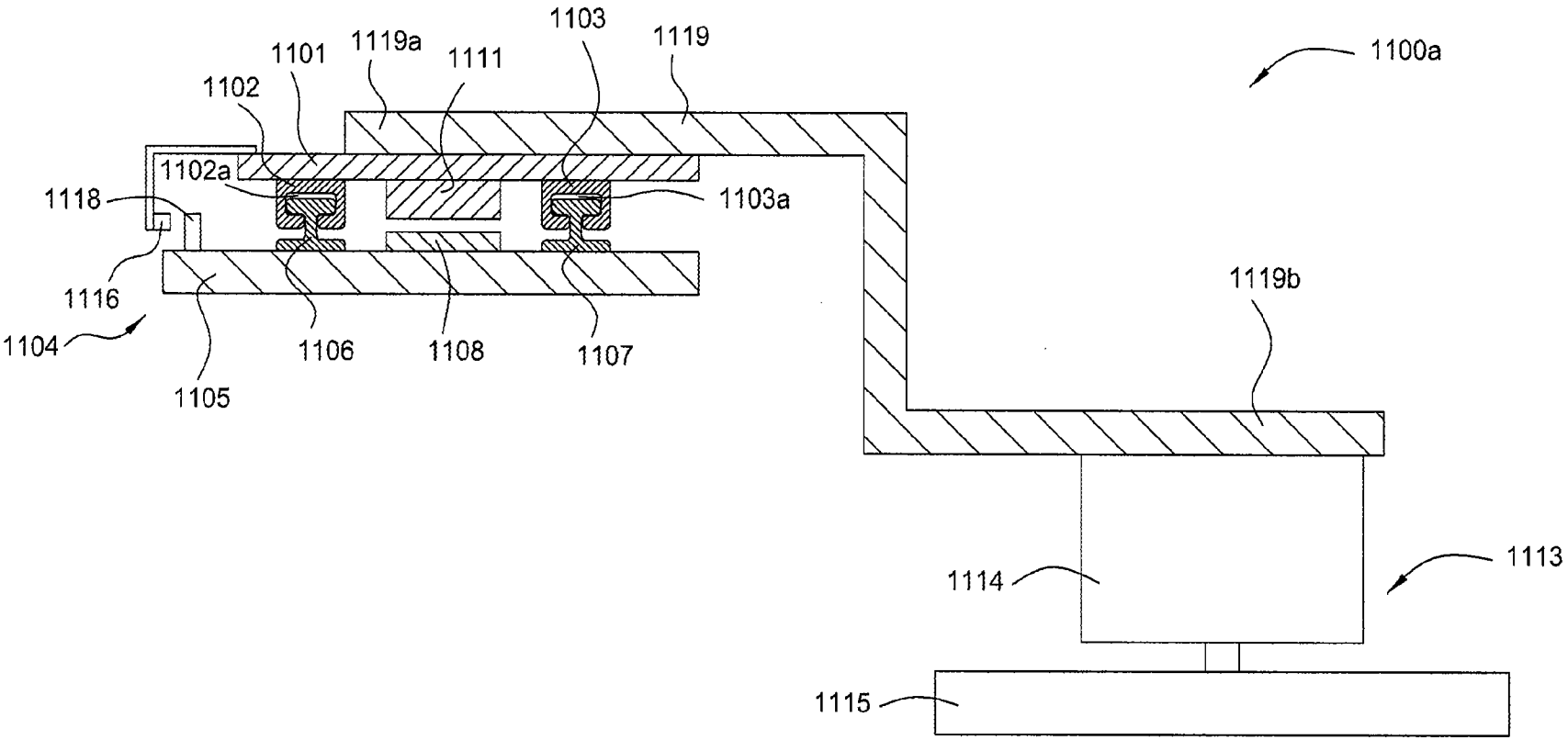
FIG. 12 is a schematic sectional side view of a polishing head and a track assembly in accordance with one embodiment described herein.

FIG. 12 is a schematic sectional side view of a polishing head 1100*a* in accordance with one embodiment described herein. The polishing head 1100*a* is similar to the polishing head 1100 shown in FIG. 11A, except the polishing head 1100*a* comprises a mounting frame 1119 which is substantially a cantilever. The mounting frame 1119 has a first end 1119*a* coupled to the carriage body 1101, and a second end 1119*b* opposing the first end 1119*a*. The polishing assembly 1113 may be mounted on the second end 1119*b*. The mounting frame 1119 allows the polishing head 1100*a* to position the polishing assembly 1113 away from the track assembly 1104. The polishing head 1100*a* may be used in suitable system designs, for example in designs where polishing stations are spread in an area larger than an area covered by the track assembly 1104.

Figure 13:
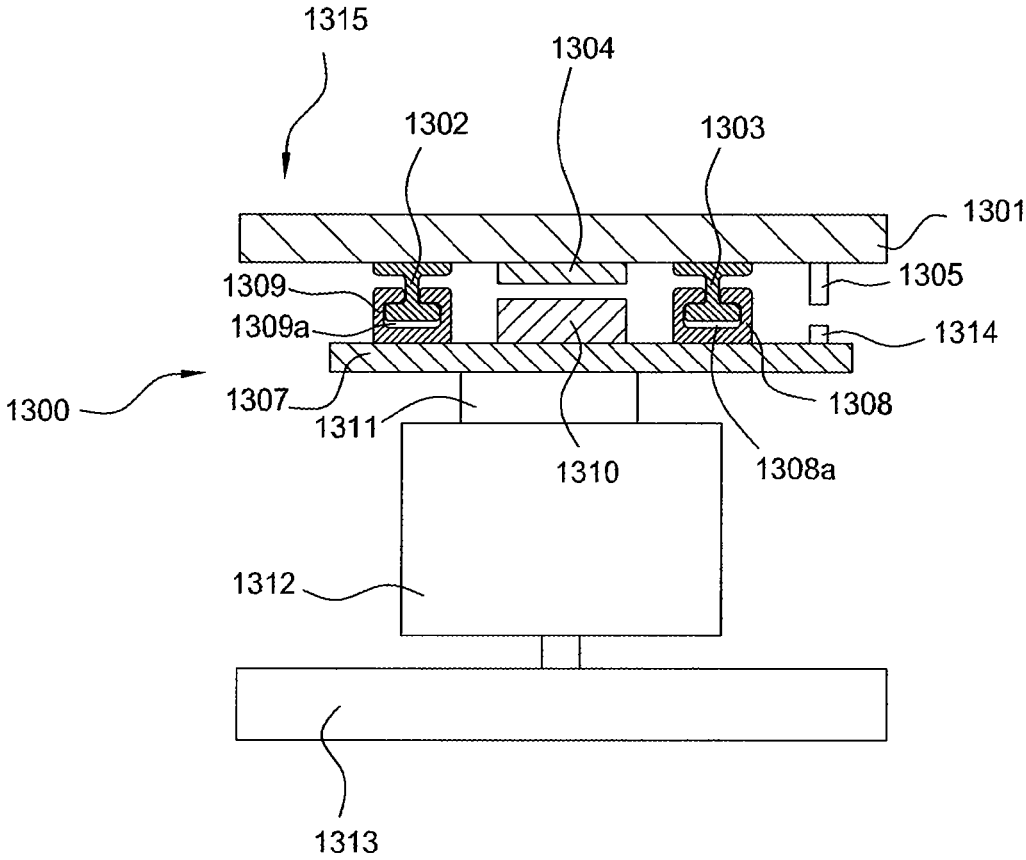
FIG. 13 is a schematic sectional side view of a polishing head and a track assembly in accordance with one embodiment described herein.

FIG. 13 is a schematic sectional side view of a polishing head 1300 and a track assembly 1315 in accordance with another embodiment described herein. The track assembly 1315 may be linear, curved, or circular.

The track assembly 1315 comprises a stationary portion having a supporting frame 1301, a first guiding rail 1302, a second guiding rail 1303, a stator strip 1304, and an encoder scale 1305 mounted on the supporting frame 1301. The guiding rails 1302, 1303, the stator strip 1304, and the encoder scale 1305 define a path along which the polishing head 1300 is configured to travel. The guiding rails 1302, 1303, the stator strip 1304, and the encoder scale 1305 may be parallel, concentric, or locally parallel depending on the shape of the path.

The guiding rails 1302, 1303 are attached to the supporting frame 1301 on a bottom side. The polishing head 1300 hangs on the guiding rails 1302, 1303. The polishing head 1300 comprises a carriage body 1307 on which a guide block 1308 and a guide block 1309 are mounted. The guide block 1308 has an inner channel 1308*a* configured to receive the guiding rail 1303, and the guide block 1309 has an inner channel 1309*a* configured to receive the guiding rail 1302. The inner channels 1308*a*, 1309*a* allow the polishing head 1300 to slide along the stationary portion of the track assembly 1315. In one embodiment, the guide blocks 1308, 1309 may comprise two or more sections configured to provide secured attachment between the guiding rails 1302, 1303.

The polishing head 1300 further comprises a rotor 1310 positioned facing the stator strip 1304. The rotor 1310 is configured to push the polishing head 1300 along the guiding rails 1302, 1303 or to station the polishing head 1300 on the guiding rails 1302, 1303 by reacting with the stator strip 1304. In one embodiment, the stator strip 1304 comprises a plurality of permanent magnets and the rotor 1310 comprises a segment motor.

The polishing head 1300 further comprises a sensor assembly 1314 positioned opposite the encoder scale 1305 on the supporting frame 1301. The sensor assembly 1314 is configured to read the encoder 1305 and provide position, and/or velocity of the polishing head 1300 relative to the encoder scale 1305, and the guiding rails 1302, 1303.

The polishing head 1300 further comprises a mounting component 1311 attached to the carriage body 1307. The mounting component 1311 is configured to provide an interface with any devices to be carried by the polishing head 1300. In one embodiment, a polishing motor 1312 and a substrate carrier 1313 is mounted on the mounting component 1311.

Figure 14:
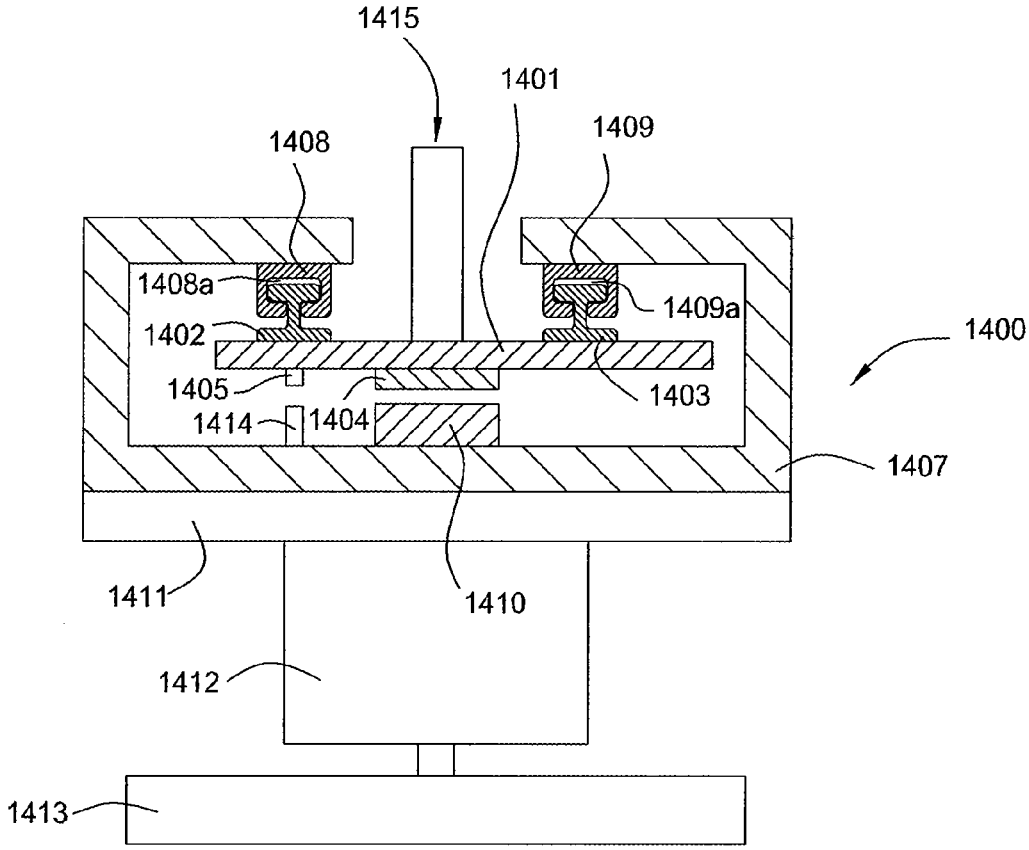
FIG. 14 is a schematic sectional side view of a polishing head and a track assembly in accordance with one embodiment described herein.

FIG. 14 is a schematic sectional side view of a polishing head 1400 and a track assembly 1415 in accordance with another embodiment described herein. The track assembly 1415 may be linear, curved, or circular.

The track assembly 1415 comprises a stationary portion having a supporting frame 1401, a first guiding rail 1402, a second guiding rail 1403, a stator strip 1404, and an encoder scale 1405 mounted on the supporting frame 1401. The guiding rails 1402, 1403, stator strip 1404, and encoder scale 1405 define a path along which the polishing head 1400 is configured to travel. The guiding rails 1402, 1403, stator strip 1404, and encoder scale 1405 may be parallel, concentric, or locally parallel depending on the shape of the path.

The guiding rails 1402, 1403 are attached to the supporting frame 1401 on a top side and the stator strip 1404 disposed on a bottom side of the supporting frame 1401. The polishing head 1400 comprises a carriage body 1407 on which a guide block 1408 and a guide block 1409 are mounted. The carriage body 1407 wraps around the tack assembly 1415 with the guide blocks 1408, 1409 sitting on the guiding rails 1402, 1403. The guide block 1408 has an inner channel 1408*a* configured to receive the guiding rail 1403, and the guide block 1409 has an inner channel 1409*a* configured to receive the guiding rail 1402. The inner channels 1408*a*, 1409*a* allow the polishing head 1400 to slide along the stationary portion of the track assembly 1415. In one embodiment, the guide blocks 1408, 1409 may comprise two or more sections configured to provide secured attachment between the guiding rails 1402, 1403.

The polishing head 1400 further comprises a rotor 1410 positioned facing the stator strip 1404. The rotor 1410 is configured to push the polishing head 1400 along the guiding rails 1402, 1403 or to station the polishing head 1400 on the guiding rails 1402, 1403 by reacting with the stator strip 1404. In one embodiment, the stator strip 1404 comprises a plurality of permanent magnets and the rotor 1410 comprises a segment motor.

The polishing head 1400 further comprises a sensor assembly 1414 positioned opposite the encoder scale 1405 on the supporting frame 1401. The sensor assembly 1414 is configured to read the encoder 1405 and provide position, and/or velocity of the polishing head 1400 relative to the encoder scale 1405, and the guiding rails 1402, 1403.

The polishing head 1400 further comprises a mounting component 1411 attached to the carriage body 1407. The mounting component 1411 is configured to provide interface to any devices to be carried by the polishing head 1400. In one embodiment, a polishing motor 1412 and a substrate carrier 1413 is mounted on the mounting component 1411.

Figure 15:
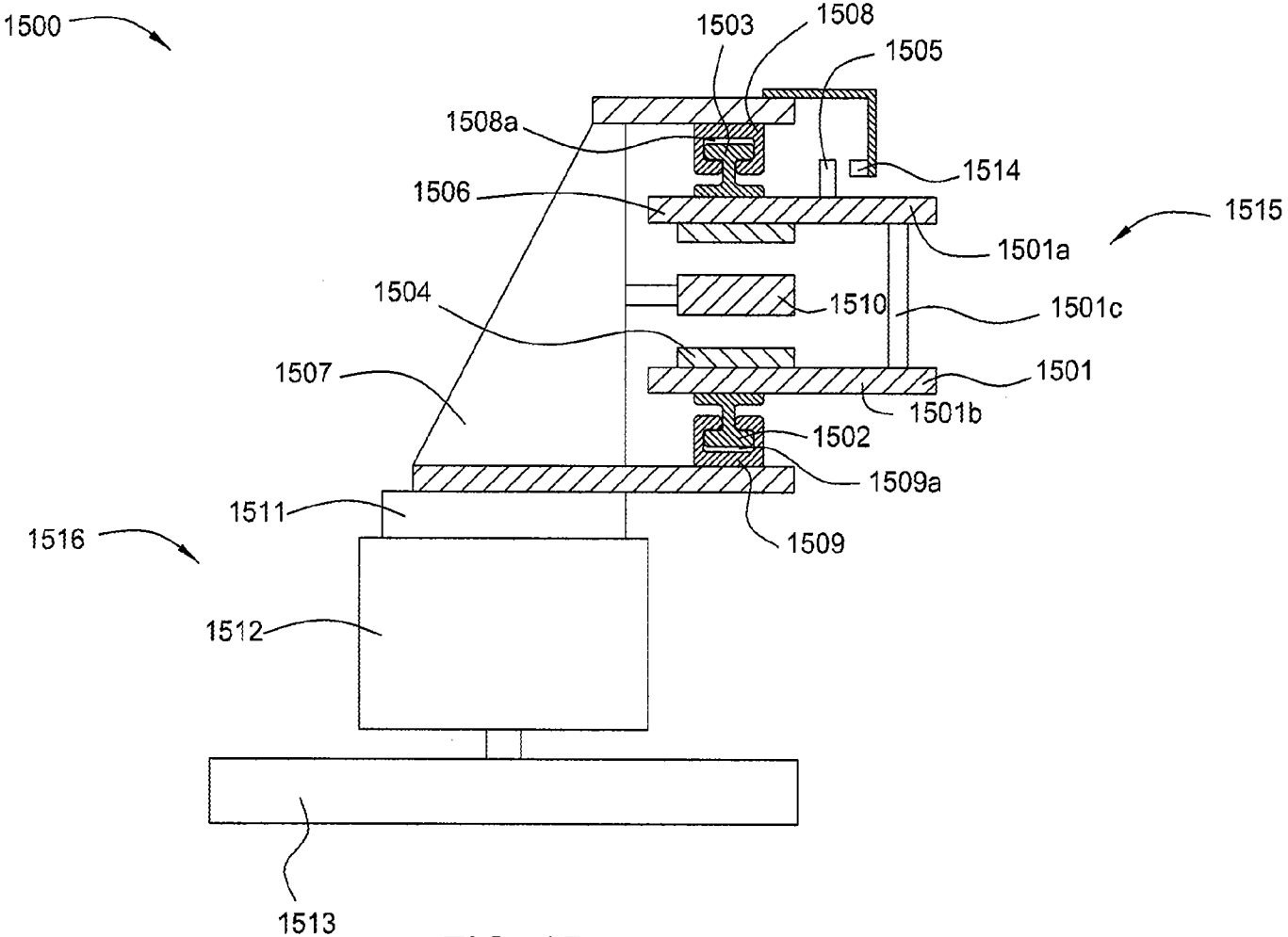
FIG. 15 is a schematic sectional side view of a polishing head and a track assembly in accordance with one embodiment described herein.

FIG. 15 is a schematic sectional side view of a polishing head 1500 and a track assembly 1515 in accordance with another embodiment described herein. The track assembly 1515 may be linear, curved, or circular.

The track assembly 1515 comprises a stationary portion having a supporting frame 1501. The supporting frame 1501 comprises an upper frame 1501*a* and a lower frame 1501*b* connected by a plurality of supporting columns 1501*c*. The stationary portion further comprises a first guiding rail 1502 mounted on a bottom side of the lower frame 1501*b*, a second guiding rail 1503 mounted on a top side of the upper frame 1501*a*. The stationary portion further comprises a stator strip 1504 disposed on a top side of the lower frame 1501*b* and a stator strip 1506 disposed on a bottom side of the upper frame 1501*a*. The stator strips 1504, 1506 provide more interaction with the polishing head 1500.

The guiding rails 1502, 1503, the stator strips 1504, 1506, and the encoder scale 1505 define a path along which the polishing head 1500 is configured to travel. The guiding rails 1502, 1503, the stator strip 1504, 1506, and the encoder scale 1505 may be parallel, concentric, or locally parallel depending on the shape of the path.

The polishing head 1500 is attached to the guiding rails 1502, 1503. The polishing head 1500 comprises a carriage body 1507 on which a guide block 1508 and a guide block 1509 are mounted. The guide block 1508 has an inner channel 1508*a* configured to receive the guiding rail 1503, and the guide block 1509 has an inner channel 1509*a* configured to receive the guiding rail 1502. The inner channels 1508*a*, 1509*a* allow the carriage assembly 1515 to slide along the stationary portion of the track assembly 1515. In one embodiment, the guide blocks 1508, 1509 may comprise two or more sections configured to provide secured attachment between the guiding rails 1502, 1503. In one embodiment, the carriage body 1507 may be designed to assert the weight of the carriage assemblies 1515 is evenly distributed between the guiding rails 1502, 1503.

The polishing head 1500 further comprises a rotor 1510 positioned facing the stator strip 1504. The rotor 1510 is configured to push the polishing head 1500 along the guiding rails 1502, 1503 or to station the polishing head 1500 on the guiding rails 1502, 1503 by reacting with the stator strips 1504, 1506. The rotor 1510 is disposed between the stator strips 1504, 1506. In one embodiment, each of the stator strips 1504, 1506 comprises a plurality of permanent magnets and the rotor 1510 comprises one or more segment motors.

The polishing head 1500 further comprises a sensor assembly 1514 positioned opposite the encoder scale 1505 on the supporting frame 1501. The sensor assembly 1514 is configured to read the encoder 1505 and provide position, and/or velocity of the polishing head 1500 relative to the encoder scale 1505, and the guiding rails 1502, 1503.

The polishing head 1500 further comprises a mounting component 1511 attached to the carriage body 1507. The mounting component 1511 is configured to provide an interface with any devices to be carried by the polishing head 1500. In one embodiment, a polishing head 1516 having a polishing motor 1512 and a substrate carrier 1513 is mounted on the mounting component 1511. The carriage body 1507 is substantially a cantilever structure with one end secured to the guiding rails 1502, 1503, and an opposite end bearing the weight of the polishing head 1516.

Figure 16:
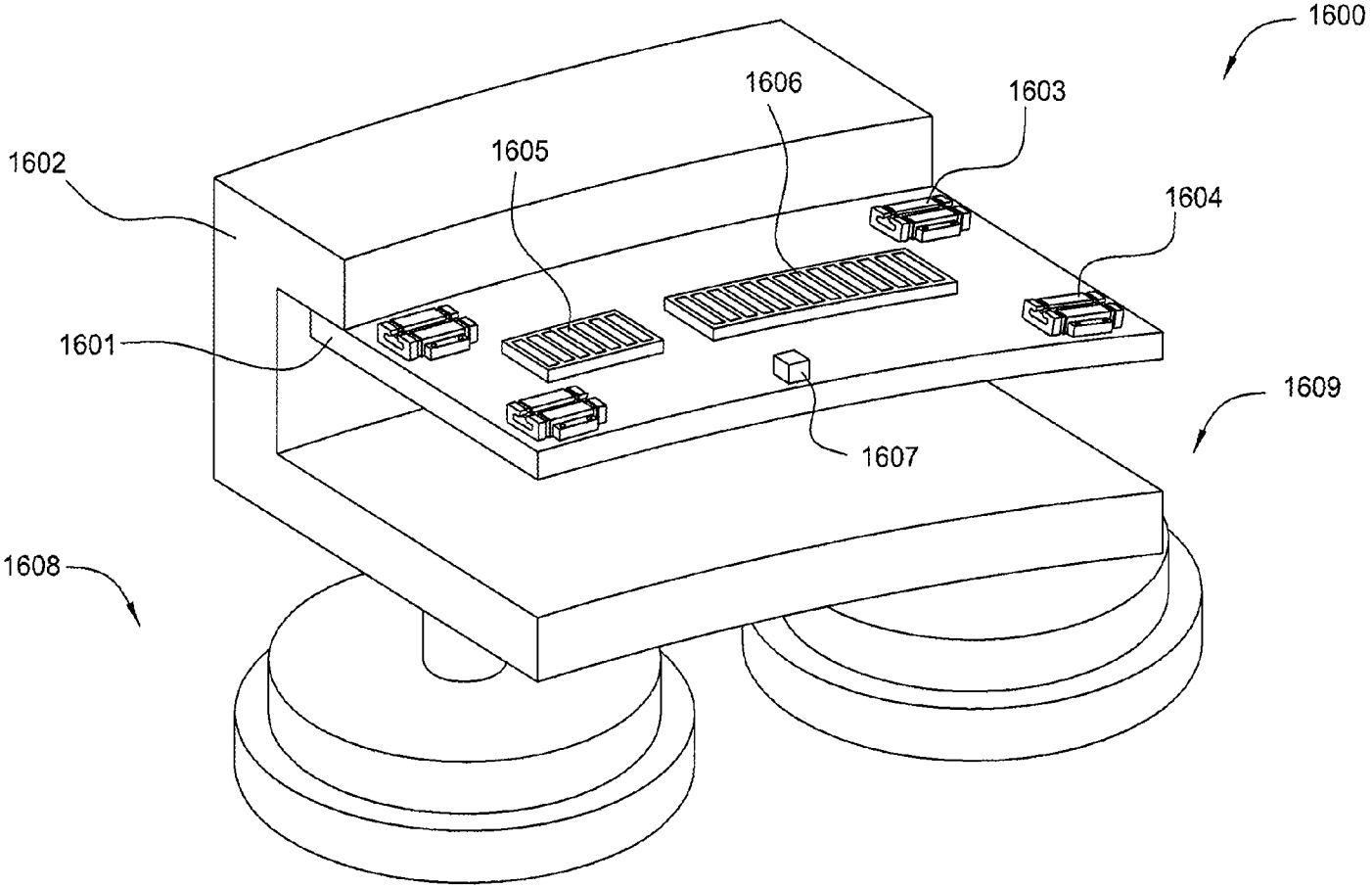
FIG. 16 is a schematic perspective view of a polishing head having two substrate carriers in accordance with one embodiment described herein.

FIG. 16 is a schematic perspective view of a polishing head 1600 having two substrate carriers 1608, 1609 in accordance with one embodiment described herein. As discussed above, polishing heads in accordance with embodiments described herein, may comprise multiple substrate carriers for processing multiple substrates simultaneously.

The polishing head 1600 comprises a carriage body 1601 having guide blocks 1603, 1604, rotors 1605, 1606, a sensor 1607 attached thereto, and configured to facilitate movement of the polishing head along a track assembly.

A mounting frame 1602 is attached to the carriage body 1601 and configured to connect two substrate carriers 1608, 1609 each configured to carry and process one substrate. The substrate carriers 1608, 1609 are transported and oscillated along the track assembly together by the carriage body 1601. In one embodiment, the transportation of the substrate carriers 1608, 1609 may be performed by the rotor 1606, and the oscillation may be performed by the rotor 1605.

Figure 17:
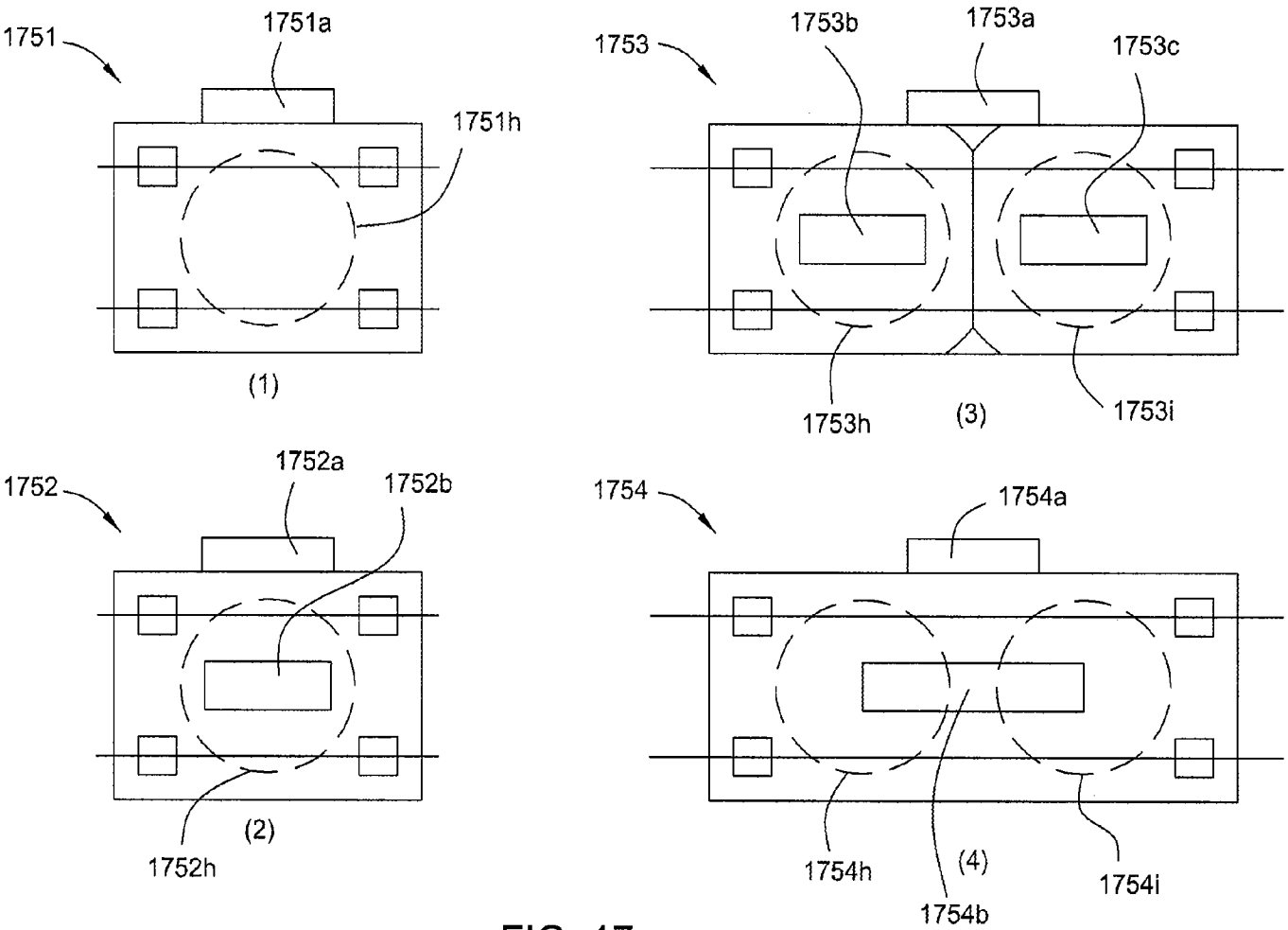
FIG. 17 schematically illustrates different configurations of actuators for transportation and sweeping in accordance with embodiments described herein.

The arrangement of actuators for transportation and oscillation may be determined by process requirements. FIG. 17 schematically illustrates different configurations of actuators for transportation and sweeping in accordance with embodiments described herein.

Polishing head 1751 comprises one actuator 1751*a* and one carrier head 1751*h*. The actuator 1751*a* is configured to conduct both transportation and oscillation of the carrier head 1751*h*. This embodiment is efficient with only one actuator, structurally robust. The single actuator configuration also reduces chances of cross talk among actuators.

Polishing head 1752 comprises a carrier head 1752*h*, a transport actuator 1752*a* and a sweeping actuator 1752*b* configured to conduct transportation and oscillation the carrier head 1752*h* respectively. The configuration allows choosing suitable actuators for sweeping and transportation.

Polishing head 1753 comprises two carrier heads 1753*h*, 1753*i*, a transport actuator 1753*a* configured to transfer the carrier heads 1753*h*, 1753*i*, and two oscillate actuators 1753*b*, 1753*c* configured to oscillate the carrier heads 1753*h*, 1753*i* respectively. This configuration provides flexibility between the two carrier heads 1753*h*, 1753*i*. The carrier heads 1753*h*, 1753*i* may be mounted on separate carrier bodies to allow independent sweeping motion.

Polishing head 1754 comprises two carrier heads 1754*h*, 1754*i*, a transport actuator 1754*a* configured to transfer the carrier heads 1754*h*, 1754*i*, and an oscillate actuator 1754*b* configured to oscillate the carrier heads 1754*h*, 1754*i* together. The configuration allows choosing suitable actuators for sweeping and transportation.

Even though a planarization process is described with the non-contact substrate holder described herein, a person skilled in the art can apply the non-contact substrate holder for holding and transferring substrates in any suitable processes, including but not limited to wet cleaning, electroplating, and electroless plating.

Shield Assembly:

Embodiments described herein further provide a shield for isolating a substrate processing environment from substrate transferring mechanisms in an overhead circular track system which advantageously reduces system maintenance and increases system uptime.

Figure 18A:
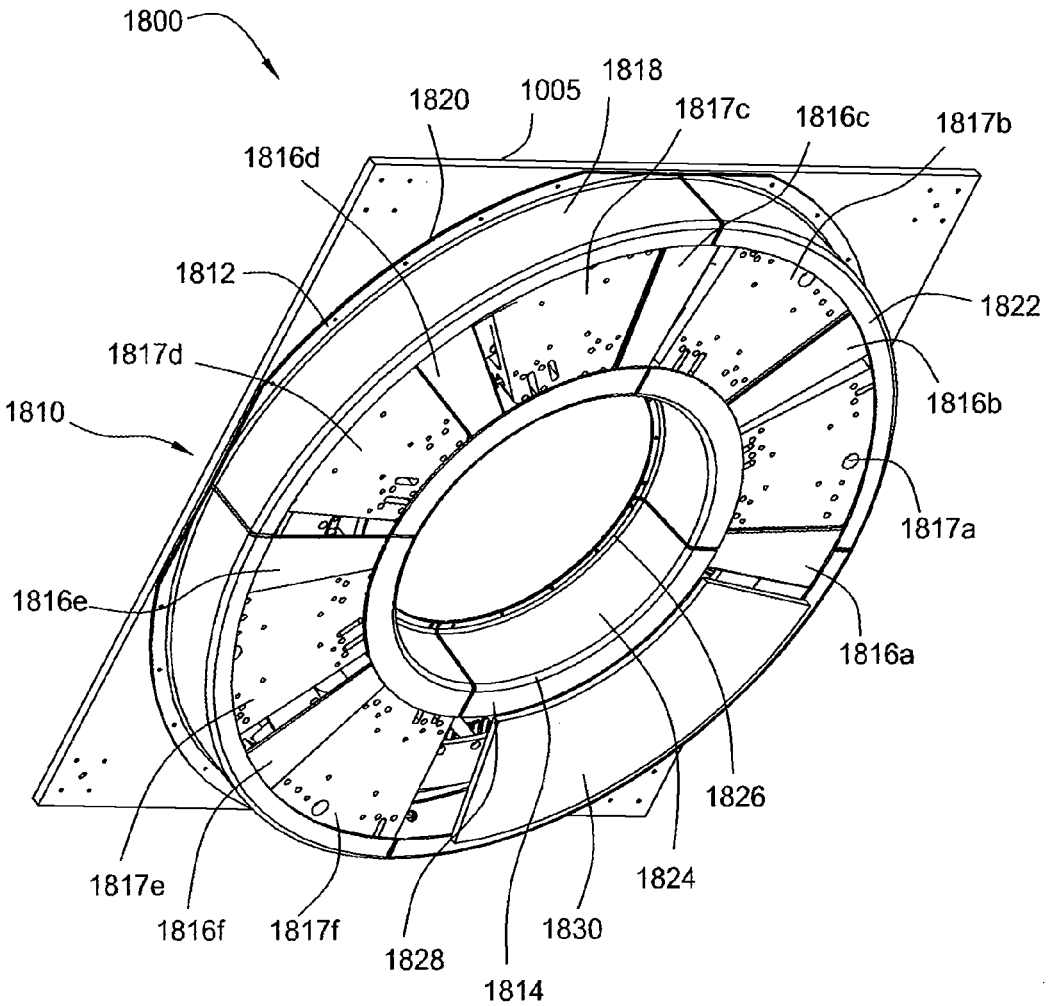
FIG. 18A is a perspective view of a track system with a shield assembly in accordance with one embodiment described herein.
Figure 18B:
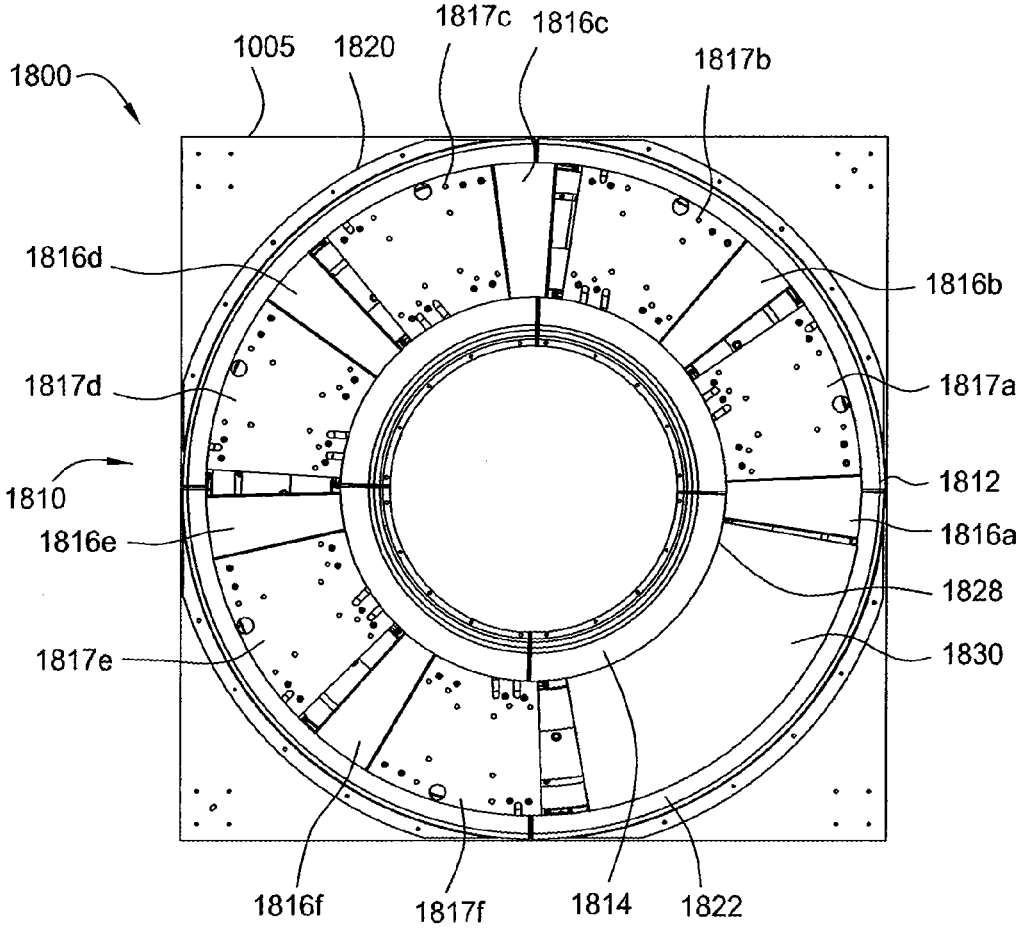
FIG. 18B is a bottom view of the track system with the shield assembly of FIG. 18A.

FIG. 18A is a perspective view of a track system 1800 with a shield assembly 1810 in accordance with one embodiment described herein. FIG. 18B is a bottom view of the track system 1800 with the shield assembly 1810 of FIG. 18A. The shield assembly 1810 comprises an outer stationary shield 1812, an inner stationary shield 1814, and a plurality of movable shields 1816*a*-1816*f*. The outer stationary shield 1812, the inner stationary shield 1814, and the movable shields 1816*a*-1816*f* work in conjunction to isolate the substrate transfer mechanisms and electronic components of the track system 1800 from the processing environment. In one embodiment, the isolated area containing the substrate transfer mechanisms and electronic components has suction ports to further isolate the process environment from the substrate transfer mechanisms and electronic components. In one embodiment, the isolated area may be pressurized to further isolate the process environment from the substrate transfer mechanisms and electronic components.

The outer stationary shield 1812 is coupled with the supporting frame 1005. The outer stationary shield 1812 is of unitary construction and comprises a cylindrical band 1818 dimensioned to encircle the two guide rails 1006, 1007 (not shown in this view). A rim 1820 extends radially outward from the top of the cylindrical band 1818 of the outer stationary shield 1812. The rim 1820 may have a plurality of holes for securing the outer stationary shield 1812 to the supporting frame 1005. The outer stationary shield 1812 may be coupled with the supporting frame 1005 using, for example, rivets, screws, or any other attachment means known in the art. An inner lip 1822 extends radially inward from the bottom of the cylindrical band 1818 of the outer stationary shield 1812. In one embodiment, the outer stationary shield 1812 comprises four separate crescent shaped pieces which are welded together to form the outer stationary shield 1812.

The inner stationary shield 1814 is also coupled with the supporting frame 1005. The inner stationary shield 1814 is of unitary construction and comprises a cylindrical band 1824 dimensioned to fit within the inner diameter of the two guide rails 1006, 1007. A lip 1826 extends radially inward from the top of the cylindrical band 1824 of the inner stationary shield 1814. The lip 1826 may have a plurality of holes for securing the inner stationary shield 1814 with the supporting frame 1005 using, for example, rivets, screws, or any other attachment means known in the art. An outer lip 1828 extends radially outward from the bottom of the cylindrical band 1824 of the inner stationary shield 1814. In one embodiment, the outer stationary shield 1812 comprises four separate pieces which are welded together to form the outer stationary shield 1814.

The movable shields 1816*a*-1816*f* may be coupled with the carriage body 1001. In one embodiment, each movable shield 1816*a*-1816*f* is coupled with a corresponding adapter plate

Figure 19:
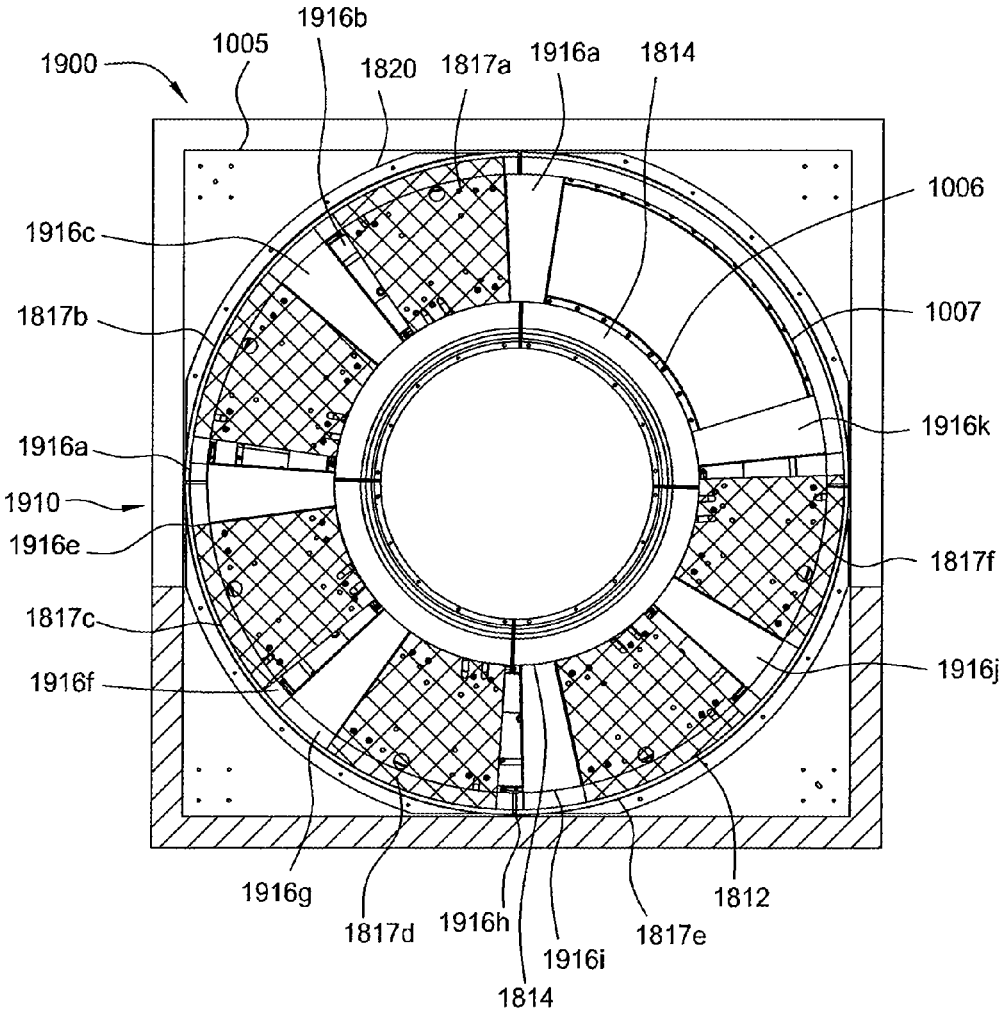
FIG. 19 is a bottom view of the track system with a shield assembly in accordance with one embodiment described herein.

1817*a*-1817*f* of the carriage body 1001. Although only one moveable shield 1816*a*-1816*f* is shown coupled with each corresponding adapter plate 1817*a*-1817*f*, it should be understood that multiple movable shields may be coupled with each adapter plate 1817*a*-1817*f*, for example, one shield may be coupled on opposing sides of each adapter plate 1817*a*-1817*f* for a total of two movable shields coupled with each adapter plate 1817*a*-1817*f* as shown in FIG. 19. It should also be understood that the track system 1800 may be configured to have more or less than six adapter plates depending upon the users needs. The movable shields may be coupled with each adapter plate 1817*a*-1817*f*.

Each movable shield 1816*a*-1816*f* comprises a wedge-shaped plate. Each movable shield 1816*a*-1816*f* is dimensioned so that the outer periphery of each movable shield overlaps the inner lip 1822 of the cylindrical band 1818 of the outer stationary shield 1812. Each movable shield 1816*a*-1816*f* is further designed so that the inner periphery of the movable shield overlaps with the outer lip 1828 of the inner stationary shield 1814. Each movable shield 1816*a*-1816*f* may have a plurality of holes for securing the movable shield 1816*a*-1816*f* to a corresponding adapter plate 1817*a*-1817*f* using, for example, rivets, screws, or any other attachment means known in the art.

In embodiments, where the number of adapter plates and corresponding movable shields do not sufficiently isolate the substrate processing environment from substrate transferring mechanisms any number of additional movable shields 1830 which may be uncoupled from the adapter plates may be added. The additional movable shield 1830 comprises a crescent shaped piece. The additional movable shield may be coupled with the guide rails 1006, 1007 using guide blocks 1002, 1003.

FIG. 19 is a bottom view of a track system 1900 with a shield assembly 1910 in accordance with one embodiment described herein. Like the shield assembly 1810 shown in FIGS. 18A and 18B, the shield assembly 1910 comprises an outer stationary shield 1812, an inner stationary shield 1814, and a plurality of movable shields 1916*a*-1916*k*. However, in the embodiment of FIG. 19, each adapter plate 1817*a*-1817*f* is coupled with two shields. For example, the adapter plate 1817*a* is coupled with movable shield 1916*a* and movable shield 1916*b*. Also, as shown in FIG. 19, adjacent movable shields may overlap. For example, movable shield 1916*b* is located in a z-plane slightly above the plane of movable shield 1916*c* such that the movable shield 1916*b* may overlap and/or telescope with the movable shield 1916*c*. A portion of the movable shield in FIG. 19 has been removed to show the inner guide rail 1006 and the outer guide rail 1007.

In operation, the adapter plates move in pairs. For example, adapter plates 1817*a* and 1817*b* may move either clockwise or counterclockwise in unison. As the adapter plates 1817*a* and 1817*b* move in unison, movable shield 1916*b* and movable shield 1916*c* maintain there overlapping positions thus maintaining isolation of the substrate processing environment from the substrate transferring mechanisms.

Figure 20:
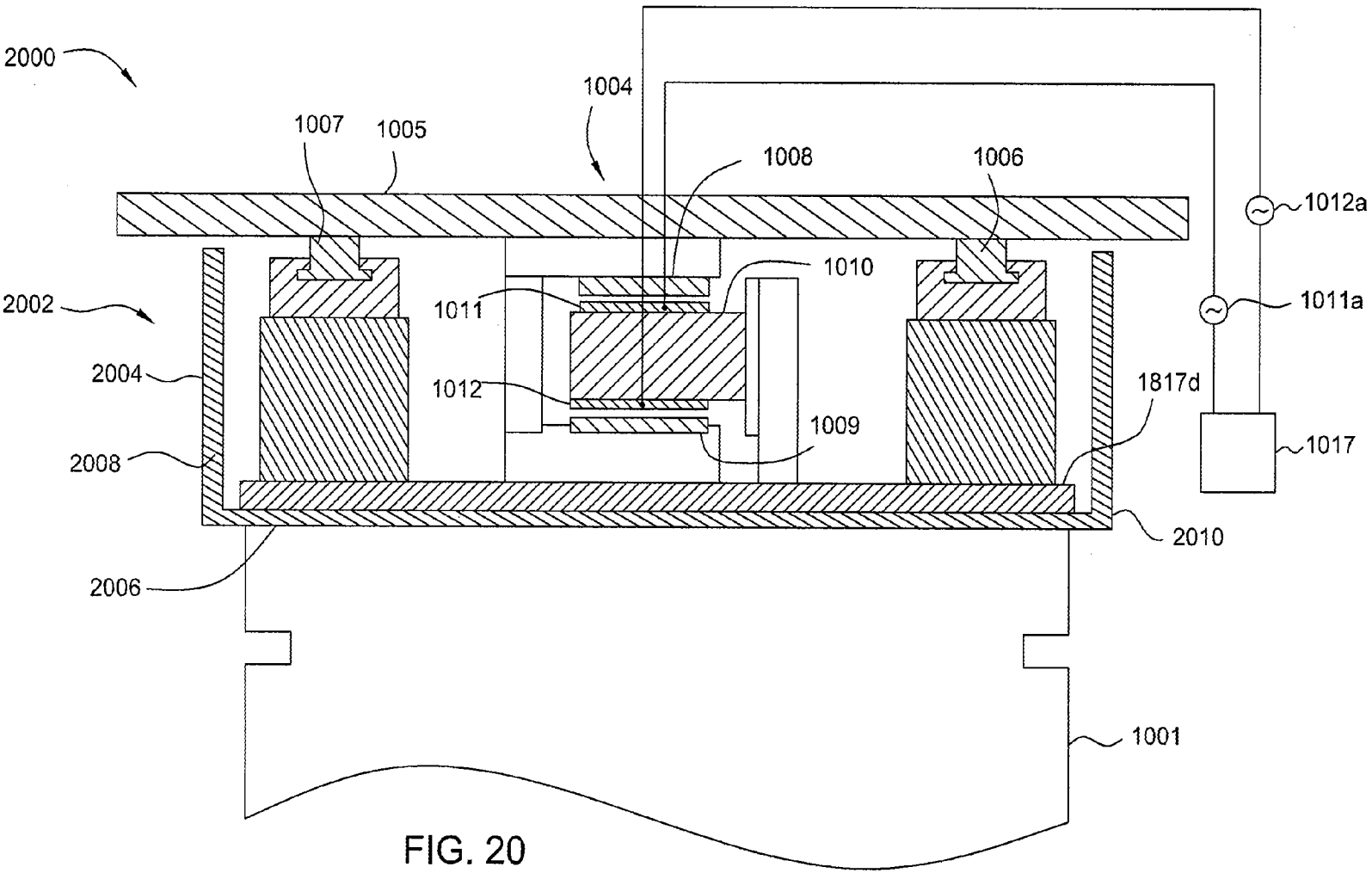
FIG. 20 is a schematic partial cross-sectional view of a track system with a shield assembly in accordance with one embodiment described herein.

FIG. 20 is a schematic partial cross-sectional view of a track system 2000 with a shield assembly 2002 in accordance with one embodiment described herein. The shield assembly 2002 comprises a movable u-shaped shield 2004. The u-shaped shield 2004 comprises an annular band 2006. An outer cylindrical band 2008 and an inner cylindrical band 2010 are coupled with and extend upward from the annular band 2006. The u-shaped shield 2004 is coupled with the carriage body 1001 such that the u-shaped shield moves with the carriage body 1001 as the carriage assembly travels along the guide rails 1006, 1007. In one embodiment, the u-shaped shield 2004 is coupled between the adapter plate 1817*d* and the carriage body 1001. Each u-shaped shield telescopes with an adjacent u-shaped shield such that the substrate transferring mechanisms remain isolated from the processing environment.

Figure 21:
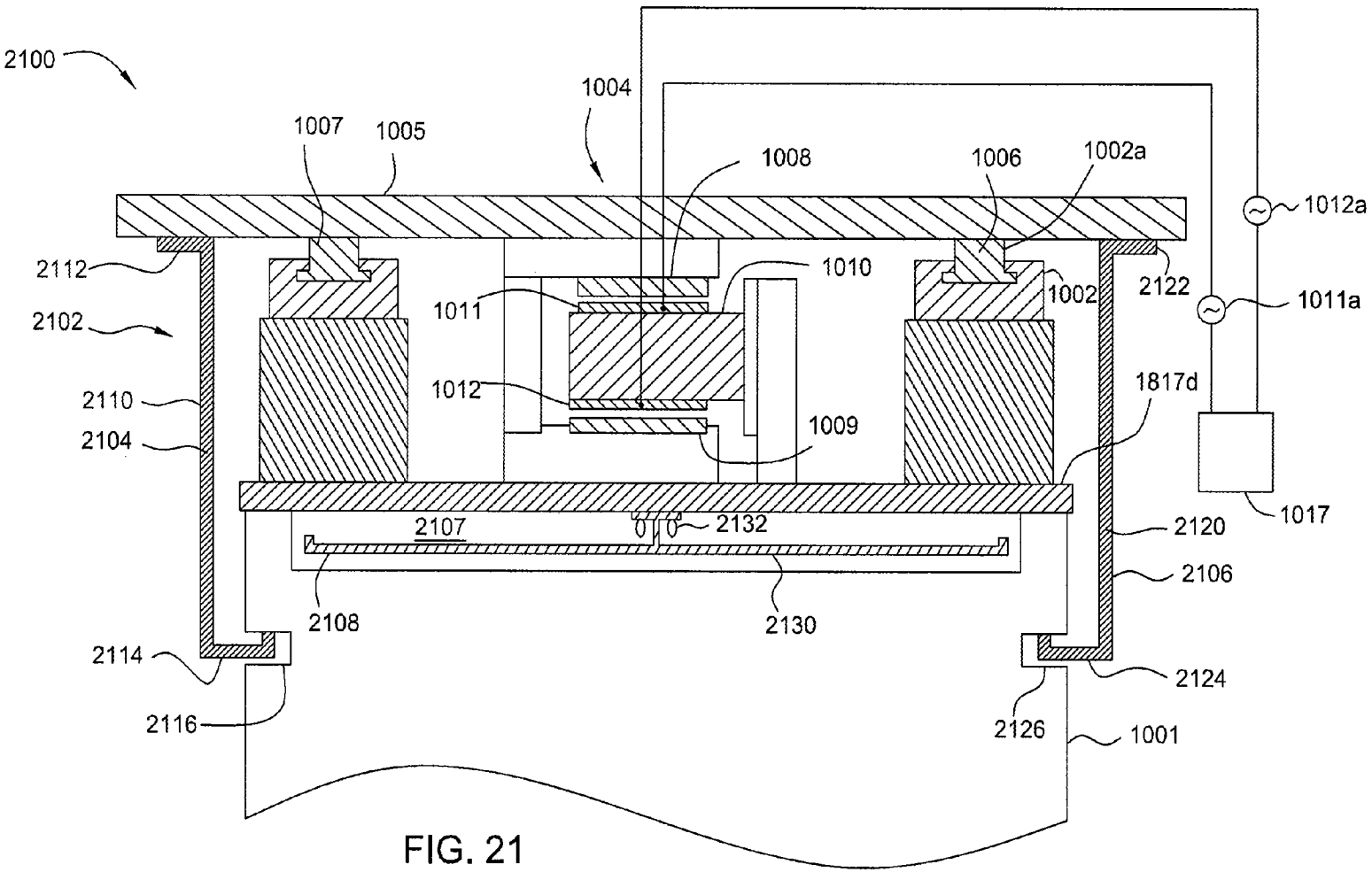
FIG. 21 is a schematic partial cross-sectional view of a track system with a shield assembly in accordance with another embodiment described herein.

FIG. 21 is a schematic partial cross-sectional view of a track system 2100 with a shield assembly 2102 in accordance with another embodiment described herein. The shield assembly 2102 is a 3-piece shield assembly comprising an outer L-shaped stationary shield 2104 and an inner L-shaped stationary shield 2106 coupled with the supporting frame 1005 and a donut or toroidal shaped shield 2108 suspended from the adapter plate 1817*d* in a recess 2107 formed between the adapter plate 1817*d* and the carriage body 1001. In one embodiment, the outer L-shaped stationary shield 2104 and the inner L-shaped stationary shield 2106 are coupled with a top plate of the supporting frame 1005.

The outer L-shaped stationary shield 2104 is of unitary construction and comprises a cylindrical band 2110 dimensioned to encircle the outer guide rail 1007. A rim 2112 extends radially outward from the top of the cylindrical band 2110 of the outer L-shaped stationary shield 2104. The rim 2112 may have a plurality of holes for securing the outer L-shaped stationary shield 2104 to the supporting frame 1005. The outer L-shaped stationary shield 2104 may be coupled with the supporting frame 1005 using, for example, rivets, screws, or any other attachment means known in the art. An inner lip 2114 extends radially inward from the bottom of the cylindrical band 2110 of the outer L-shaped stationary shield 2104. The inner lip 2114 extends radially inward into a recess 2116 formed in the carriage body 1001.

The inner L-shaped stationary shield 2106 is also of unitary construction and comprises a cylindrical band 2120 dimensioned to fit within the inner diameter of the inner guide rail 1006. A lip 2122 extends radially inward from the top of the cylindrical band 2120 of the inner L-shaped stationary shield 2106. The lip 2122 may have a plurality of holes for securing the inner L-shaped stationary shield 2106 with the supporting frame 1005 using, for example, rivets, screws, or any other attachment means known in the art. An outer lip 2124 extends radially outward from the bottom of the cylindrical band 2120 of the inner L-shaped stationary shield 2106. The outer lip 2124 extends radially outward into the recess 2126 formed in the carriage body 1001.

The donut shaped shield 2108 is of unitary construction and comprises an annular band 2130 having a hole in the center. The donut shaped shield 2108 is suspended from the adapter plate 1817*d* in the recess 2107 formed between the adapter plate 1817*d* and the carriage body 1001. The donut shaped shield 2108 is dimensioned to cover the entire circular area of the inner guide rail 1006 and the outer guide rail 1007. Each carriage assembly comprises support such as rollers or guides 2132 for the donut shaped shield 2108. Advantageously, this shield assembly 2102 can be used with all platen and polishing head configurations and in each configuration the angles between each carriage assembly may be variable.

Figure 22:
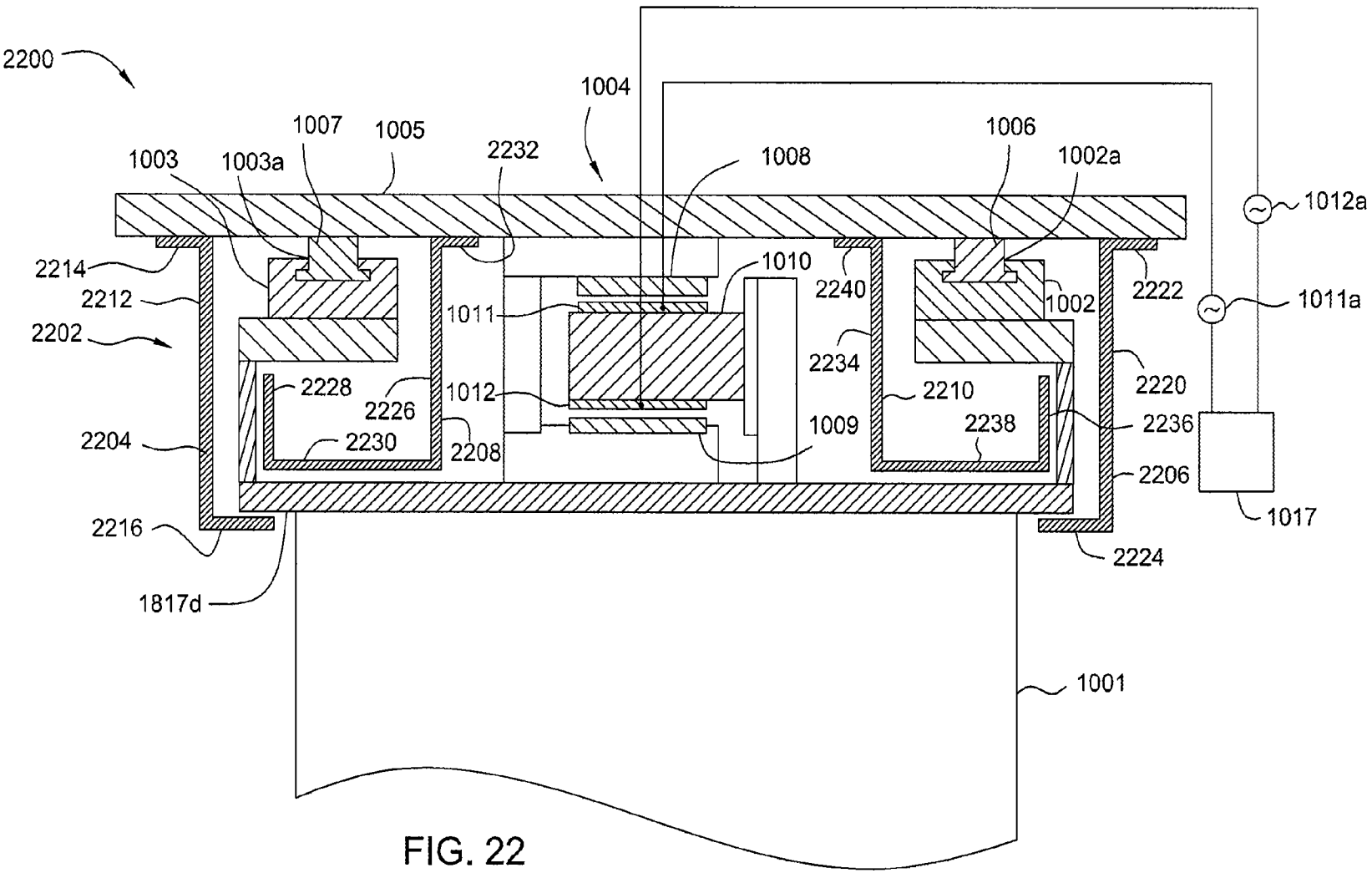
FIG. 22 is a schematic partial cross-sectional view of a track system with a shield assembly in accordance with yet another embodiment described herein.

FIG. 22 is a schematic partial cross-sectional view of a track system 2200 with a shield assembly 2202 in accordance with yet another embodiment described herein. The shield assembly 2202 is a four piece shield assembly 2202 comprising an outer L-shaped stationary shield 2204 and an inner L-shaped stationary shield 2206 coupled with the supporting frame 1005. The shield assembly 2202 further comprises a first u-shaped shield 2208 and a second u-shaped shield 2210 located in between the outer L-shaped stationary shield 2204 and the inner L-shaped stationary shield and coupled with the supporting frame 1005. In one embodiment, the outer L-shaped stationary shield 2204 and the inner L-shaped stationary shield 2206 are coupled with a top plate of the supporting frame 1005.

The outer L-shaped stationary shield 2204 is of unitary construction and comprises a cylindrical band 2212 dimensioned to encircle the outer guide rail 1007. A rim 2214 extends radially outward from the top of the cylindrical band 2212 of the outer L-shaped stationary shield 2204. The rim 2214 may have a plurality of holes for securing the outer L-shaped stationary shield 2204 to the supporting frame 1005. The outer L-shaped stationary shield 2204 may be coupled with the supporting frame 1005 using, for example, rivets, screws, or any other attachment means known in the art. An inner lip 2216 extends radially inward from the bottom of the cylindrical band 2212 of the outer L-shaped stationary shield 2204. The inner lip 2216 extends radially inward extending under an edge of the adapter plate 1817*d* forming a labyrinth gap between the edge of the adapter plate 1817*d* and the outer L-shaped stationary shield 2204.

The inner L-shaped stationary shield 2206 is of unitary construction and comprises a cylindrical band 2220 dimensioned to fit within the inner diameter of the inner guide rail 1006. A lip 2222 extends radially inward from the top of the cylindrical band 2220 of the inner L-shaped stationary shield 2206. The lip 2222 may have a plurality of holes for securing the inner L-shaped stationary shield 2206 with the supporting frame 1005 using, for example, rivets, screws, or any other attachment means known in the art. An outer lip 2224 extends radially outward from the bottom of the cylindrical band 2220 of the inner L-shaped stationary shield 2206. The outer lip 2224 extends radially outward extending under an edge of the adapter plate 1817*d* forming a labyrinth gap between the edge of the adapter plate 1817*d* and the inner L-shaped stationary shield 2206.

The first u-shaped shield 2208 comprises an inner cylindrical band 2226, an outer cylindrical band 2228, and an annular band 2230. The inner cylindrical band 2226 surrounds an outer periphery of the actuator assembly 1010. The annular band 2230 extends radially outward from the bottom of the inner cylindrical band 2226. The outer cylindrical band 2228 extends upward from the annular band 2230 to form the u-shaped channel. A lip 2232 extends radially inward from the top of the inner cylindrical band 2226 of the first u-shaped shield 2208. The lip 2232 may have a plurality of holes for securing the first u-shaped shield 2208 with the supporting frame 1005 using, for example, rivets, screws, or any other attachment means known in the art.

The second u-shaped shield 2210 mirrors the first u-shaped shield 2208. The second u-shaped shield 2210 comprises an outer cylindrical band 2234, an inner cylindrical band 2236, and an annular band 2238. The outer cylindrical band 2234 surrounds an inner periphery of the actuator assembly 1010. The annular band 2238 extends radially inward from the bottom of the outer cylindrical band 2234. The inner cylindrical band 2236 extends upward from the annular band 2238 to form the u-shaped channel. A lip 2240 extends radially outward from the top of the outer cylindrical band 2234 of the second u-shaped shield 2210. The lip 2240 may have a plurality of holes for securing the second u-shaped shield 2210 with the supporting frame 1005 using, for example, rivets, screws, or any other attachment means known in the art.

Figure 23:
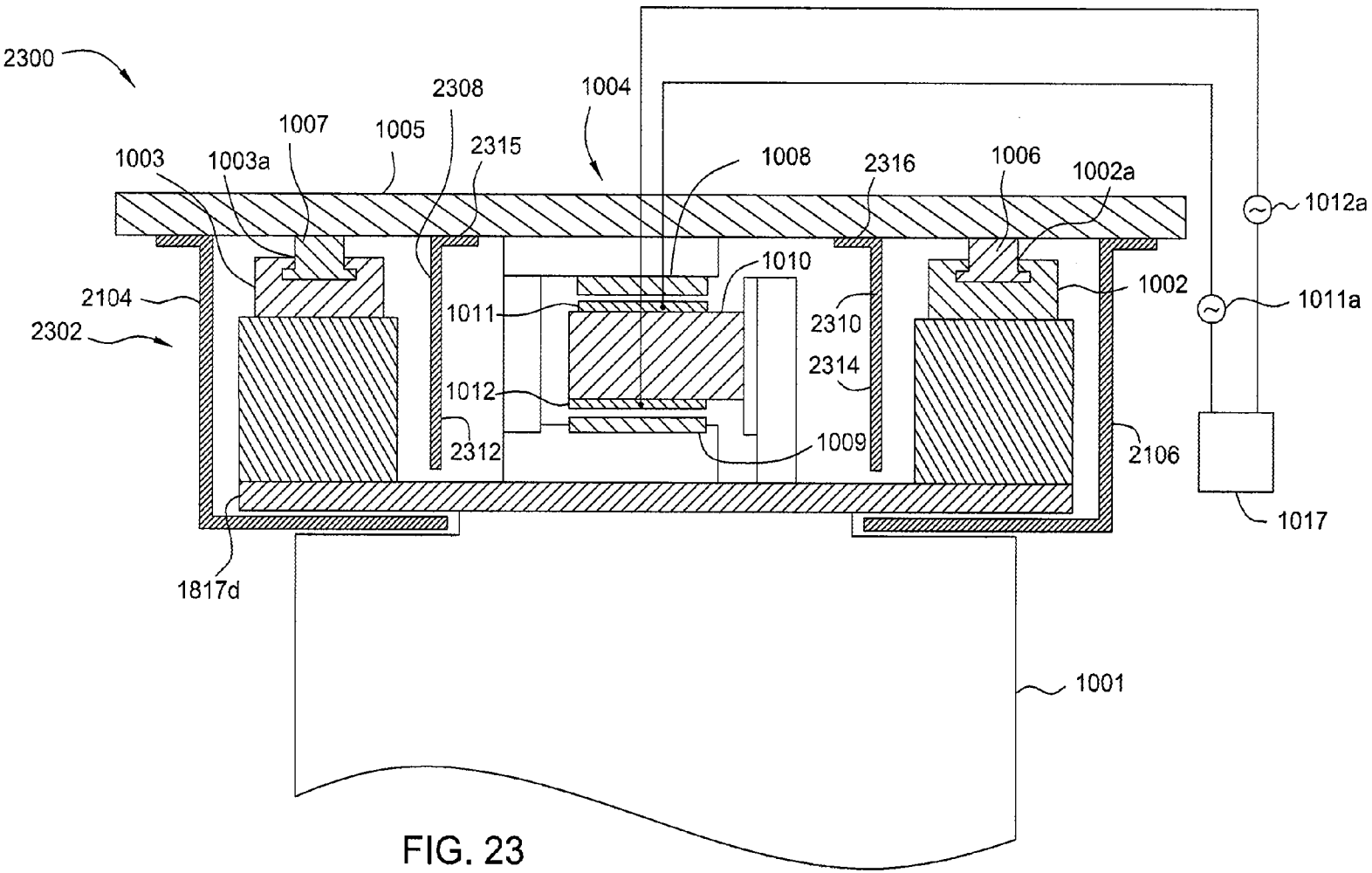
FIG. 23 is a schematic partial cross-sectional view of a track system with a shield assembly in accordance with yet another embodiment described herein.

FIG. 23 is a schematic cross-sectional view of a track system 2300 with a shield assembly 2302 in accordance with yet another embodiment described herein. The shield assembly 2302 is a four piece shield assembly comprising the outer L-shaped stationary shield 2104 and the inner L-shaped stationary shield 2106 coupled with the supporting frame 1005. The shield assembly 2302 further comprises a first shield 2308 and a second shield 2310 located in between the outer L-shaped stationary shield 2104 and the inner L-shaped stationary shield 2106 and coupled with the supporting frame 1005. In one embodiment, the outer L-shaped stationary shield 2104 and the inner stationary L-shaped shield 2106 are coupled with a top plate of the support frame 1005.

The outer L-shaped stationary shield 2104 and the inner L-shaped stationary shield 2106 are described above. The first shield 2308 comprises a cylindrical band 2312 that surrounds the outer periphery of the actuator assembly 1010. A lip 2315 extends radially inward from the top of the cylindrical band 2312. The second shield 2310 comprises a cylindrical band 2312 that is positioned in between an inner periphery of the actuator assembly 1010 and the inner guide rail 1006. A lip 2316 extends radially outward from the cylindrical band 2314.

Figure 24:
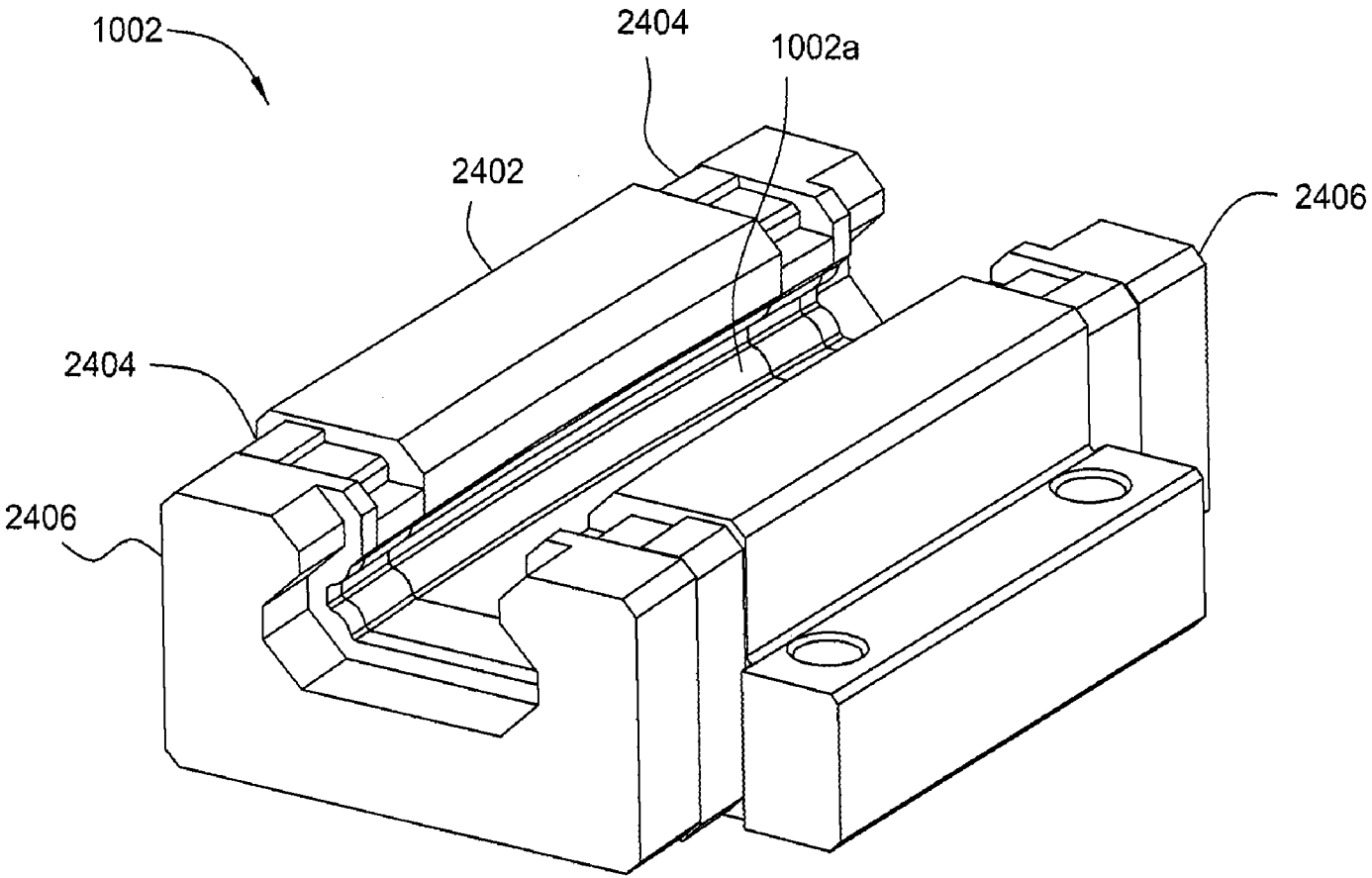
FIG. 24 is a perspective view of a guide block with a replaceable seal according to one embodiment described herein.

Replaceable Seal for Guide Rails:

FIG. 24 is a perspective view of a guide block 1002 with a replaceable seal 2406 according to one embodiment described herein. The guide block 1002 has a sliding channel 1002*a* shaped to straddle and slide over a guide rail 1007. The guide block 1002 is movable in a longitudinal direction along the rail. The guide block 1002 comprises a block 2402 and end plates 2404. The replaceable seal 2406 is arranged outside the end plates 2404 which are coupled with both ends of the block 2402. The replaceable seal 2406 prevents foreign objects from the processing environment such as dirt and dust from entering the guide block 1002. Further, the seal 2406 contains particles generated within the guide block 1002 thereby reducing any adverse impact on the process due to the sliding motion of the guide block 1002 along the guide rail 1007.

Figure 25A:
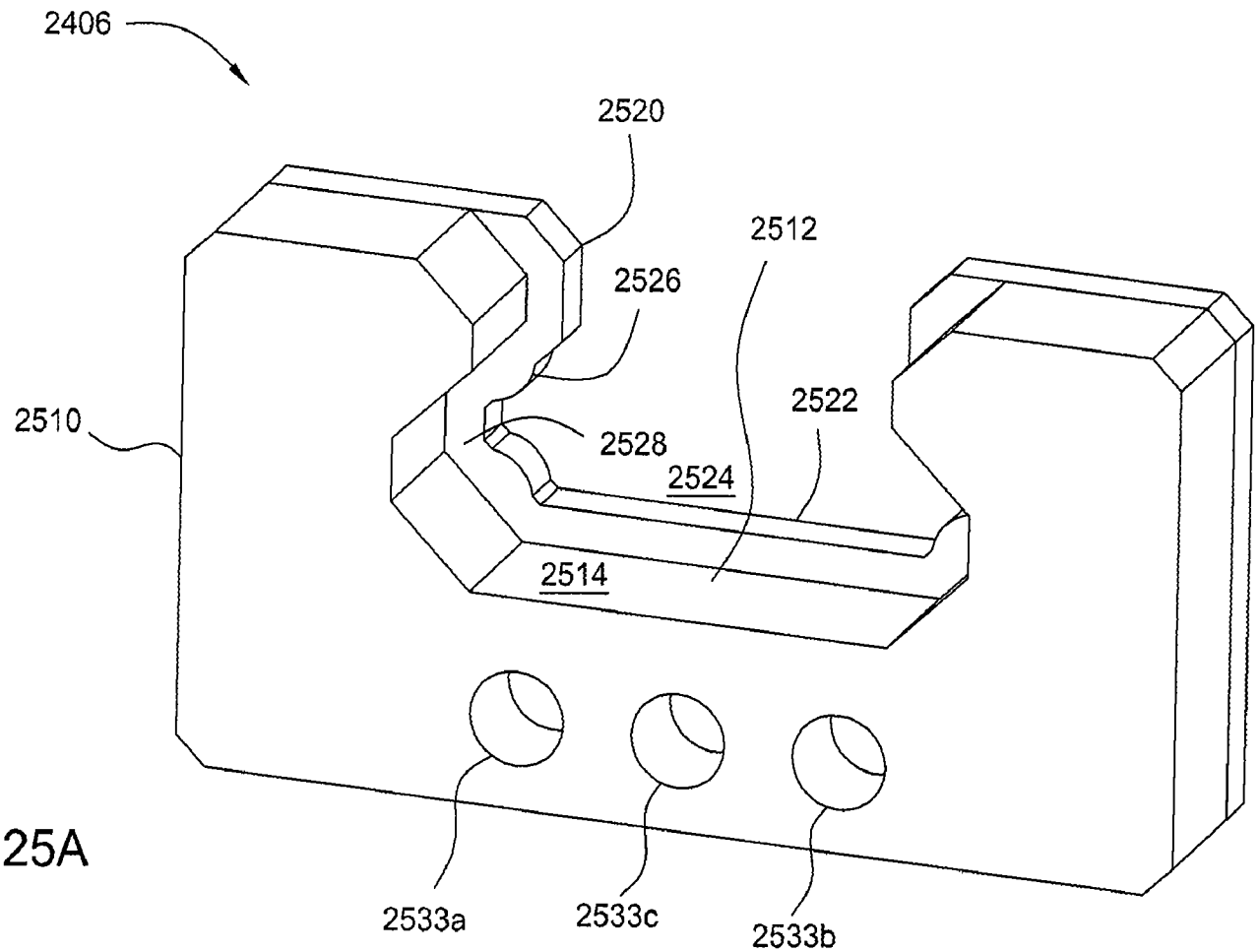
FIG. 25A is a perspective view of a replaceable seal according to one embodiment described herein.
Figure 25B:
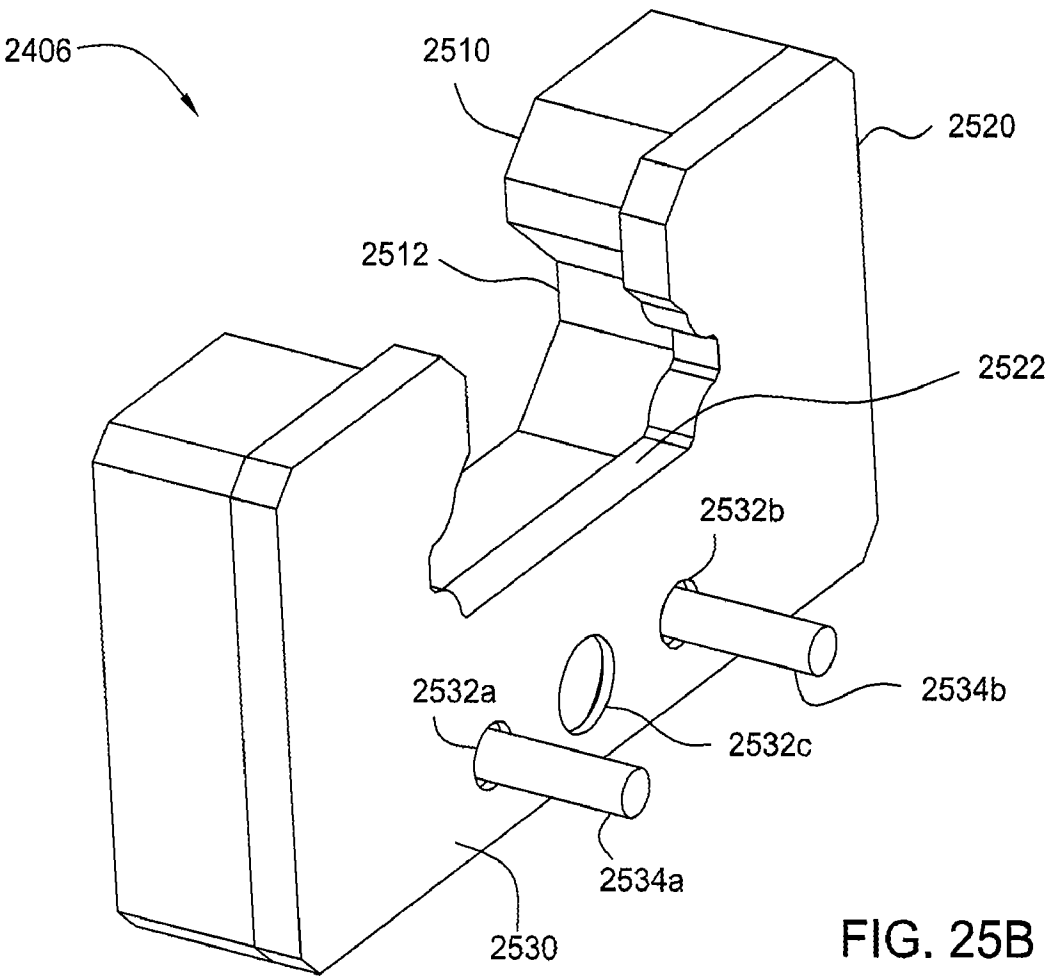
FIG. 25B is a perspective rear view of the replaceable seal of FIG. 25A according to one embodiment described herein.

FIG. 25A is a perspective view of a replaceable seal 2406 according to one embodiment described herein. FIG. 25B is a perspective rear view of the replaceable seal 2406 of FIG. 25A according to one embodiment described herein. The replaceable seal comprises a backing plate 2510 and a seal member 2520. The backing plate 2510 has an inner circumferential face 2512 forming a recessed portion 2514 to accommodate a guide rail 1007. In one embodiment, the backing plate 2510 couples the seal member 2520 to the guide block 2402 while providing rigidity to the seal member 2520. The seal member 2520 has an inner circumferential face 2522 forming a recessed portion 2524 which accommodates the guide rail 1007. A stepped portion 2526 is formed at the intersection of the inner circumferential face 2512 of the backing plate 2510 and a first surface 2528 of the seal member 2520. In one embodiment, the inner circumferential face 2522 of the seal member 2520 is offset from the inner circumferential face 2512 of the backing plate 2510 such that a distance between opposing sides of the inner circumferential face 2522 of the seal member 2520 is smaller than the distance between opposing sides of the inner circumferential face 2512 of the backing plate 2510. In one embodiment, the seal member 2520 is compressible around the rail thus preventing dirt and debris along the guide rail 1007 from entering the guide block 2402.

A second surface 2530 of the seal member 2520 opposing the first surface 2528 of the seal member 2520 has a series of holes 2532*a*, 2532*b*, and 2532*c*. Coupling pins 2534*a*, 2534*b* extend through the holes 2532*a* and 2532*b* to couple the replaceable seal 2406 with the guide block 1002. In one embodiment, the backing plate 2510 has holes 2533*a*, 2533*b*, and 2533*c* corresponding to holes 2532*a*, 2532*b*, and 2532*c* and the pins 2534*a*, 2534*b* also extend through the corresponding holes of the backing plate 2510 securing the seal member 2520 with the guide block 2402. Although only one seal member is shown, it should be understood that a plurality of seal members of varying thicknesses may be used. Other components such as isolator plates may also be used, for example, in embodiments comprising a plurality of seal members, isolator plates may be placed between each of the seal members.

In operation, the replaceable seal 2406 is uncoupled from the guide block 1002. Due to the proximity of the outer surface of the guide rail 1007 with the inner circumferential face of the 2512 of the backing plate 2510 and the inner circumferential face 2522 of the seal member, while coupled together, the backing plate 2510 and the seal member 2520 cannot be removed from the guide rail 1007. However, the two-piece design of the replaceable seal 2406 allows the uncoupling of the backing plate 2510 from the seal member 2520. After uncoupling the seal member 2520 from the backing plate 2510, the flexible seal member 2520 may be removed from the guide rail 1007 while the rigid backing plate 2510 remains on the guide rail 1007. The flexibility of the seal member 2520 allows removal of the seal member 2520 from the guide rail 1007. A new seal member may then be positioned to straddle the guide rail 1007. The new seal member is coupled with the backing plate 2510 to re-form the replaceable seal 2406 and the replaceable seal may be reattached to the guide block 1002.

Figure 26:
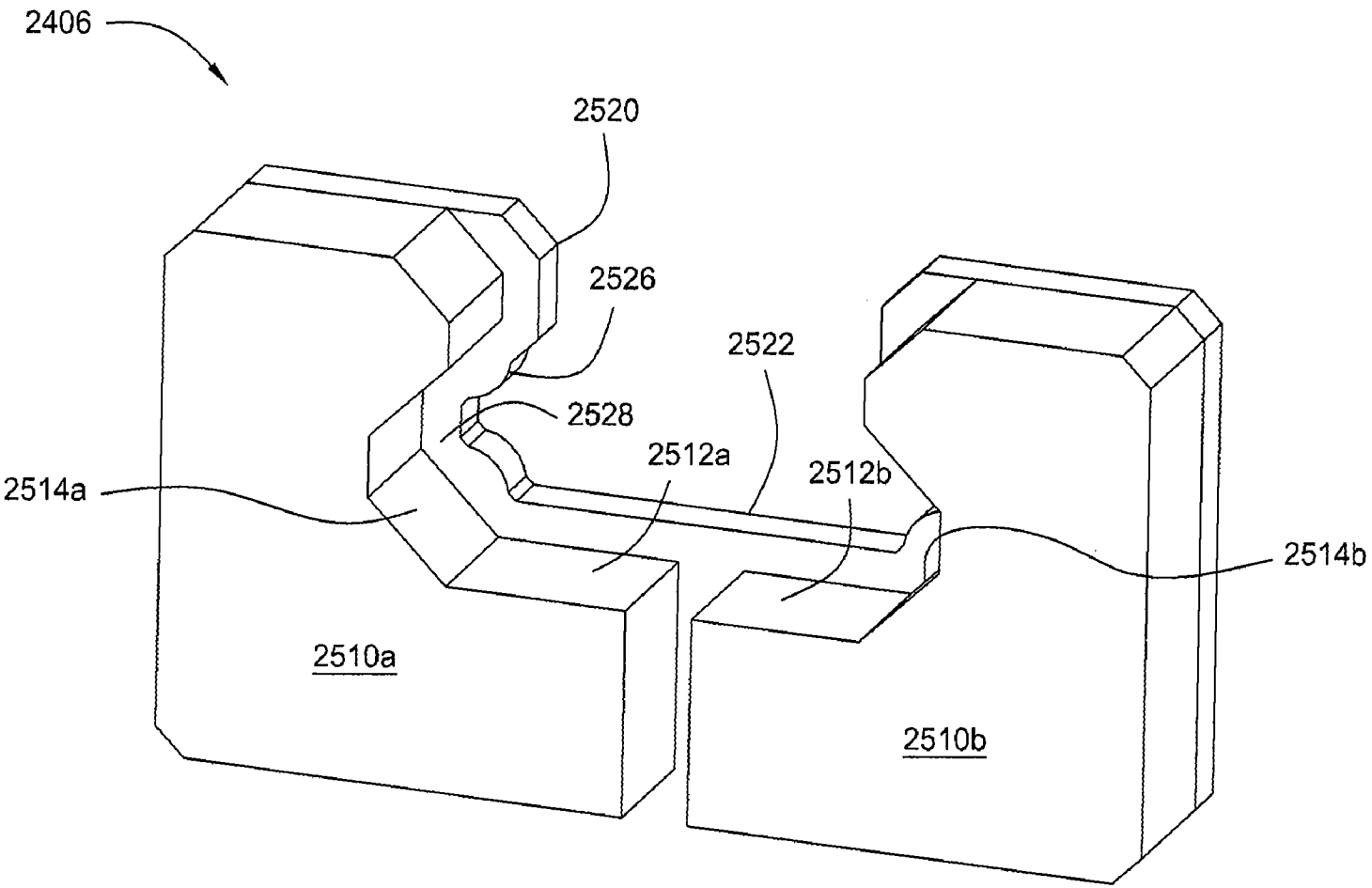
FIG. 26 is a perspective view of another replaceable seal according to one embodiment described herein.

FIG. 26 is a perspective view of another replaceable seal 2406 according to one embodiment described herein. The replaceable seal 2406 comprises a seal member 2520 coupled with two backing plates 2510*a*, 2510*b*. The backing plates 2510*a*, 2510*b* each have an inner circumferential face 2512*a*, 2512*b* forming a recessed portion 2514*a*, 2514*b* to accommodate the guide rail 1007. In one embodiment, the backing plates 2510*a*, 2510*b* are spaced apart. The backing plates 2510*a*, 2510*b* may each be individually coupled with the seal member 2520.

In operation, the seal member 2520 and backing plates 2510*a*, 2510*b* may be uncoupled from the guide rail 1007 while coupled together. In one embodiment, the backing plates 2510*a*, 2510*b* may be uncoupled from the seal member 2520 prior to uncoupling the seal member 2520 from the guide rail 1007.

In one embodiment, the replaceable seal 2406 comprises a seal member 2520 coupled with one or more backing plates 2510. In one embodiment, the replaceable seal 2406 is formed by forming the seal member 2520 around the backing plate 2510, for example, by molding the seal member 2520 on the backing plate 2510 using adhesives to form a unitary replaceable seal.

Figure 27A:
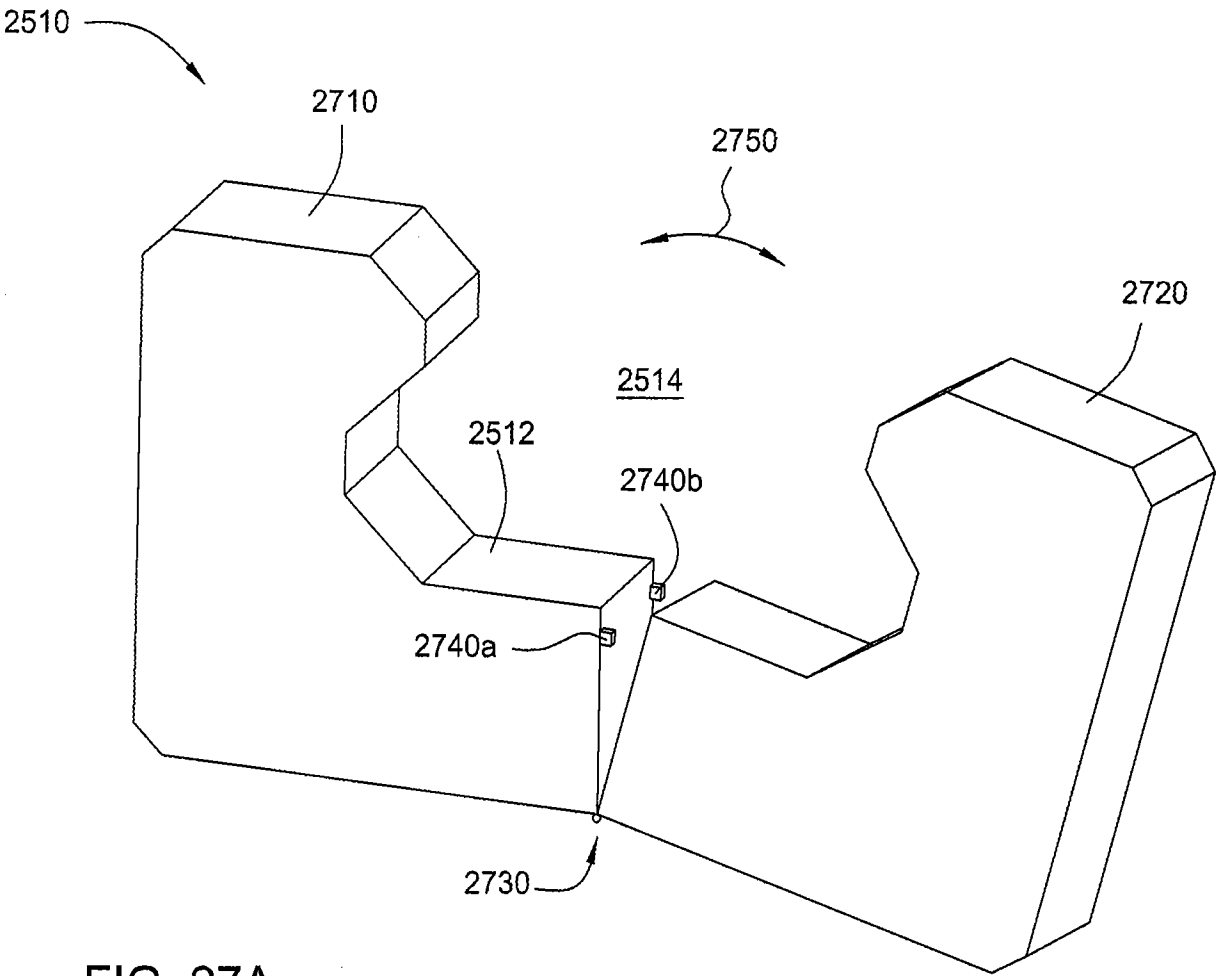
FIG. 27A is a perspective view of one embodiment of a backing plate according to one embodiment described herein.

FIG. 27A is a perspective view of one embodiment of a backing plate 2510 according to one embodiment described herein. In this embodiment, the backing plate 2510 comprises a first support member 2710 and a second support member 2720 which a coupled together to form the backing plate 2510. The two piece backing plate 2510 may be easily removed from the guide rail 1007 and guide block 1002 of the circular track without disassembling the circular track assembly.

In the embodiment shown, the first support member 2710 and the second support member 2720 are coupled together with a hinge assembly 2730 and a plurality of locking clips 2740*a*, 2740*b* positioned on the first support member 2710 that are received by a plurality of clip catching ends (not shown) on the second support member 2720 locking the first support member 2710 and the second support member 2720 together to form the backing plate 2510. It should also be understood that any other means known for coupling the first support member 2710 with the second support member 2720 may also be used. The hinge assembly 2730 allows the first support member 2710 and the second support member 2720 to open as shown by arrow 2750.

Figure 27B:
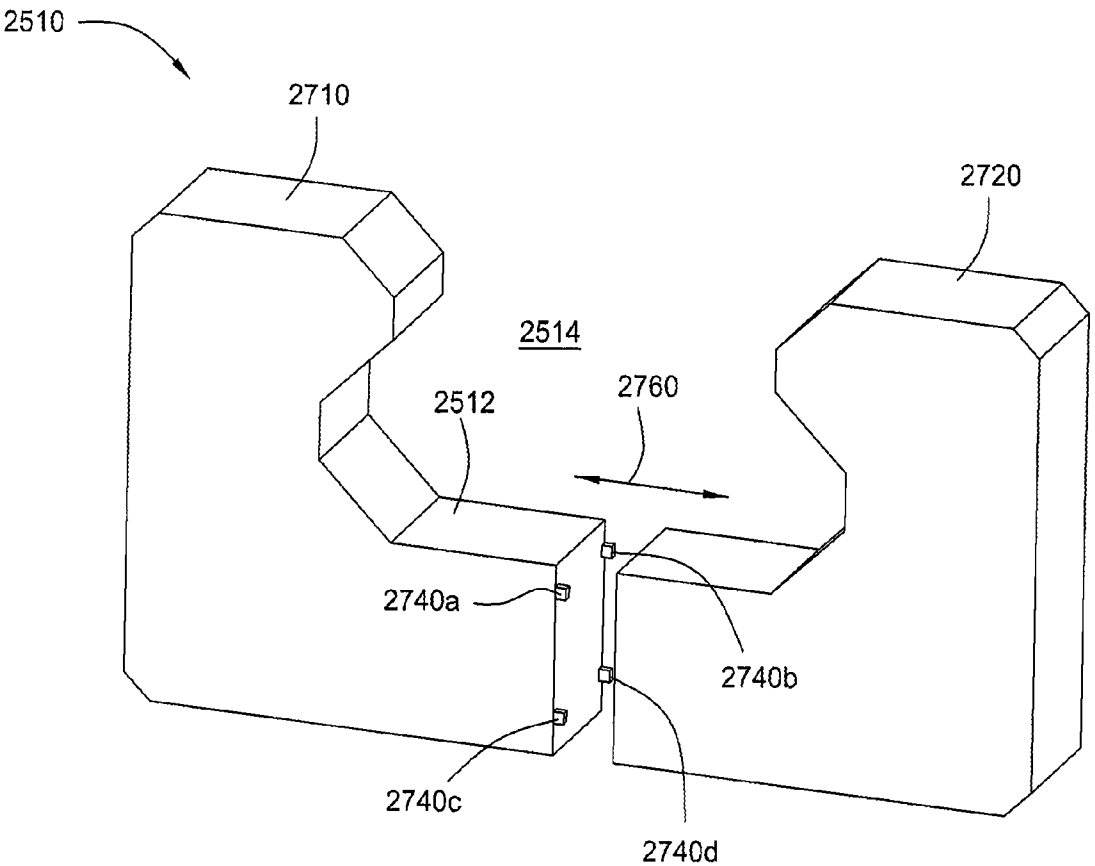
FIG. 27B is a perspective view of another embodiment of a backing plate according to one embodiment described herein.

FIG. 27B is a perspective view of another embodiment of a backing plate 2510 according to one embodiment described herein. In the embodiment shown, the first support member 2710 may be completely decoupled form the second support member 2720 as shown by arrow 2760. The first support member 2710 and the second support member 2720 are coupled together with a plurality of locking clips 2740*a*, 2740*b*, 2740*c*, 2740*d* positioned on the first support member 2710 that are received by a plurality of clip catching ends (not shown) on the second support member 2720 locking the first support member 2710 and the second support member 2720 together to form the backing plate 2510.

In one embodiment, the first support member 2710 and the second support member 2720 of the backing plate 2510 are not coupled together. In one embodiment, the first support member 2710 and the second support member 2720 are each individually coupled with the guide block 1002, effectively sandwiching the seal member between each support member 2710, 2720 and the guide block 1002.

Figure 28:
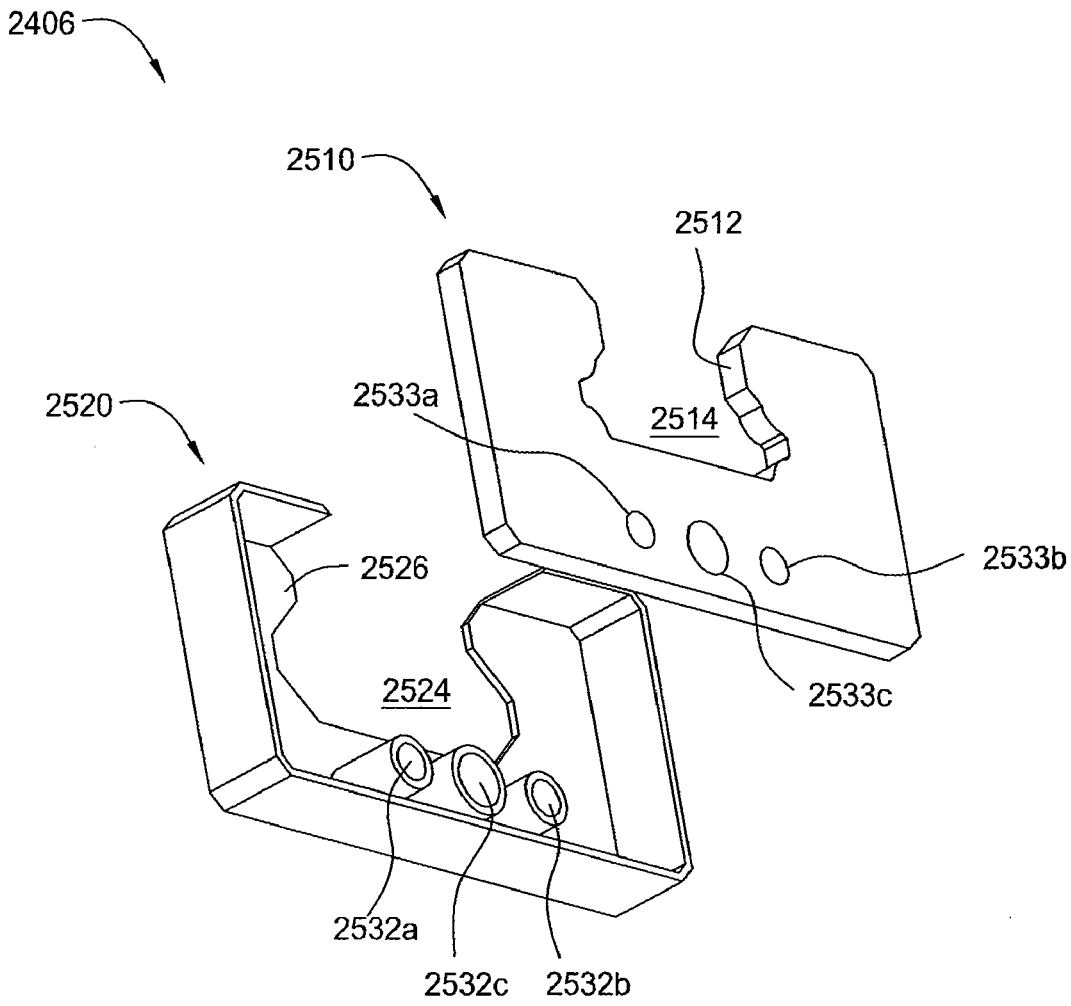
FIG. 28 is an exploded perspective view of a replaceable seal according to another embodiment described herein.

FIG. 28 is an exploded perspective view of a replaceable seal 2406 according to another embodiment described herein. The backing plate 2510 fits within the seal member 2520 providing additional rigidity to the seal member 2520. In this embodiment, the backing plate 2510 has holes 2533*a*, 2533*b*, and 2533*c* to accommodate holes 2532*a*, 2532*b*, and 2532*c* of the seal member 2520.

In operation, the replaceable seal 2406 is uncoupled from the guide block 1002. Due to the proximity of the outer surface of the guide rail 1007 with the inner circumferential face of the 2512 of the backing plate 2510 and the inner circumferential face 2522 of the seal member 2520, while coupled together, the backing plate 2510 and the seal member 2520 cannot be removed from the guide rail 1007. However, the two-piece design of the replaceable seal 2406 allows the uncoupling of the backing plate 2510 from the seal member 2520. After uncoupling the seal member 2520 from the backing plate 2510, the flexible seal member 2520 may be removed from the guide rail 1007 and the two piece backing plate 2510 may also be removed from the guide rail 1007. A new seal member and a new backing plate may then be positioned to straddle the guide rail 1007. The new seal member is coupled with new the backing plate to re-form the replaceable seal 2406 and the replaceable seal may be reattached to the guide block 1002.

In one embodiment, the seal member 2520 may also comprise multiple pieces. For example, the seal member 2520 may be two pieces. However, the pieces of the seal member 2520 are compressed together such that there is no gap in the seal member after installation. In one embodiment, the multiple piece seal member is used with the multi-piece backing plate. In another embodiment, the multi-piece seal member is used with the unitary backing plate.

The backing plate 2510 may comprise metals compatible with process chemistries such as aluminum or stainless steel. The seal member 2520 may comprise rubber or any other elastic material, for example, synthetic rubber and fluoropolymer elastomer. In one embodiment, the seal member 2520 comprises a rubber material coated on a plate-shaped metal.

One way to increase system uptime is to develop hardware that is easily removed and replaced without significant modifications to the substrate fabrication system. Embodiments described herein increase system uptime by providing a replaceable seal device that is easily removed from and easily installed on a circular track system with minimal system downtime. Advantageously, the replaceable seal or a portion of the replaceable seal may be removed from the guide rail of a circular track without disassembling the circular track itself.

Figure 29:
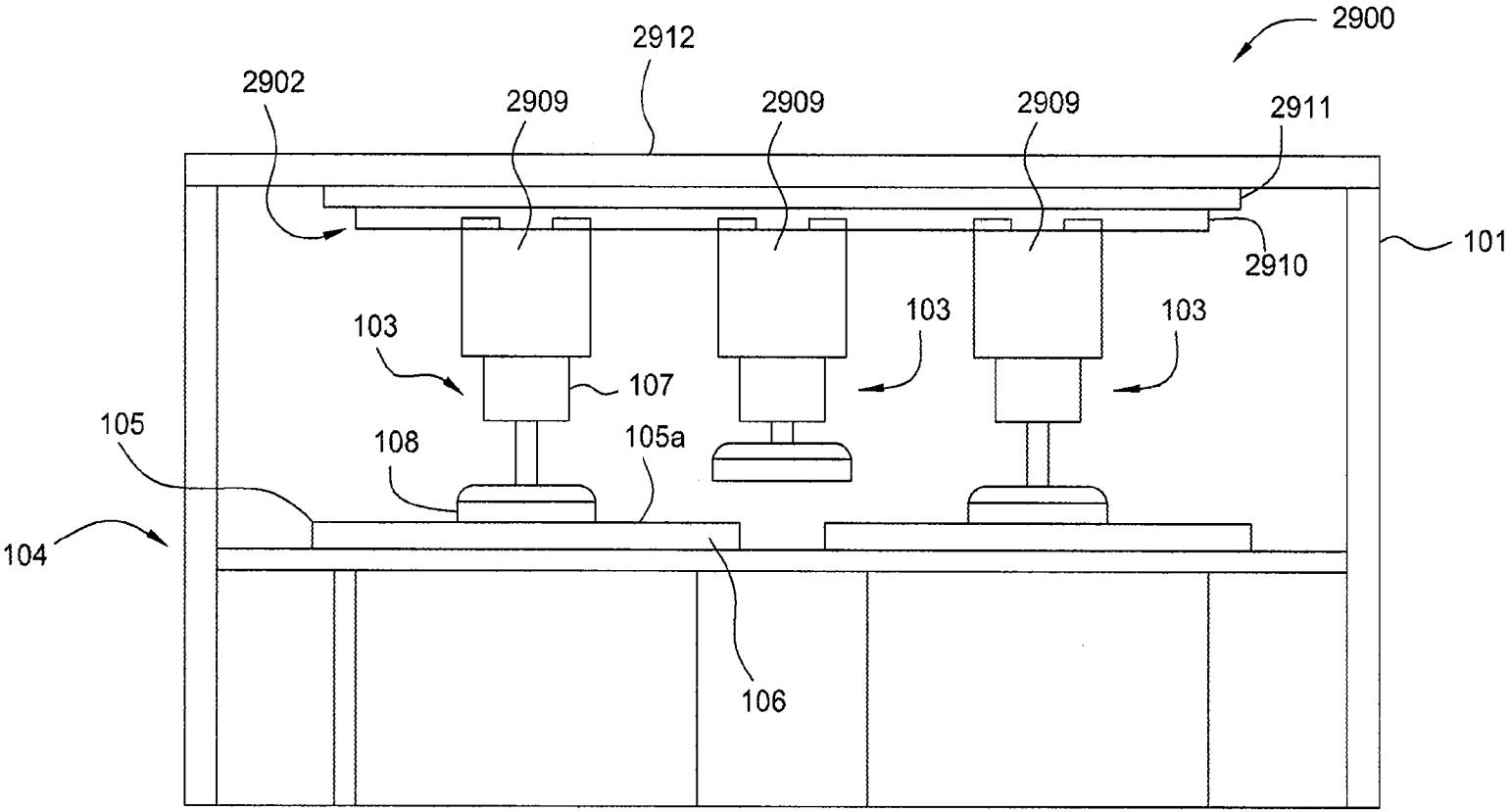
FIG. 29 illustrates a schematic side view of a track polishing system with a guide assembly in accordance with one embodiment described herein.

Circular Track Installation:

FIG. 29 is a schematic side view of a track polishing system 2900 with a guide assembly 2902 in accordance with one embodiment described herein. The track polishing system 2900 comprises a system frame 101 configured to provide support for an apparatus used in a polishing process.

The guide assembly 2902 is coupled with an upper portion of the system frame 101 and a processing platform 104 is installed on a lower portion of the system frame 101. In one embodiment, the upper system of the support frame 101 comprises a top plate 2912 and the guide assembly 2902 is coupled with the top plate 2912. In one embodiment, a number of components (not shown), such as electronic components are mounted on the top plate 2912. In another embodiment, the guide assembly 2902 may be coupled directly with the support frame 101. In one embodiment, the processing platform 104 may comprise a combination of modulated tools, such as polishing stations, load cups, and cleaning stations according to process requirement. Similar to FIG. 1, the processing platform 104 comprises one or more polishing stations 105.

In one embodiment, the guide assembly 2902 comprises a plate 2911 coupled with a track body 2910 defining a path along which the polishing heads 103 may move. The guide assembly 2902 further comprises one or more carriages 2909 movably connected to the track body 2910. Each of the one or more carriages 2909 is configured to carry at least one polishing head 103.

Figure 30A:
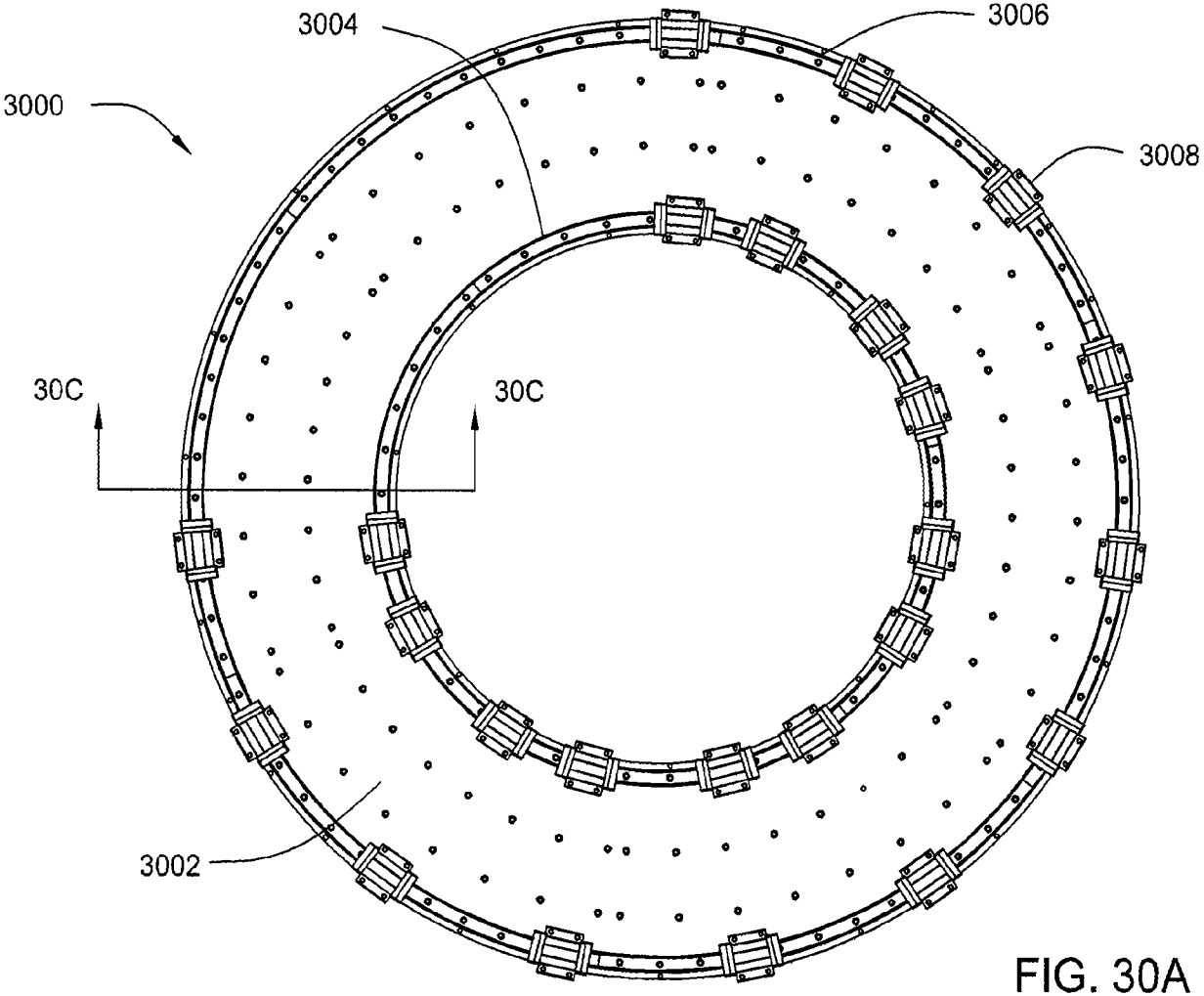
FIG. 30A illustrates a schematic bottom view of a guide assembly in accordance with one embodiment described herein.

FIG. 30A illustrates a schematic bottom view of a guide assembly 3000 in accordance with one embodiment described herein. FIGS. 30B-30E illustrate schematic partial cross-sectional views of the guide assembly 3000 in accordance with embodiments described herein. FIG. 30C is a partial cross-sectional view taken along line 30C of FIG. 30A. Line 3020 represents the center axis of the guide assembly 3000. The guide assembly 3000 comprises a plate 3002 and a pair of concentric guide rails including an inner circular guide rail 3004, and an outer circular guide rail 3006 coupled with the plate 3002. In one embodiment, a plurality of pins 3024 may be used to secure the inner 3004 and outer guide rails 3006 to the plate 3002 for preventing the lateral movement of the inner and outer guide rails. In one embodiment the plate 3002 is an annular shaped plate. In one embodiment, the plate 3002 is an annular band shaped band. In one embodiment, the inner circular guide rail 3004 and the outer circular guide rail 3006 are concentric. A plurality of guide blocks 3008 may be coupled with both the inner circular guide rail 3004 and the outer circular guide rail 3006. The plate 3002 also has a plurality of holes 3010 for coupling the guide assembly with the system frame 101. In one embodiment the plate 3002 comprises a process compatible material such as aluminum, stainless steel or combinations thereof.

Figure 30B:
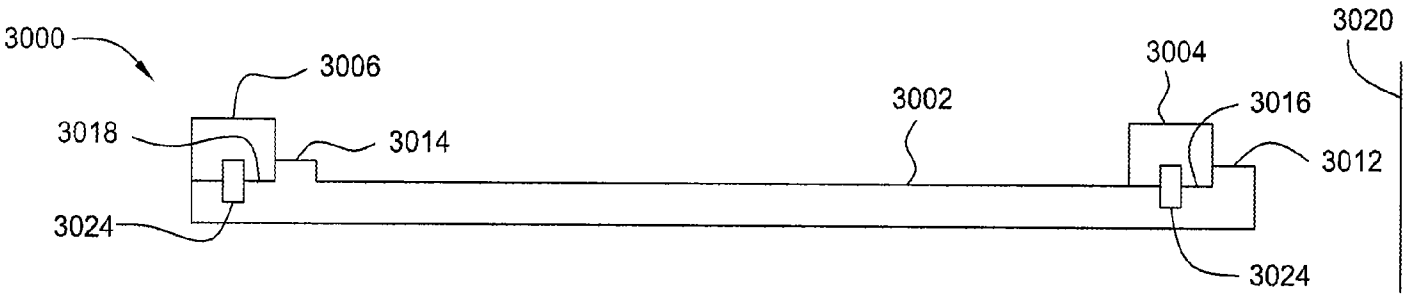
FIG. 30B illustrates a schematic partial cross-sectional view of a guide assembly in accordance with one embodiment described herein.
Figure 30C:
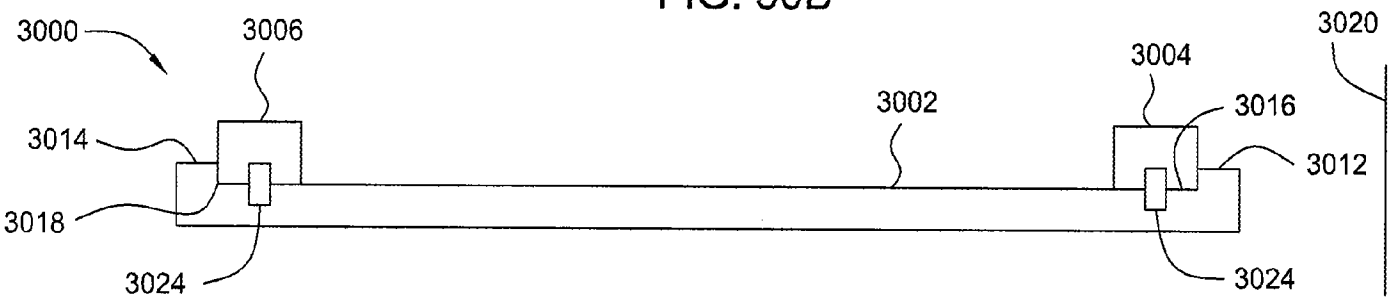
FIG. 30C illustrates a schematic partial cross-sectional view of a guide assembly in accordance with another embodiment described herein.
Figure 30D:
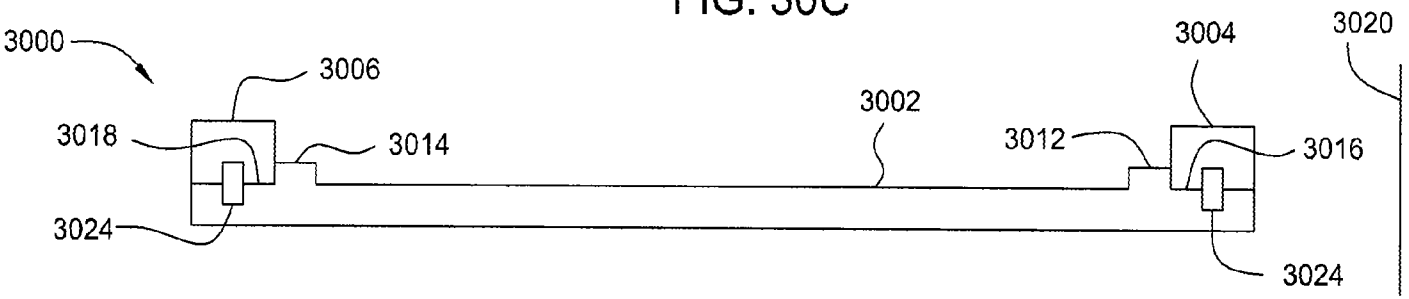
FIG. 30D illustrates a schematic partial cross-sectional view of a guide assembly in accordance with another embodiment described herein.

Referring to FIGS. 30B-30D, the guide assembly 3000 may also comprise an inner circular shoulder 3012 and an outer circular shoulder 3014 that provide a fixed reference for alignment of the inner circular guide rail 3004 and the outer circular guide rail 3006. The inner circular shoulder 3012 forms a step 3016 with a surface of the plate 3002. The step 3016 provides a fixed reference for the inner circular guide rail 3004. The outer circular shoulder 3014 forms a step 3018 with a surface of the plate 3002. The step 3018 provides a fixed reference for the outer circular guide rail 3006. The inner circular shoulder 3012 and outer circular shoulder 3014 may also help the inner circular guide rail 3004 and the outer circular guide rail 3006 withstand lateral forces.

Figure 30E:
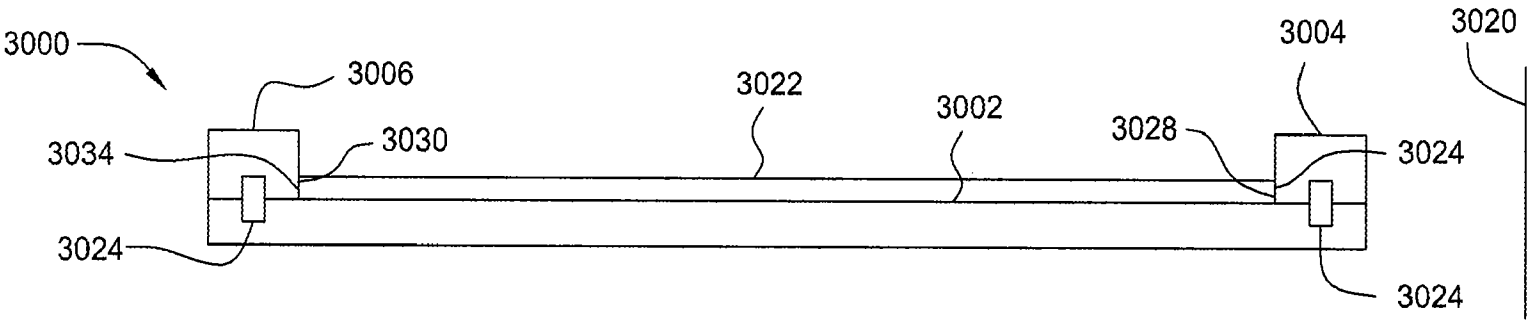
FIG. 30E illustrates a schematic partial cross-sectional view of a guide assembly in accordance with another embodiment described herein.

Referring to FIG. 30E, in another embodiment, the guide assembly 3000 may further comprise a shoulder plate 3022 coupled with the plate 3002. The shoulder plate 3022 comprises an annular body defined by an inner circular shoulder 3028 and an outer circular shoulder 3030 that provide a fixed reference for alignment of the inner circular guide rail 3004 and the outer circular guide rail 3006. The inner circular shoulder 3028 forms a step 3032 with a surface of the plate 3002. The step 3032 provides a fixed reference for the inner circular guide rail 3004. The outer circular shoulder 3030 forms a step 3034 with a surface of the plate 3002. The step 3034 provides a fixed reference for the outer circular guide rail 3006. The inner circular shoulder 3028 and the outer circular shoulder 3030 may also help the inner circular guide rail 3004 and the outer circular guide rail 3006 withstand lateral forces.

Figure 30F:
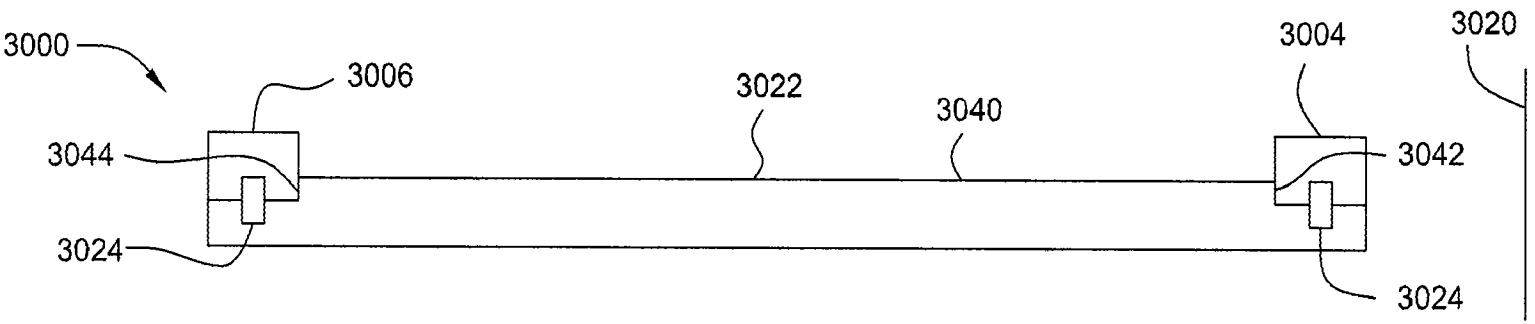
FIG. 30F illustrates a schematic partial cross-sectional view of a guide assembly in accordance with another embodiment described herein.

Referring to FIG. 30F, in another embodiment, the plate 3002 has a raised portion 3040 that provides a fixed reference for alignment of the inner circular guide rail 3004 and the outer circular rail 3006. The raised portion 3040 is defined by inner circular shoulder 3042 and an outer circular shoulder 3044 that provide a fixed reference for alignment of the inner circular guide rail 3004 and the outer circular rail 3006.

In certain embodiments, the inner circular shoulder 3012 and the outer circular shoulder 3014 form a unitary body with the plate 3002. In certain embodiments, the inner circular shoulder 3012 and the outer circular shoulder 3014 are separate pieces that may be coupled with the plate 3002.

Figure 30G:
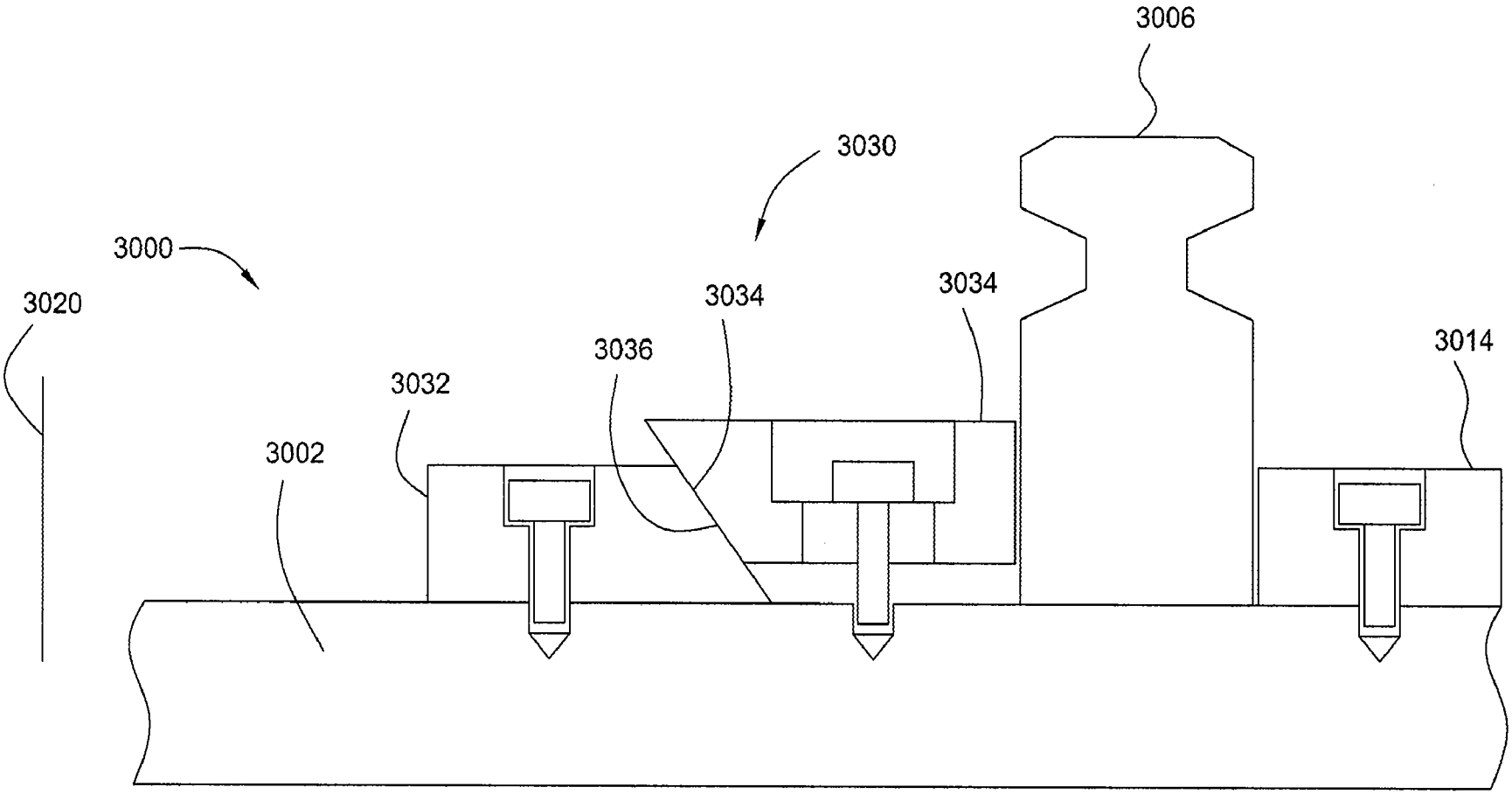
FIG. 30G illustrates a schematic cross-sectional view of a guide assembly in accordance with another embodiment described herein.

FIG. 30G illustrates a schematic cross-sectional view of a guide assembly 3000 in accordance with another embodiment described herein. The guide assembly 3000 depicted in FIG. 30G uses a two-piece wedge 3300 coupled with the plate 3002. The two-piece wedge 3030 may be positioned along the inner diameter of the outer circular guide rail 3006. When positioned along the inner diameter of the outer circular guide rail 3006 the two-piece wedge 3030 reduces lateral movement of the guide rail 3006. The two-piece wedge 3030 comprises a fixed wedge piece 3032 coupled with the body of the guide assembly 3002 and an adjustable wedge piece 3034 that may be adjustably coupled with the guide assembly 3002. The fixed wedge piece 3032 has a slanted mating surface that fits with a corresponding slanted mating surface 3036 of the adjustable wedge piece 3034. In one embodiment, a second two-piece wedge assembly may be positioned along the inner diameter of the inner circular guide rail 3004 with an inner circular shoulder positioned along the outer diameter of the inner circular guide rail 3004. In another embodiment, a first two-piece wedge assembly may be positioned along the outer diameter of the inner circular guide rail 3004 and a second two-piece wedge assembly may be positioned along the outer diameter of the outer circular with fixed circular shoulder positioned on the opposite side of each guide rail. In yet another embodiment, a two-piece wedge assembly may be positioned along either the outer diameter of the inner circular guide rail 3004 and a second two-piece wedge assembly may be positioned along the inner diameter of the outer circular with fixed circular shoulder positioned on the opposite side of each guide rail.

In one embodiment, as shown in FIG. 30B, the inner circular shoulder 3012 is positioned along the inner diameter of the inner circular guide rail 3004 and the outer circular shoulder is positioned along the inner diameter of the outer circular guide rail 3006. In another embodiment, as shown in FIG. 30C, the inner circular shoulder 3012 is positioned along the inner diameter of the inner circular guide rail 3004 and the outer circular shoulder is positioned along the outer diameter of the outer circular guide rail 3006. In yet another embodiment, the inner circular shoulder 3012 is positioned along the outer diameter of the inner circular guide rail 3004 and the outer circular shoulder 3014 is positioned along the inner diameter of the outer circular guide rail 3006.

Figure 31:
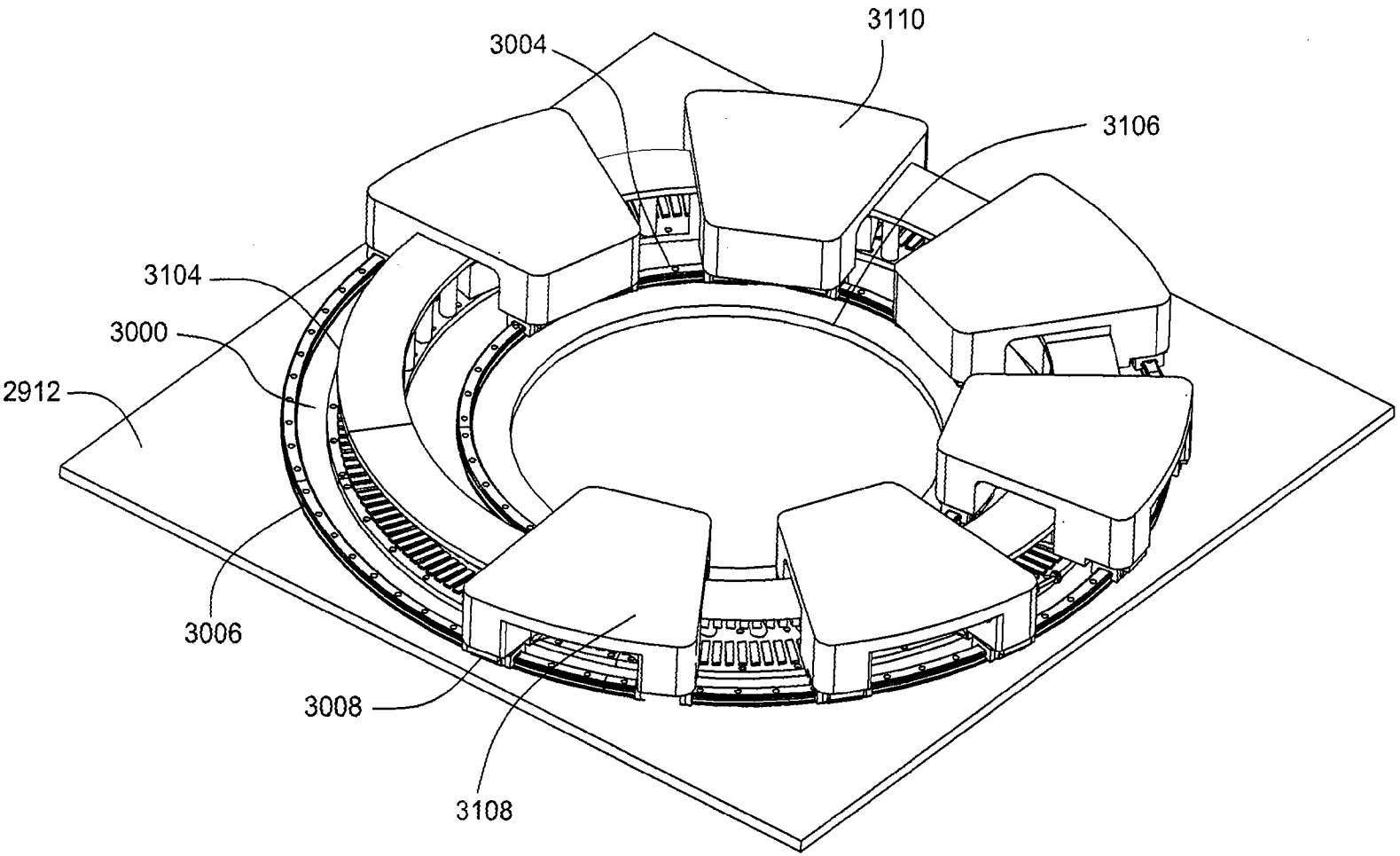
FIG. 31 illustrates a perspective view a guide assembly in accordance with one embodiment described herein.

FIG. 31 illustrates a perspective view a guide assembly coupled with a top plate 2912 in accordance with one embodiment described herein. The top plate 2912 and guide assembly 3000 may be coupled with an upper portion of a system frame such as system frame 101 and a processing platform 104. Two concentric guiding rails 3004, 3006, are coupled with the guide assembly 3000. A linear motor magnet track 3104 is coupled with the guide assembly. In one embodiment, the linear motor magnet track is dimensioned to have a width such that the linear motor magnet track 3104 functions as a fixed reference for placement of the inner circular guide rail 3004 and the outer circular guide rail 3006. In one embodiment, an encoder scale 3106 may be coupled with the guide assembly 3000. In another embodiment, the encoder scale 3106 may be coupled with the top plate. An adapter assembly 3108 comprising guide blocks 3008 and an adapter plate 3110 may be coupled with the inner circular guide rail 3004 and the outer circular guide rail 3006.

Typically, the installation of a circular track assembly into a track polishing system comprises several steps. Six inner guide segments with guide blocks are coupled directly with a top plate of the track polishing system. Six outer guide segments with guide blocks are then coupled directly with the top plate of the track polishing system. Alignment blocks are installed on the inner and outer sides of the inner and outer guide segments. The inner guide segments are aligned with each other using set screws on the alignment blocks. The outer guide segments are aligned with each other and the with the inner guide segment using set screws on the alignment blocks. An adapter assembly and an encoder scale are installed on the track polishing system. The encoder scale is aligned with the encoder read head. A linear motor magnet track is installed and aligned with the linear motor coil.

Figure 32:
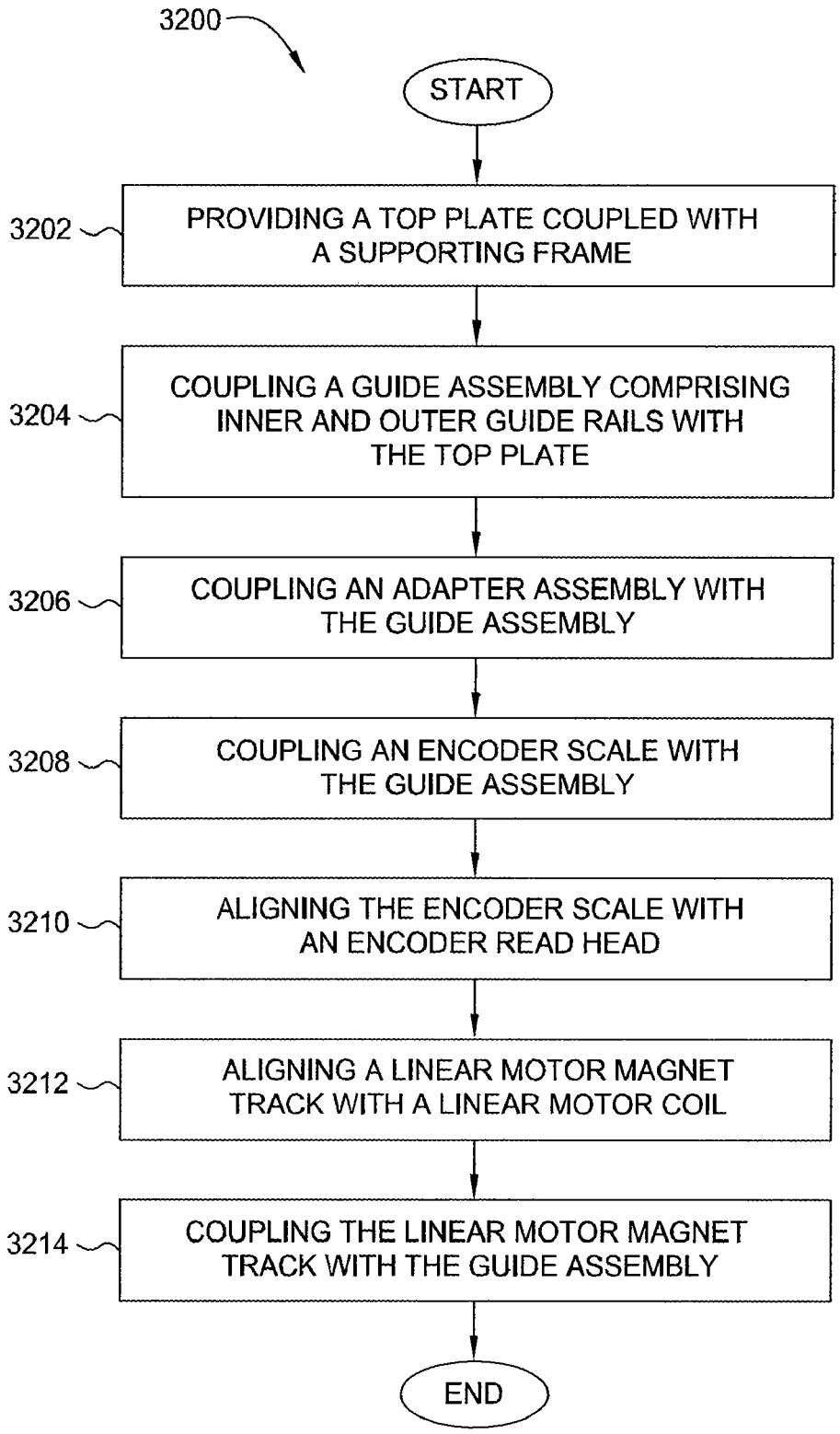
FIG. 32 illustrates a process sequence for the installation of a guide assembly into a track polishing system described herein.

FIG. 32 illustrates a process sequence 3200 for the installation of a guide assembly into a track polishing system. A top plate 2912 coupled with a supporting frame is provided (block 3202). A guide assembly 300 comprising inner 304 and outer circular guide rails 306 is coupled with the top plate 2912 (block 3204). An adapter assembly 3108 is coupled with the guide assembly 3000 (block 3206). An encoder scale 3106 is coupled with the guide assembly 2902 (block 3208). In one embodiment the encoder scale is coupled with the top plate 2912. The encoder scale 3106 is aligned with a sensor assembly (block 3210). In one embodiment, the sensor assembly comprises an encoder reader head to read the encoder scale. A linear motor magnet track is aligned with a linear motor magnet coil (block 3212). The linear motor magnet track is coupled with the guide assembly 3000 (block 3214).

One way to increase system uptime is to develop hardware that is easily removed and replaced without significant modifications to the substrate fabrication system. Embodiments described herein increase system uptime by providing a guide assembly that is easily removed from a circular track system with minimal system downtime. Advantageously, the guide assembly and the inner circular guide and/or the outer circular guide may be removed from the support frame of the circular track system without disassembling the circular track system. Further, the alignment and mounting of the inner and outer circular guide on the guide assembly may be performed by the manufacturer thus increasing the repeatability of the alignment and set up of the guides from tool to tool.

While the foregoing is directed to embodiments described herein, other and further embodiments of the invention may be devised without departing from the basic scope thereof, and the scope thereof is determined by the claims that follow.

What is claimed is:

1. A track system configured to transfer polishing heads in a polishing system, comprising:

a supporting frame;

a track coupled to the supporting frame and defining a path along which the polishing heads are configured to move; and one or more carriages configured to carry at least one polishing head along the path defined by the track, wherein the one or more carriages are coupled to the track and independently movable along the track, wherein the track comprises a stator strip disposed along the path, and each of the one or more carriages comprises a rotor configured to move and stop the respective carriage by reacting with the stator strip.

2. The track system of claim 1, wherein the stator strip comprises a plurality of permanent magnetic segments, and the rotor of each carriage comprises a segment motor facing the plurality of permanent magnetic segments.

3. The track system of claim 1, wherein the track further comprises a guiding rail disposed along the stator strip, and each of the one or more carriages comprises one or more guiding blocks which movably couple the respective carriage to the guiding rail and restrict movements of the respective carriage within the path.

4. The track system of claim 3, wherein each of the guiding rail and the stator strip form a closed loop.

5. The track system of claim 1, wherein the stator strip is circular, and the track further comprises:

a first circular guiding rail disposed concentric to the stator strip; and a second circular guiding rail disposed concentric to the stator strip, and each of the one or more carriages comprises four guiding blocks which movably couple the respective carriage to the first and second guiding rails and restrict movements of the respective carriage within the path.

6. The track system of claim 5, wherein the first circular guiding rail has a diameter larger than a diameter of the stator strip, the second circular guiding rail has a diameter smaller than the diameter of the stator strip, and each of the one or more carriages is configured to carry one or more polishing head between the first and second circular guiding rails.

7. The track system of claim 1, wherein the track further comprises an encoder scale disposed along the path, and each of the one or more carriages comprises an encoder sensor facing the encoder scale and configured to sense a position of the respective carriage in the path.

8. The track system of claim 7, further comprising a carriage controller connected with the encoder sensor and configured to independently control movements of the respective carriage according to measurements from the encoder sensor.

9. A track system configured to transfer polishing heads in a polishing system, comprising:

a supporting frame;

a track coupled to the supporting frame and defining a path along which the polishing heads are configured to move;

one or more carriages configured to carry at least one polishing head along the path defined by the track, wherein the one or more carriages are coupled to the track and independently movable along the track; and a shield assembly coupled with the supporting frame and isolating the track from a processing environment.

10. A method for polishing semiconductor substrates, comprising:

loading a substrate onto a polishing head configured to transfer the substrate among loading, unloading and polishing stations;

moving the polishing head along a track system to a first polishing station, wherein the system comprises:

a supporting frame;

a track coupled to the supporting frame and defining a circular path along which the polishing heads have access to the loading, unloading and polishing stations; and one or more carriages configured to carry at least one polishing head along the path defined by the track, wherein the one or more carriages are coupled to the track and independently movable along the track; and polishing the substrate at the first polishing station, wherein the track comprises a circular stator strip comprising a plurality of magnetic segments disposed along the circular path, and each of the one or more carriages comprises a segment motor configured to move and stop the respective carriage by reacting with the plurality of permanent magnetic segments.

11. The method of claim 10, wherein polishing the substrate comprises oscillating the polishing head along the track.

12. A polishing head for a polishing system having a track, comprising:

a carriage body;

one or more guide blocks mounted on the carriage body, wherein the one or more guide blocks are configured to couple with a track and restrict movements of the carriage body to along the track;

a sliding actuator connected to the carriage body and configured to move the carriage body along the track;

a first polishing motor connected with the carriage body, wherein the first polishing motor is moved with the movement of the carriage body;

a first substrate carrier configured to secure a substrate during transferring and polishing, wherein the first substrate carrier is coupled to the first polishing motor and rotated by the first polishing motor during polishing; and a sensor assembly disposed on the carriage body, wherein the sensor assembly is configured to measure a position of the polishing head on the track.

13. The polishing head of claim 12, wherein the track is a circular track and the one or more guide blocks have curved sliding channels configured to adapt to a curvature of the circular track.

14. The polishing head of claim 12, wherein the sliding actuator is a segment motor configured to move the carriage body by reacting with a plurality of permanent magnetic segments disposed along the track.

15. The polishing head of claim 14, wherein the sliding actuator is further configured to oscillate the carriage body about a position on the track to provide sweeping motion to the first substrate carrier during polishing.

16. The polishing head of claim 14, further comprising a sweeping actuator connected to the carriage body and configured to oscillate the carriage body about a position on the track to provide sweeping motion to the first substrate carrier during polishing, wherein the sweeping actuator is a segment motor that oscillates the carriage body by reacting with the plurality of permanent magnetic segments disposed along the track.

17. The polishing head of claim 12, further comprising:

a second polishing motor connected with the carriage body, wherein the second polishing motor is moved with the movement of the carriage body; and a second substrate carrier configured to secure a substrate during transferring and polishing, wherein the second substrate carrier is coupled to the second polishing motor and rotated by the second polishing motor during polishing.

18. The polishing head of claim 17, further comprising a first sweeping actuator connected to the carriage body and configured to oscillate the carriage body about a position on the track to provide sweeping motion to the first and second substrate carriers during polishing.

19. The polishing head of claim 17, further comprising:

a first sweeping actuator connected between the carriage body and the first polishing motor, wherein the first sweeping actuator is configured to oscillate first polishing motor about a position on the track to provide sweeping motion to the first substrate carrier during polishing; and a second sweeping actuator connected between the carriage body and the second polishing motor, wherein the second sweeping actuator is configured to oscillate the second polishing motor about a position on the track to provide sweeping motion to the second substrate carrier during polishing.

20. A polishing head for a polishing system having a track, comprising:

a carriage body;

one or more guide blocks mounted on the carriage body, wherein the one or more guide blocks are configured to couple with a track and restrict movements of the carriage body to along the track;

a sliding actuator connected to the carriage body and configured to move the carriage body along the track;

a first polishing motor connected with the carriage body, wherein the first polishing motor is moved with the movement of the carriage body; and a first substrate carrier configured to secure a substrate during transferring and polishing, wherein the first substrate carrier is coupled to the first polishing motor and rotated by the first polishing motor during polishing, the carriage body comprises a C shape body wrapping around a section of the track, the one or more guide blocks are mounted on an upper portion of the C shape body, and the first polishing motor is mounted on a lower portion of the C shape body.

21. A polishing head for a polishing system having a track, comprising:

a carriage body;

one or more guide blocks mounted on the carriage body, wherein the one or more guide blocks are configured to couple with a track and restrict movements of the carriage body to along the track;

a sliding actuator connected to the carriage body and configured to move the carriage body along the track;

a first polishing motor connected with the carriage body, wherein the first polishing motor is moved with the movement of the carriage body; and a first substrate carrier configured to secure a substrate during transferring and polishing, wherein the first substrate carrier is coupled to the first polishing motor and rotated by the first polishing motor during polishing, the carriage body comprises a cantilever body, the one or more guide blocks are mounted on one end of the cantilever body, and the first polishing motor is mounted on an opposite end of the cantilever body.

* * * * *

UNITED STATES PATENT AND TRADEMARK OFFICE

CERTIFICATE OF CORRECTION

PATENT NO. : 8,172,643 B2
APPLICATION NO. : 12/420996
DATED : May 8, 2012
INVENTOR(S) : Yilmaz et al.

It is certified that error appears in the above-identified patent and that said Letters Patent is hereby corrected as shown below:

Column 4, Line 3, delete “unshaped” and insert --u-shaped-- therefor.

Signed and Sealed this
Twenty-eighth Day of August, 2012

David J. Kappos

David J. Kappos
*Director of the United States Patent and Trademark Office*